US007103919B2

(12) United States Patent
Isom et al.

(10) Patent No.: US 7,103,919 B2
(45) **Date of Patent: *Sep. 12, 2006**

(54) HAND COVERING

(75) Inventors: Matthew Isom, Baltimore, MD (US); Brian E. Le Gette, Baltimore, MD (US); Alan Tipp, Baltimore, MD (US); Justin Saul Werner, Millersville, MD (US); Ronald L. Wilson, II, Catonsville, MD (US)

(73) Assignee: 180s, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/358,397

(22) Filed: Feb. 5, 2003

(65) Prior Publication Data

US 2004/0148681 A1 Aug. 5, 2004

Related U.S. Application Data

(63) Continuation of application No. 10/062,508, filed on Feb. 5, 2002.

(51) Int. Cl.
*A41D 19/00* (2006.01)

(52) U.S. Cl. ..... 2/160

(58) Field of Classification Search ..... 2/161.1, 2/161.6, DIG. 1, DIG. 3
See application file for complete search history.

(56) References Cited

U.S. PATENT DOCUMENTS

| | | | | |
|---|---|---|---|---|
| 2,842,771 A | | 7/1958 | Foti | |
| 3,121,877 A | * | 2/1964 | Gintner | 2/159 |
| 3,259,914 A | | 7/1966 | Johnson | |
| 3,649,966 A | * | 3/1972 | Shields | 2/159 |
| 3,706,102 A | | 12/1972 | Grenier | |
| 3,992,723 A | * | 11/1976 | Lazanas | 2/161.7 |
| 4,021,640 A | | 5/1977 | Gross et al. | |
| 4,965,886 A | | 10/1990 | Ockels | |
| 5,025,502 A | | 6/1991 | Raymond et al. | |
| 5,120,304 A | * | 6/1992 | Sasaki | 604/35 |
| 5,345,609 A | * | 9/1994 | Fabry et al. | 2/20 |
| 5,832,539 A | * | 11/1998 | Williams | 2/239 |
| 5,833,915 A | | 11/1998 | Shah | |
| 6,009,713 A | * | 1/2000 | Horn | 62/89 |
| 6,055,670 A | * | 5/2000 | Parker | 2/161.1 |
| 6,060,693 A | | 5/2000 | Brown | |

FOREIGN PATENT DOCUMENTS

| | | |
|---|---|---|
| DE | 1 839 911 | 10/1961 |
| DE | 3301231 A1 | 7/1984 |
| DE | 3326085 A1 | 4/1985 |

(Continued)

OTHER PUBLICATIONS

Outdoor Retailer's Newsbytes, "Gore Gives New Inflatable Insulation a Public Airing", www.outdoorretailer.com/or_ main/news/archive/200112.htm, Dec. 12, 2001, pp. 1,2 and 21.

(Continued)

*Primary Examiner*—Katherine M. Moran
(74) *Attorney, Agent, or Firm*—Cooley Godward LLP

(57) ABSTRACT

A hand covering has a hand-receiving portion and a cover. The hand-receiving portion is closed at a first end and defining an opening at a second end. The hand covering comprises an air distribution device and an inlet cover. The air distribution device is disposed between the cover and the hand-receiving portion. The air distribution device has an inlet and an outlet. The inlet cover is removably coupled to the inlet of the air distribution device.

30 Claims, 65 Drawing Sheets

FOREIGN PATENT DOCUMENTS

| | | | |
|---|---|---|---|
| DE | 3619180 | A1 | 12/1987 |
| FR | 2 089 036 | | 1/1972 |
| FR | 2 124 257 | | 9/1972 |
| FR | 2 206 916 | | 6/1974 |
| JP | 7-18504 | | 1/1995 |
| WO | WO 92/17079 | * | 10/1992 |
| WO | WO 92/17079 | A1 | 10/1992 |
| WO | WO 01/74186 | A2 | 10/2001 |

OTHER PUBLICATIONS

Formulaire Enveloppe Soleau, dated Nov. 9, 2001, 1 page.

* cited by examiner

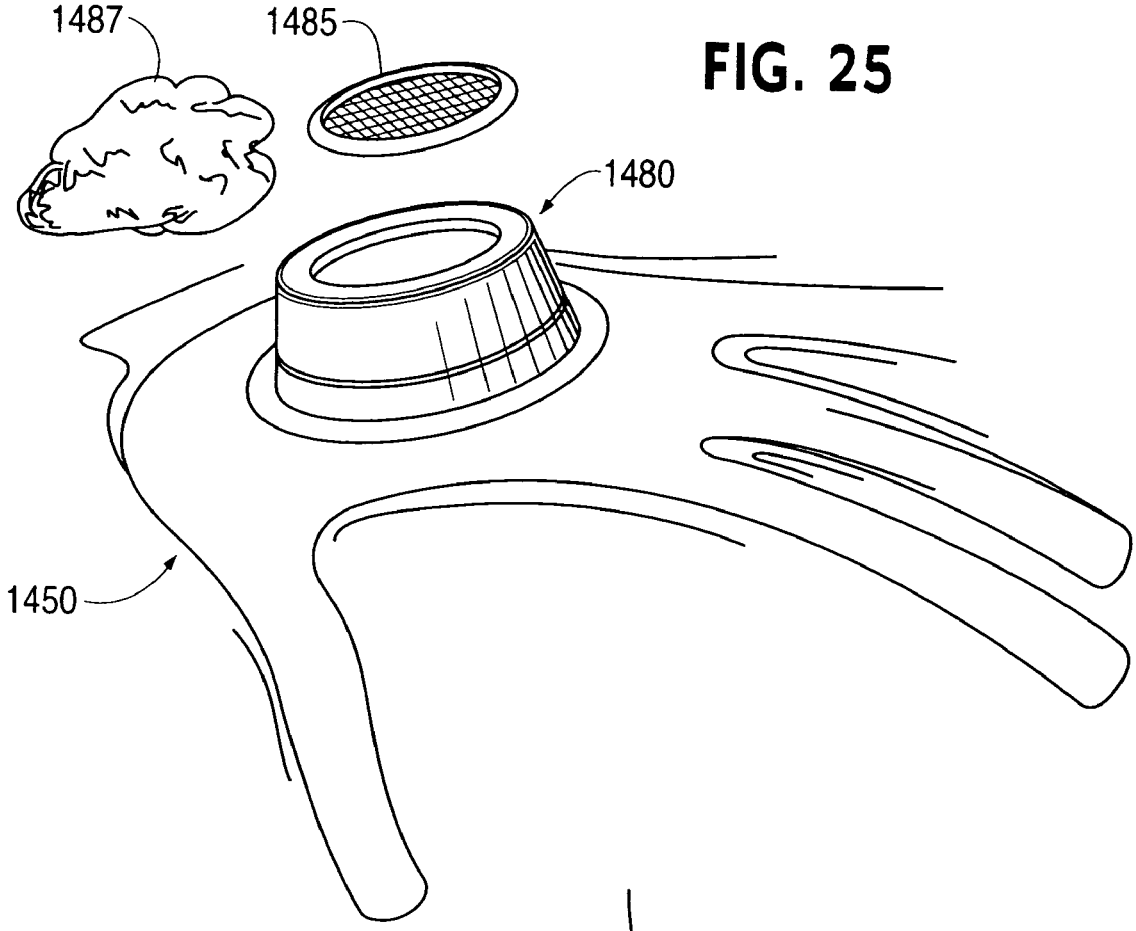
FIG. 25
FIG. 26
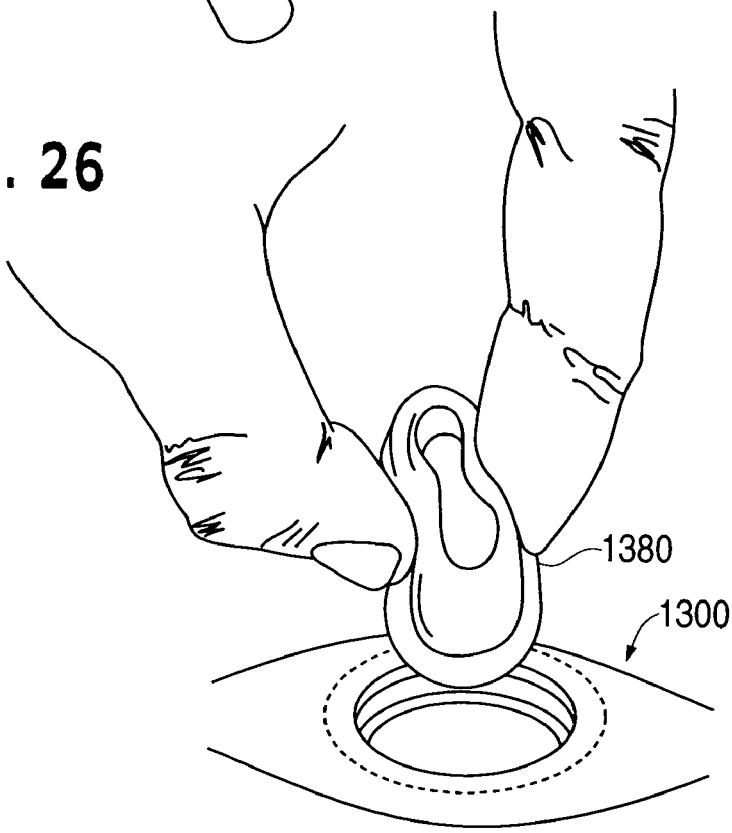

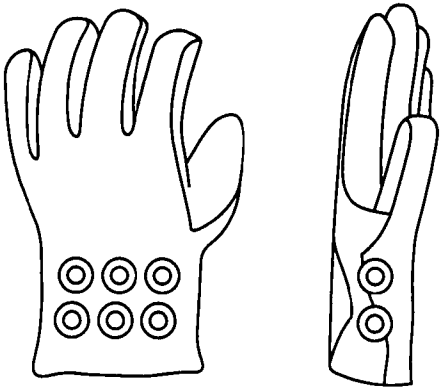
FIG. 98
FIG. 99
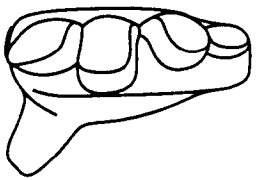
FIG. 100
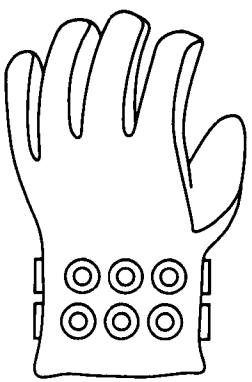
FIG. 101
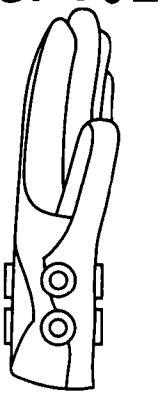
FIG. 102
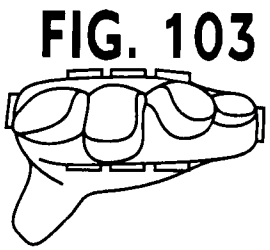
FIG. 103
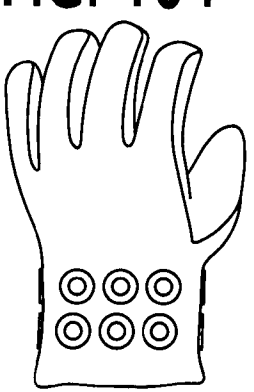
FIG. 104
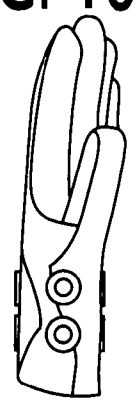
FIG. 105
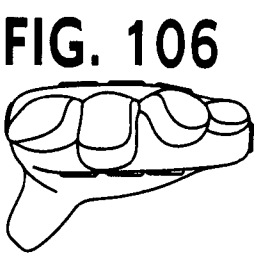
FIG. 106
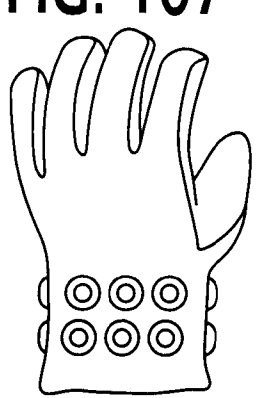
FIG. 107
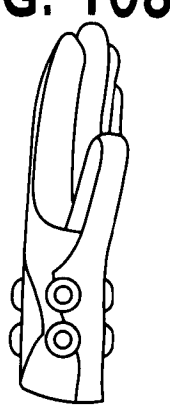
FIG. 108
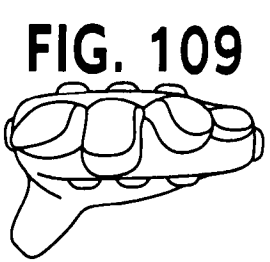
FIG. 109

FIG. 212
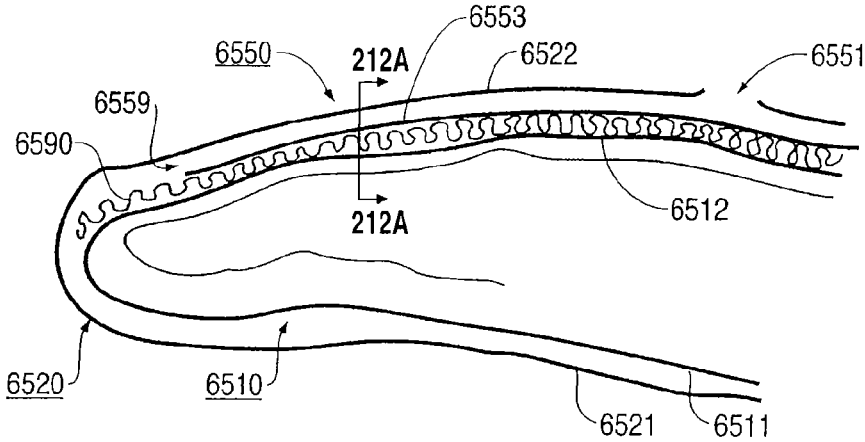
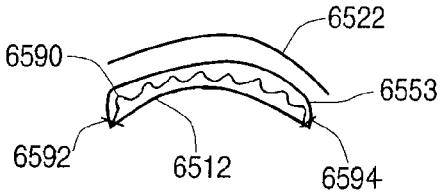
FIG. 212A
FIG. 213
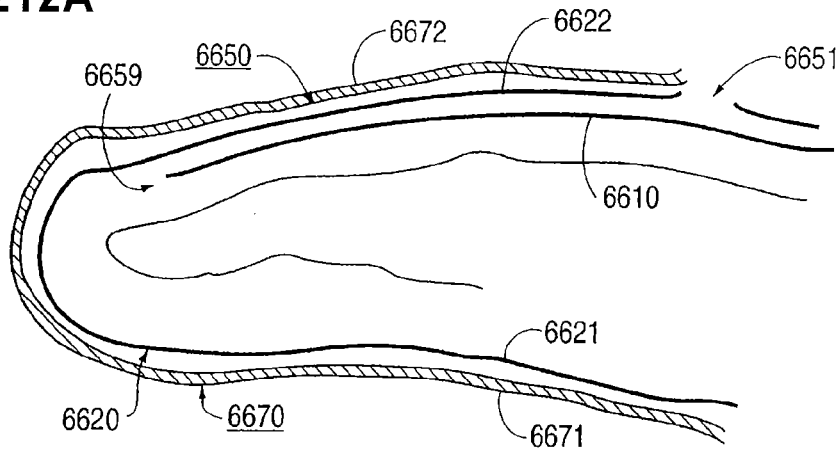

HAND COVERING

CROSS-REFERENCE TO RELATED APPLICATIONS

This application is a continuation of and claims priority to co-pending U.S. patent application Ser. No. 10/062,508, entitled "Hand Covering with Internal Thermal Tubes," filed Feb. 5, 2002, the entirety of which is incorporated herein by reference.

BACKGROUND

1. Field of the Invention

The present invention relates generally to hand coverings and more particularly to a hand covering with internal thermal tubes.

2. Description of the Related Art

In cold weather, it is often desirable to keep one's hands warm by wearing gloves or similar hand coverings. A concern arises when, during extreme temperature conditions, it is difficult to maintain ones hands at a comfortable temperature regardless of whether or not one is wearing such hand coverings. Accordingly, hand coverings have been provided that allow a user to warm their hands beyond the temperature, which is provided by simply wearing the hand covering.

Hand coverings have been provided that allow the wearer to introduce heat into the interior of the hand covering. Such hand coverings typically allow the heat to dissipate throughout the entire interior chamber of the hand covering. A problem with such hand coverings is that the heat dissipates quickly and the extremities (i.e., the fingertips) often do not receive the warm air and therefore remain at an uncomfortable, cold temperature. This is a concern because extremities are typically the first part of the body to get cold and are also the most difficult to warm up once they have become cold.

Other hand coverings have been provided that allow air to be ventilated through the chamber of the hand covering in which the hand is placed to allow for air flow and greater comfort for the wearer.

What is needed is an improved hand covering that communicates warm air to the extremities of the wearer's hand without dissipation of the warm air between an inlet and an outlet and allows for adequate ventilation.

SUMMARY OF THE INVENTION

A hand covering has a hand-receiving portion and a cover. The hand-receiving portion is closed at a first end and defines an opening at a second end. The hand covering comprises an air distribution device and an inlet cover. The air distribution device is disposed between the cover and the hand-receiving portion. The air distribution device has an inlet and an outlet. The inlet cover is removably coupled to the inlet of the air distribution device.

These and other aspects of the present invention will become apparent from the following drawings and description.

BRIEF DESCRIPTION OF THE DRAWINGS

The present invention is described with reference to the accompanying drawings. In the drawings, like reference numbers indicate identical or functionally similar elements.

FIGS. 24 through 40 illustrate alternative embodiments of the air conduit according to the present invention.

FIGS. 210 through 218 depict a partial cross sectional view of other embodiments of the invention along the line A—A of FIG. 3.

DETAILED DESCRIPTION

Figure 1:
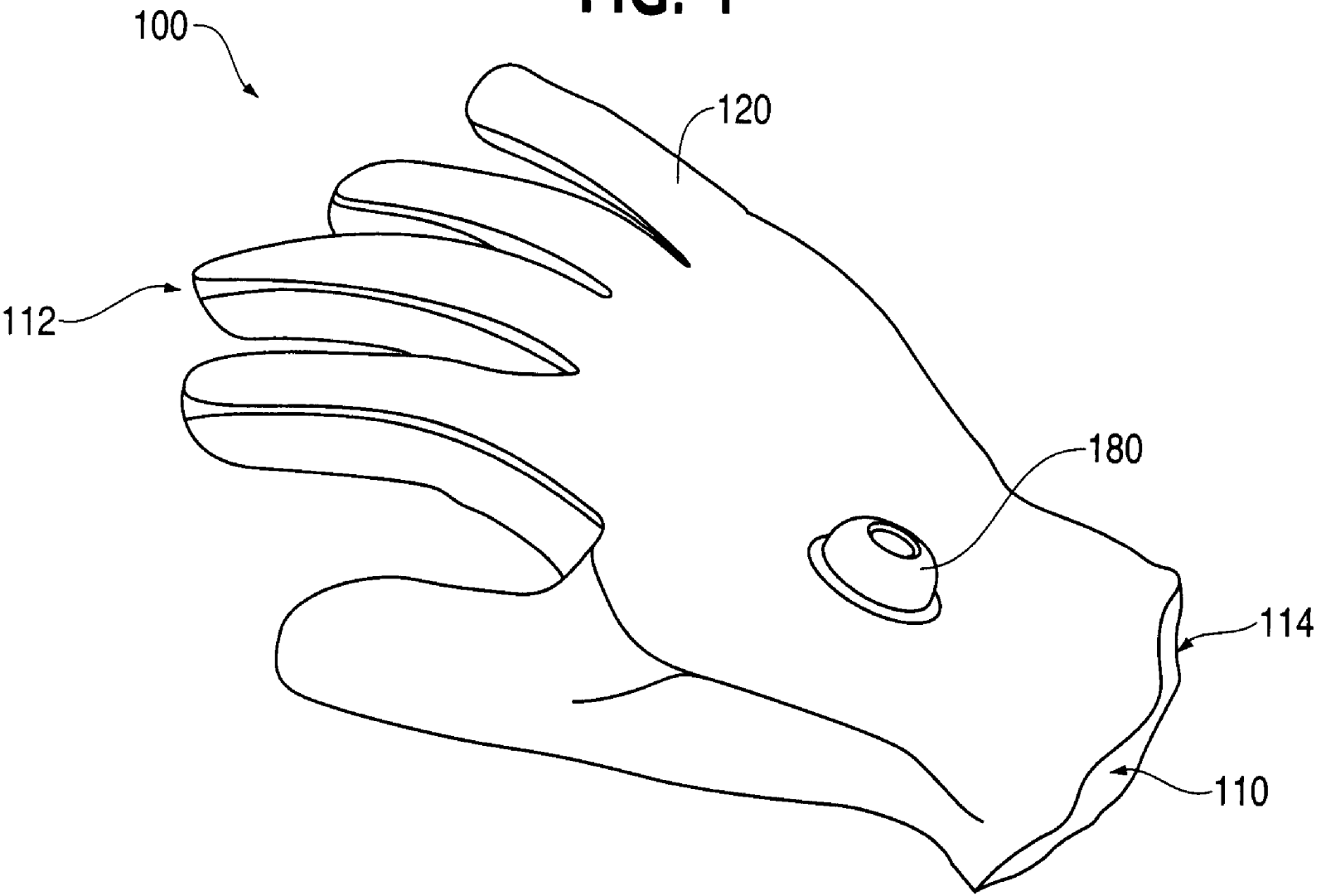
FIG. 1 illustrates a perspective view of a hand covering according to an embodiment of the present invention.
Figure 2:
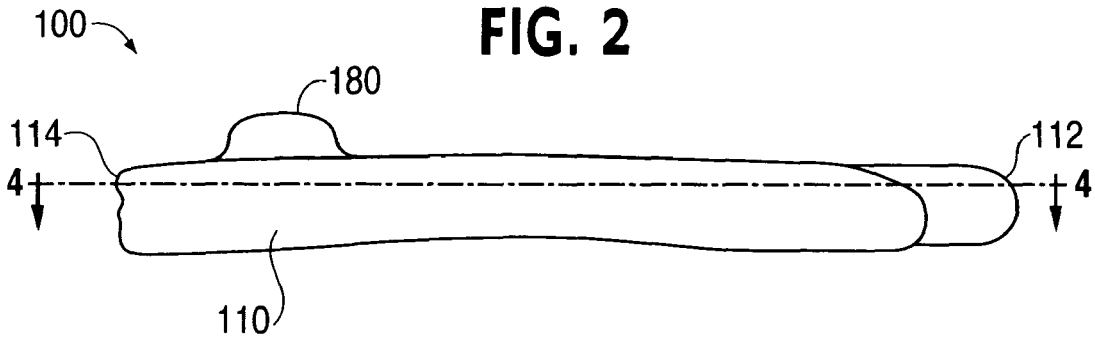
FIG. 2 is a side view of the hand covering illustrated in FIG. 1.
Figure 3:
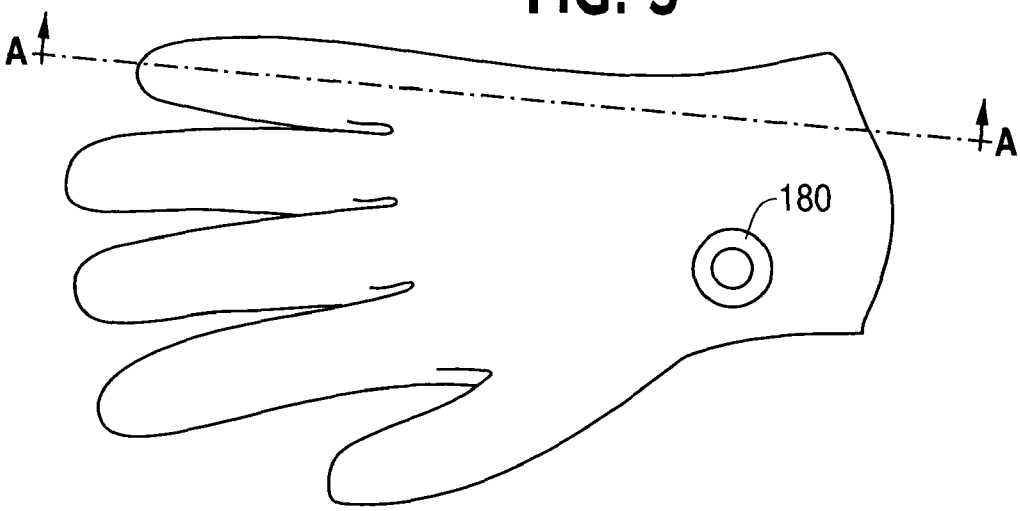
FIG. 3 is a top view of the hand covering illustrated in FIG. 1.
Figure 5:
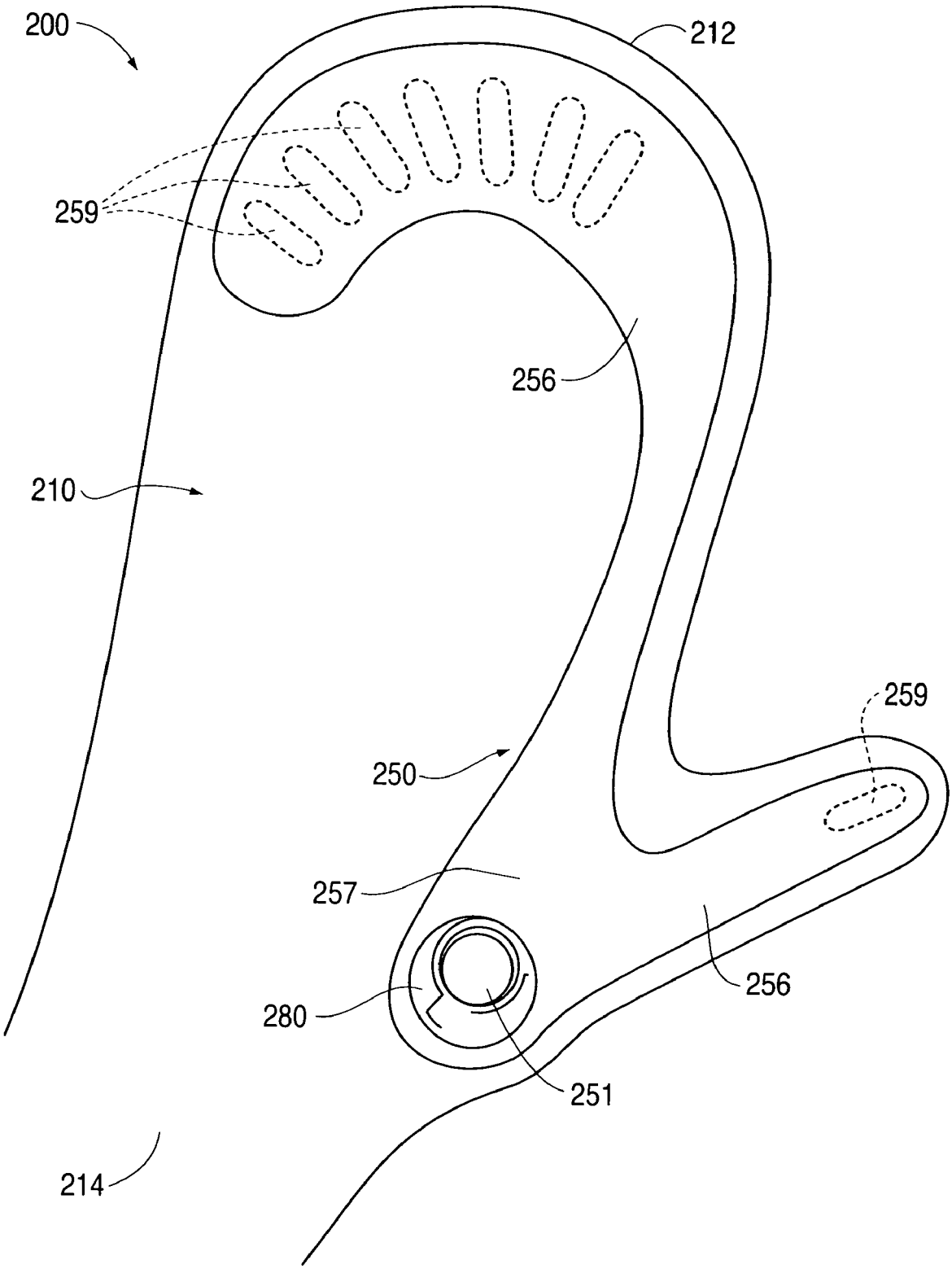
FIG. 5 illustrates a cross sectional view of an alternative embodiment of a hand covering the present invention.

A hand covering is configured to distribute air from an inlet to at least one outlet that is spaced apart from the inlet. The outlet is spaced apart from the inlet such that air is distributed to the extremities of the hand covering without dissipating throughout the hand covering. FIGS. 1–3 illustrate an embodiment of a hand covering 100. The hand covering 100 is comprised of multiple layers and includes a first layer or hand receiving portion 110 that is closed at a first end 112 and defines an opening at a second end 114. The hand receiving portion defines a cavity 115 (not shown in FIG. 1) that is configured to receive the hand of a user. While the hand covering 100 is illustrated in FIG. 1 as a glove, it will be appreciated that other hand coverings such as mittens (as illustrated in FIG. 5) or mitten and glove combinations, are also possible.

A second layer or cover 120 is coupled to the hand receiving portion 110 and an air distribution device 150 (not shown in FIG. 1) is disposed between the cover 120 and the hand receiving portion 110. The cover 120 is provided to substantially encapsulate the air distribution device 150. Depending upon whether the air distribution device is positioned outside or inside the hand receiving portion 110, the cover 120 is positioned either inside or outside the hand receiving portion 110 accordingly.

Figure 4:
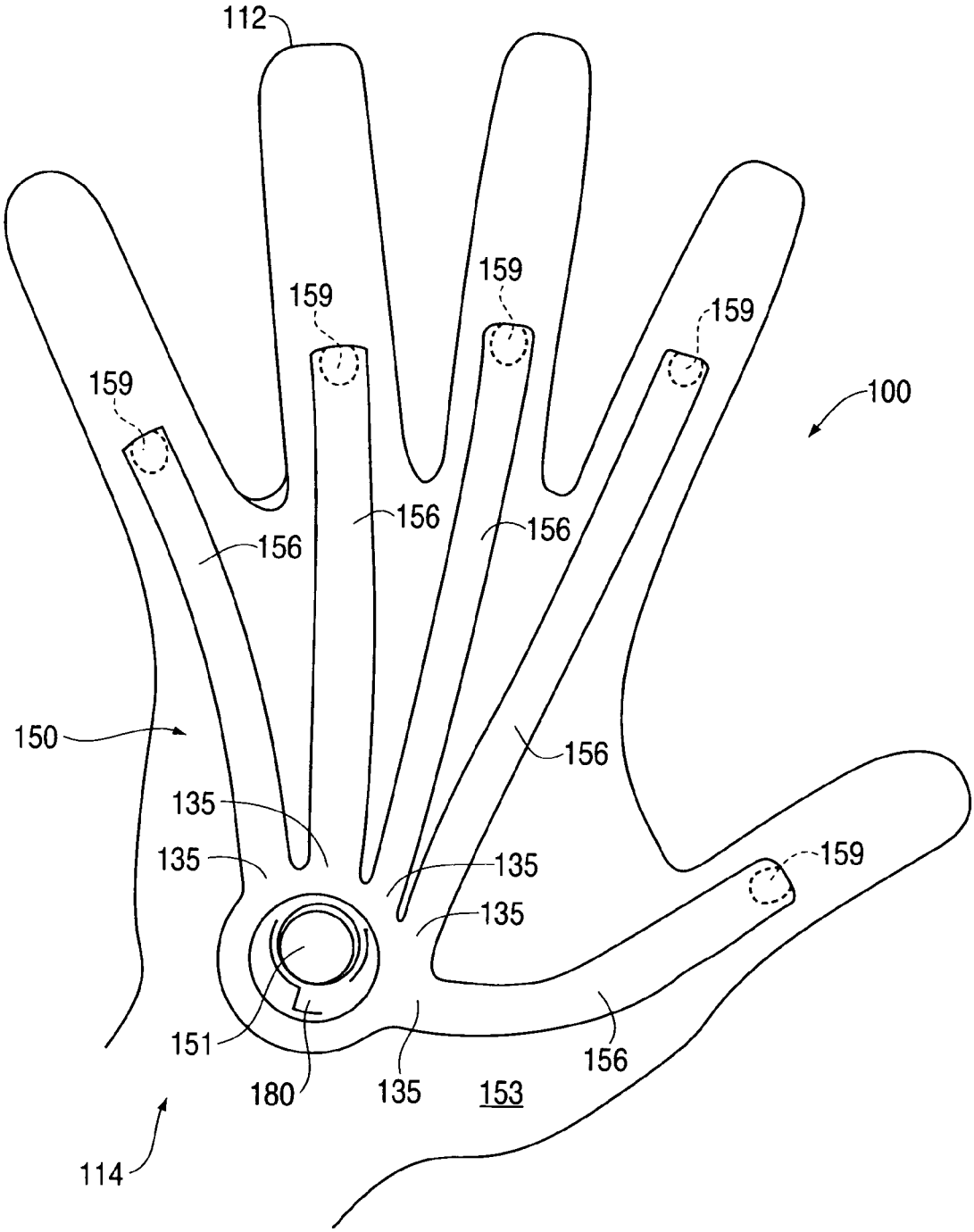
FIG. 4 illustrates a cross sectional view of the hand covering illustrated in FIG. 1 taken along the line 4—4 in FIG. 2.

The air distribution device 150 is configured to communicate air from an inlet 151 to at least one outlet 159 (see FIG. 4). The inlet 151 and outlet 159 are positioned in a spaced apart relation such that the air introduced into the inlet travels over a length before exiting at the outlet 159. As discussed above, the air is to be distributed through the hand covering such that the extremities of the user are contacted by exhausted air while minimizing the dissipation of heat throughout the other portions of the hand covering.

The temperature and pressure of the air at the inlet 151 can be substantially the same as the temperature and pressure of the air at the outlet 159. Depending upon the relative sizes of the inlet 151 and outlet 159, and the size of the channels through which the air flows (described in detail below) the pressure differential between the inlet 151 and outlet 159 may vary (i.e., be greater or lesser pressure at the outlet than at the inlet).

The air distribution device 150 is disposed within the hand covering 100 such that the outlet 159 is positioned proximate the closed end 112 of the hand receiving portion 110. Accordingly, the air will be directed to the extremities of the user as desired.

An air conduit or air intake 180 is provided to facilitate the introduction of air into the air distribution device 150. In the illustrated embodiment, the air conduit 180 is configured as a mouthpiece into which the user can blow to introduce air into the air distribution device 150. As will be appreciated, the air conduit 180 may take many other forms as illustrated in FIGS. 22 through 39. Regardless of the form of air conduit 180, the air conduit 180 is configured to be in gaseous communication with inlet 151 of the air distribution device 150.

The cover 120 defines an opening (not illustrated) that is positioned in registry with the inlet 151 of the air distribution device 150. The air conduit 180 is in gaseous communication with the inlet and can be positioned in registry with the opening in the cover 120. The air conduit can be coupled directly to the cover 120, or alternatively, coupled directly to the air distribution device 150. Alternatively, there may be no air conduit 180 and there may simply be an opening in the cover 120 of the hand covering 100. In a further alternative embodiment, there is no opening in the cover 120 and the user provides air through the cover to an air conduit.

Referring to FIGS. 4 through 9, various embodiments of the air distribution device of the present invention are illustrated. It will be appreciated that the general construction of the embodiments of the air distribution devices 150, 250, 350, 450, 550, 650, 750 are substantially similar and will first be described with reference to air distribution device 350 illustrated in FIGS. 6 and 7.

Figure 6:
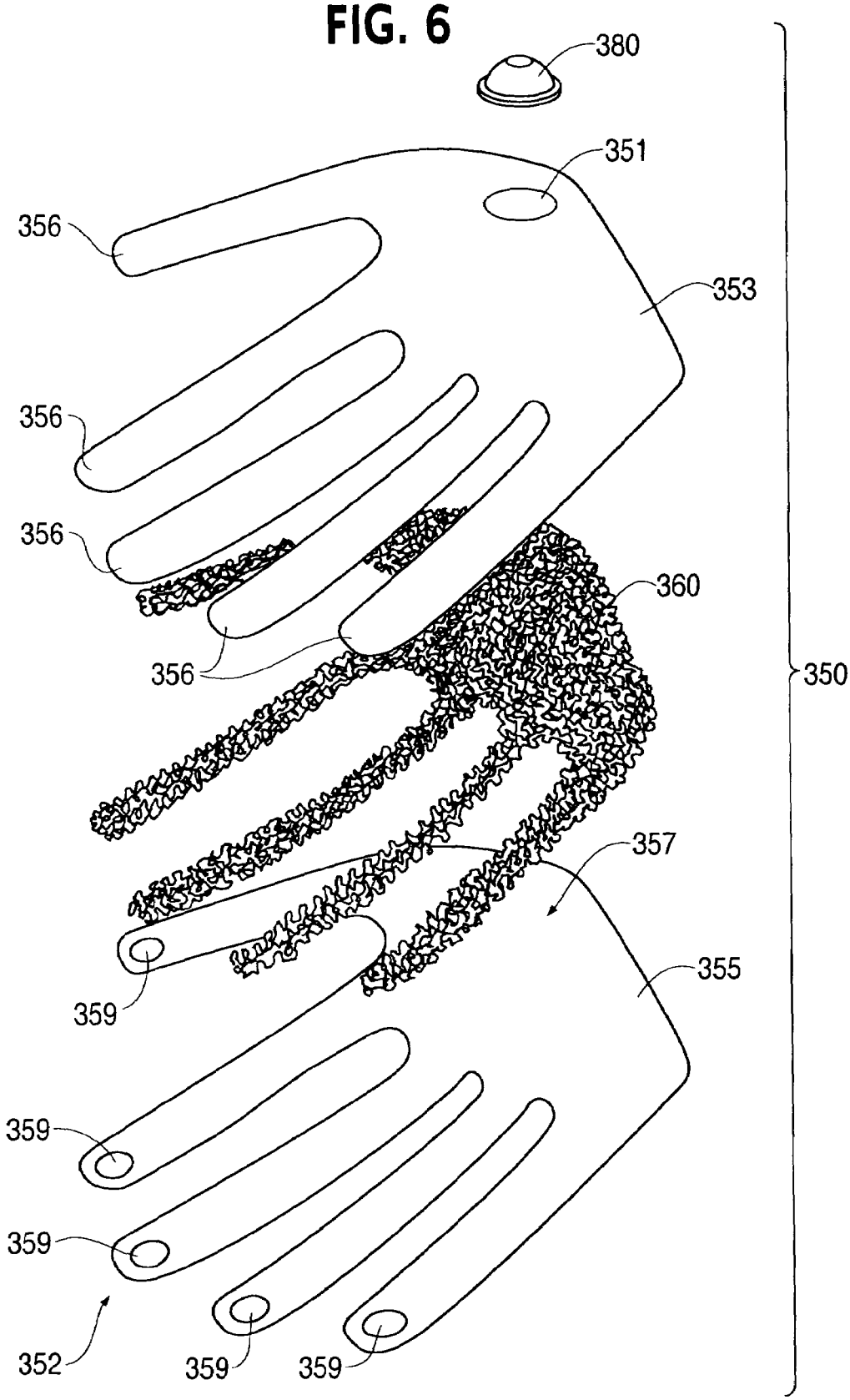
FIG. 6 illustrates an exploded assembly view of an air distribution device according to the present invention.

FIG. 6 illustrates an exploded assembly view of an embodiment of the air distribution device 350 according to an aspect of the present invention. The air distribution device 350 includes a first membrane 353 defining an inlet 351, a second membrane 355 that is coupled to the first membrane 353 and defines at least one outlet 359. The first and second membranes 353, 355 together define an air passage through which air travels from the inlet to the outlet. The outlet 359 is located proximate an end 352 of the second membrane. As described above, the outlets 359 are at an opposite end of the air distribution device 350 from the inlet 351 to properly distribute the air. In this embodiment, the outlets 359 are defined entirely by the second membrane 355. The position and configuration of the inlet 351 and outlets 359 can vary as will be described below. Additionally, the number of inlets and outlets may be varied as desired.

Figure 7:
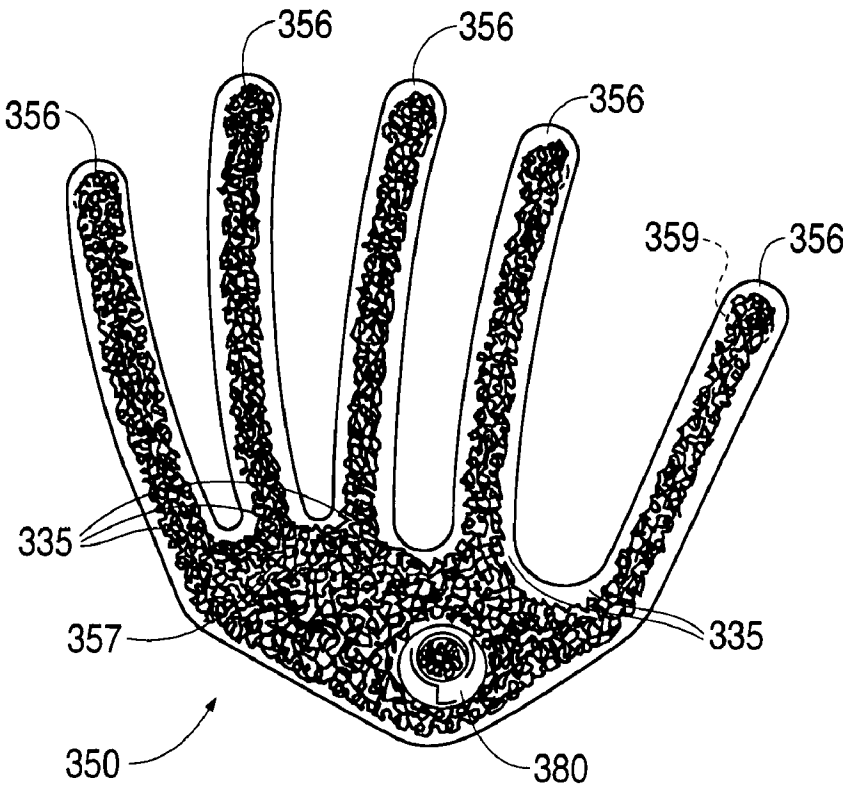
FIG. 7 illustrates an alternative embodiment of an air distribution device according to the present invention.

As shown in FIG. 7, the air distribution device 350 also includes a plurality of channeling members 356. Each channeling member 356 includes its own inlet 335. Air is communicated to the inlet 335 from an air chamber 357. The air chamber 357 is located between the inlet 335 of the channeling members 356 and the inlet 351 defined by the first membrane 353.

In the illustrated embodiment, an air conduit 380 is coupled to the first membrane 353 adjacent to, and in registry with, the inlet 351.

A layer of material 360 is disposed between the first membrane 353 and second membrane 355 within the air passage. The material 360 that is located in the air passage defined by the two membranes 353, 355 can serve many purposes. The material 360 is configured to maintain the air passage open (i.e., prevent the two membranes from sticking together). The material 360 also can serve as a wicking material or desiccant to aid in the drying and distribution of moisture out of the air distribution device. The material 360 can be manufactured, for example, from foam or may be an interwoven porous material. The material 360 in addition to providing a moisture barrier and acting as a wicking material, may also have heat retaining qualities. The material 360 allows only minor dissipation of the heat of the air provided at the inlet, and allows the air to pass through the channeling members 356 at a substantially constant temperature.

Stated broadly, the material 360 can be selected for desired temperature-management properties and desired moisture-management properties. These properties can also relate to the material's abilities for heat storage (or insulation), moisture storage, moisture wicking, heat dissipation, breathability, or non-breathability. Such a material can be made from, for example, neoprene, Coolmax® or Gore-Tex®.

For example, the material 360 can be selected for its moisture-retaining characteristics. By selecting a material that retains moisture, the temperature within the glove can be enhanced for an extended period of time without providing discomfort to the user. More specifically, when air is provided into the inlet of the air distribution device (e.g., a user breath), the heat and moisture of the user's breath can be retained within the material. This allows the moisture to be disposed close to the user's skin without being immediately in contact with the user's skin. Because the temperature of the moisture is related to the temperature of the material, it is desirable that the moisture is retained within the air distribution device for a period of time. By retaining moisture within the glove at a membrane that is not immediately in contact with the user's skin, the temperature within the glove to be enhanced for an extended period of time while the user avoids the discomfort of a wet or moist surface in contact with the user's skin.

Figure 12:
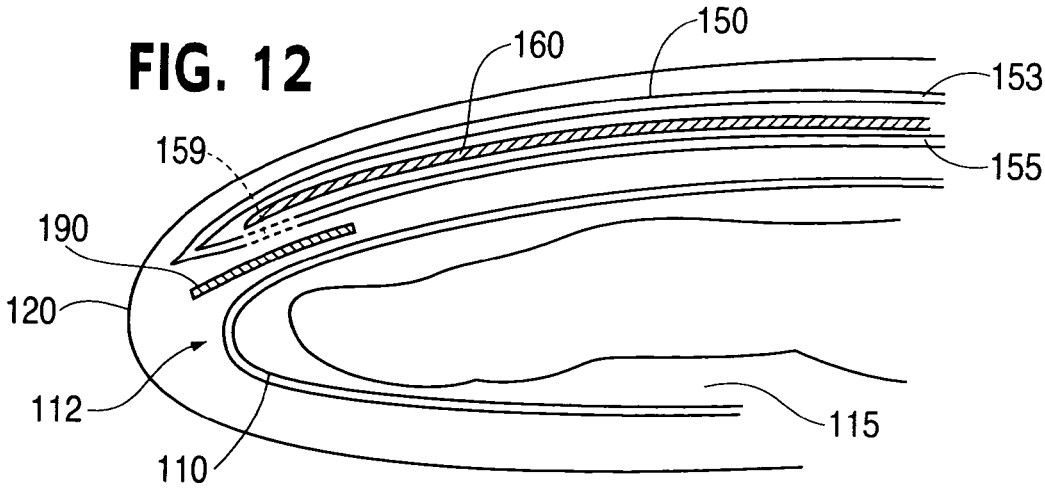
FIG. 12 illustrates a partial cross sectional view of another embodiment of the present invention taken along the line A—A of FIG. 3.

Returning to the hand covering 100 of FIG. 4, the embodiment of the air distribution device 150 illustrated in FIG. 4 includes an air conduit 180 coupled to a first membrane 153 of the air distribution device 150 adjacent to the inlet 151. The air distribution device 150 includes a second membrane 155 (see FIG. 12). Multiple channeling members 156 each has an inlet 135 and is configured to communicate a gas to its own outlet 159. In the illustrated embodiment, the outlets 159 are shown in dashed lines, indicating that they are located along the length of the side of the air distribution device 150 that is opposite the inlet 151 (i.e., defined entirety by the second membrane). In the embodiment illustrated in FIG. 4, air is provided to the air conduit or air intake 180, and is distributed to inlets 135 and through channeling members 156 until it is ultimately exhausted at the outlets 159. In the illustrated embodiment, there is no air chamber between the air conduit 180 and the channeling members 156 although in other embodiments, an air chamber can be present.

An alternative embodiment of an air distribution device 250 for use with an alternative hand covering 200 having an open end 214 and a closed end 212 is illustrated in FIG. 5. In this embodiment the air distribution device 250 includes an air conduit or air intake 280 that is coupled to the air distribution device 250 adjacent the inlet 251. The air outlets 259 are located adjacent the closed end 212 of the hand covering 200 and are defined by the second membrane (not visible in FIG. 5). As is apparent, two channeling members 256 are coupled to an air chamber 257. One of the channeling members 256 includes multiple outlets 259 while the other channeling member 256 includes a single outlet 259. Alternatively, both of the channeling members 256 could include a plurality of outlets or a single outlet 259.

Figure 8:
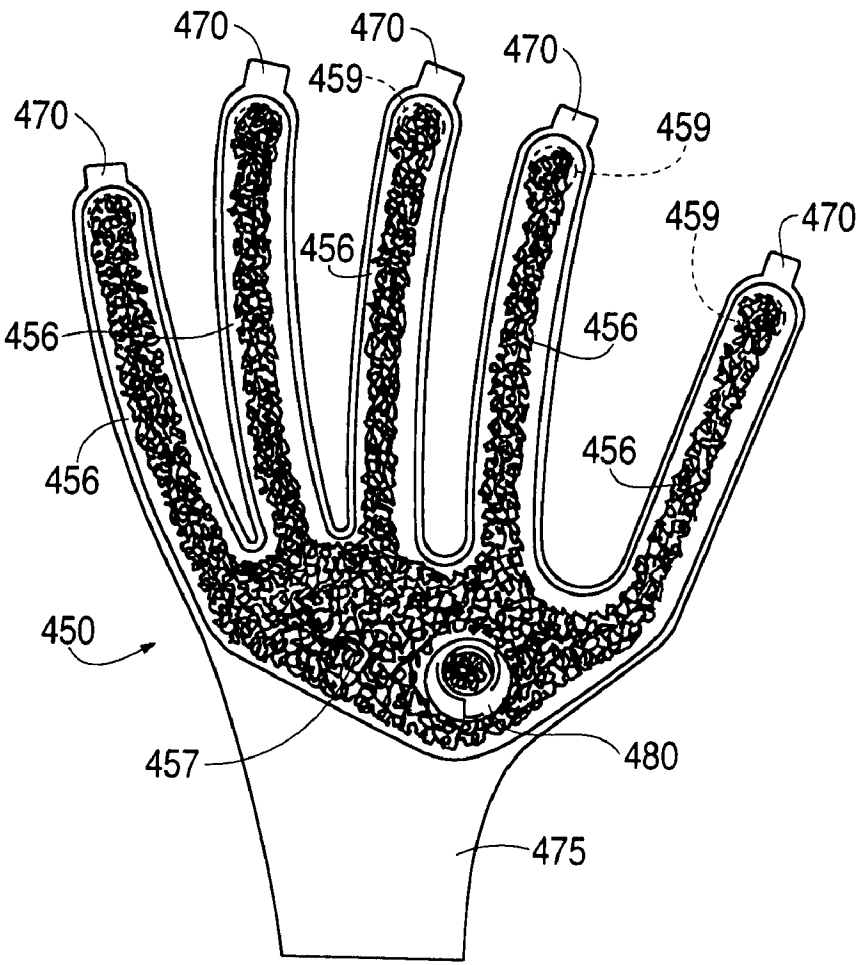
FIG. 8 illustrates another alternative embodiment of an air distribution device according to the present invention.

The embodiment of an air distribution device 450 illustrated in FIG. 8 is substantially similar to the air distribution device 350 and includes channeling members 456, air outlets 459, air chamber 457, and an air conduit 480 coupled to a membrane of the air distribution device 450. In the illustrated embodiment in FIG. 7 however, tabs, or securing elements 470, 475 are provided on the membranes of air distribution device 450 to be secured between the layers of the hand covering during assembly as will be described. For example, the tabs may be sewn separately to the cover or the hand receiving portion or may simply be sewn using the same seam used to couple the hand receiving portion and cover together.

A separate layer of fabric or foam 190 (shown in FIGS. 12 through 14), in addition to the fabric 160 disposed within the air distribution device between the first and second membranes 153, 155, may be disposed between or adjacent to the air distribution device 150, 250, 350, 450, 550, 650, 750 and the hand receiving portion 110. The separate layer of fabric 190 can be a heat retaining fabric and/or can also act as a wicking material to prevent moisture from escaping through the outlet 159. The separate layer of fabric may be dimensioned such that it only covers the outlet 159 or can be dimensioned to extend the length of the channeling member or the entire air distribution device. It will be appreciated that the material that is disposed between the two membranes of the air distribution device may also have heat retaining qualities. Likewise, the hand receiving portion 110 may have such heat retaining qualities and may be manufactured from a heat retaining fabric to prevent the dissipation of heat from the hand covering. Examples of heat retaining fabrics are THERMALITE, commercially available from Dupont or THINSULATE™, commercially available from 3M Corporation.

Figure 9:
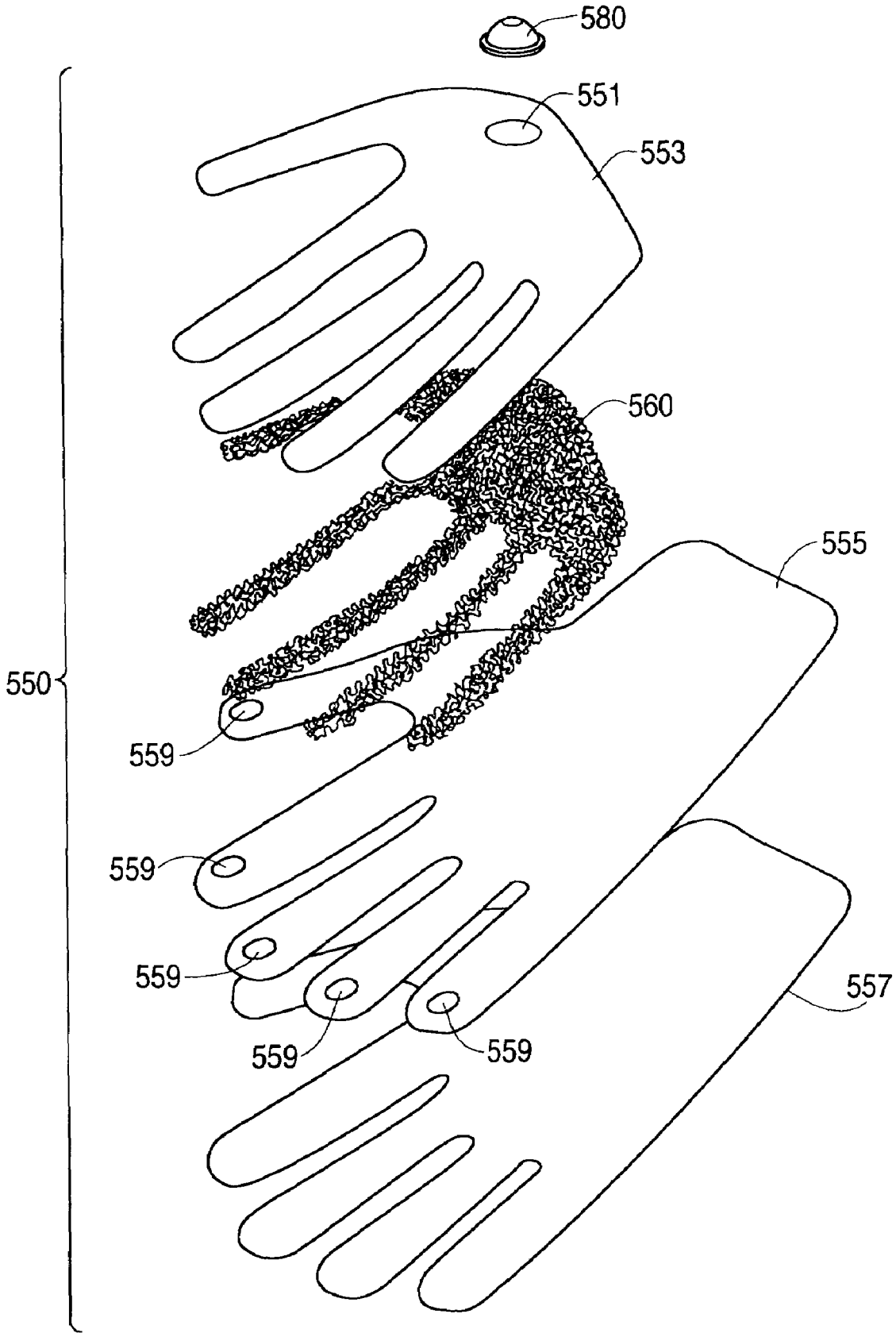
FIG. 9 illustrates an exploded view of an alternative embodiment of an air distribution device according to the present invention.
Figure 10:
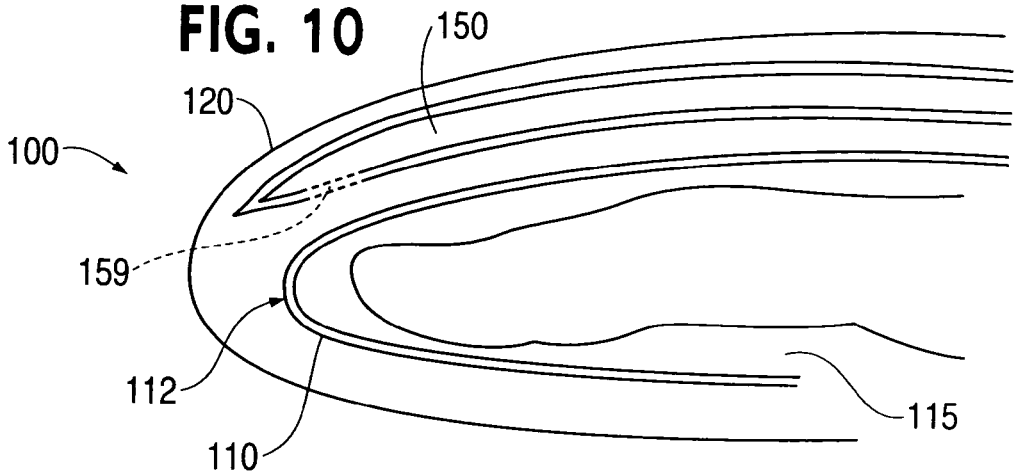
FIG. 10 illustrates a partial cross sectional view of an embodiment of the present invention taken along the line A—A of FIG. 3.
Figure 13:
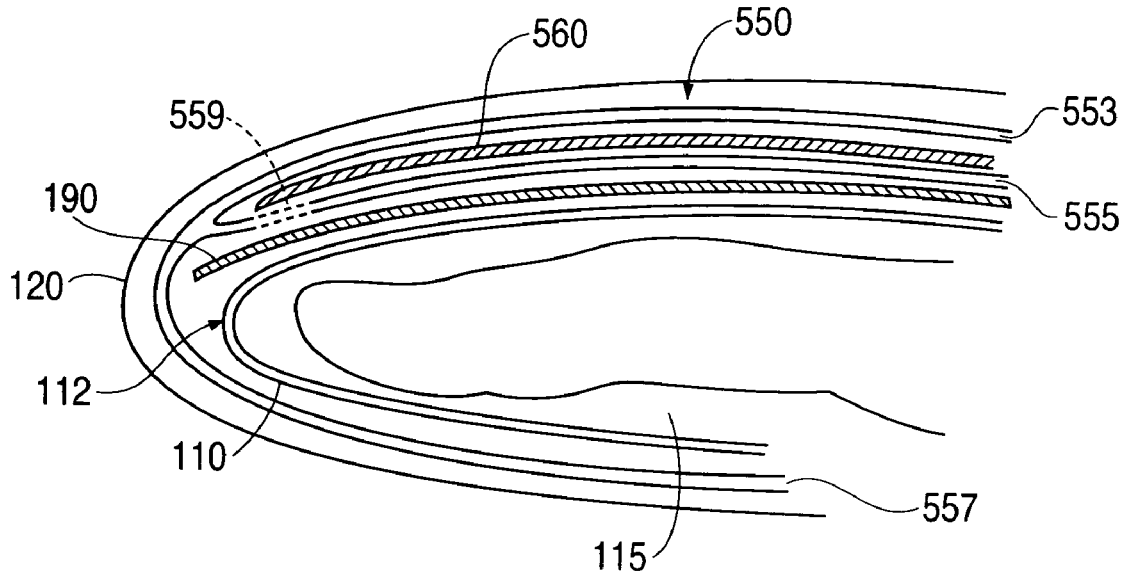
FIG. 13 illustrates a partial cross sectional view of yet another embodiment of the present invention taken along the line A—A of FIG. 3.
Figure 14:
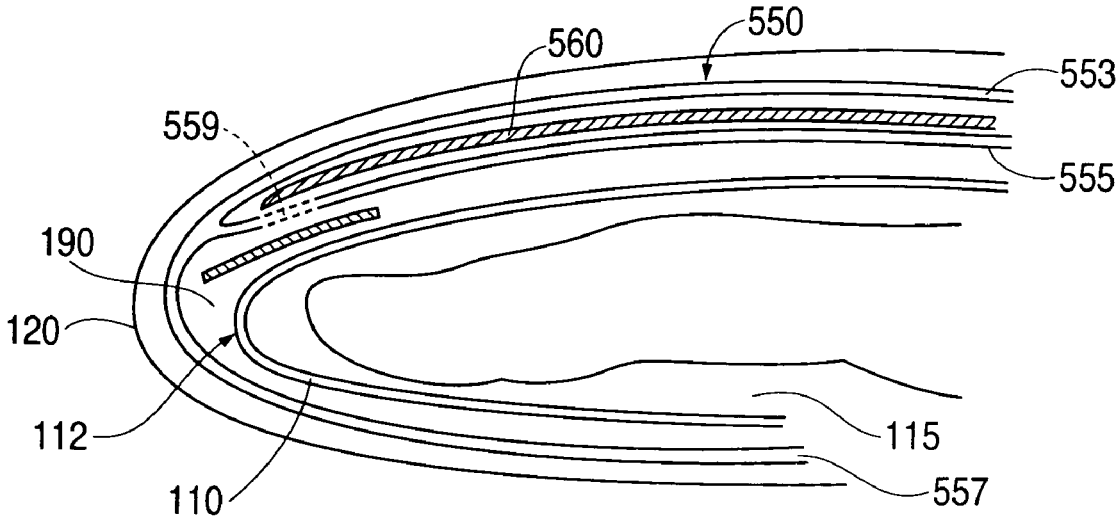
FIG. 14 illustrates a partial cross sectional view of a further embodiment of the present invention taken along the line A—A of FIG. 3.

As illustrated in FIGS. 9, 13 and 14, an alternative air distribution device 550 is illustrated that includes a first membrane 553, defining an inlet 551, a second membrane 555 and a third membrane 557. Alternatively, the membranes can be molded from a single piece of material rather than coupling separate pieces of material together. The air distribution device 550 is disposed between the cover 120 and the hand receiving portion 110. A layer of fabric 560, which is similar to fabric 190 as described above, may be disposed between the outlet 559 of the air distribution device 550 and the hand receiving portion 110. In the illustrated embodiment, the third membrane 557, along with the first and second membranes, 553, 555 act as a liquid barrier and/or a waterproof, breathable barrier that is configured to prevent liquid from entering the chamber 115 of hand receiving portion 110. An conduit 580 is positioned in registry with the inlet 551.

Figure 15:
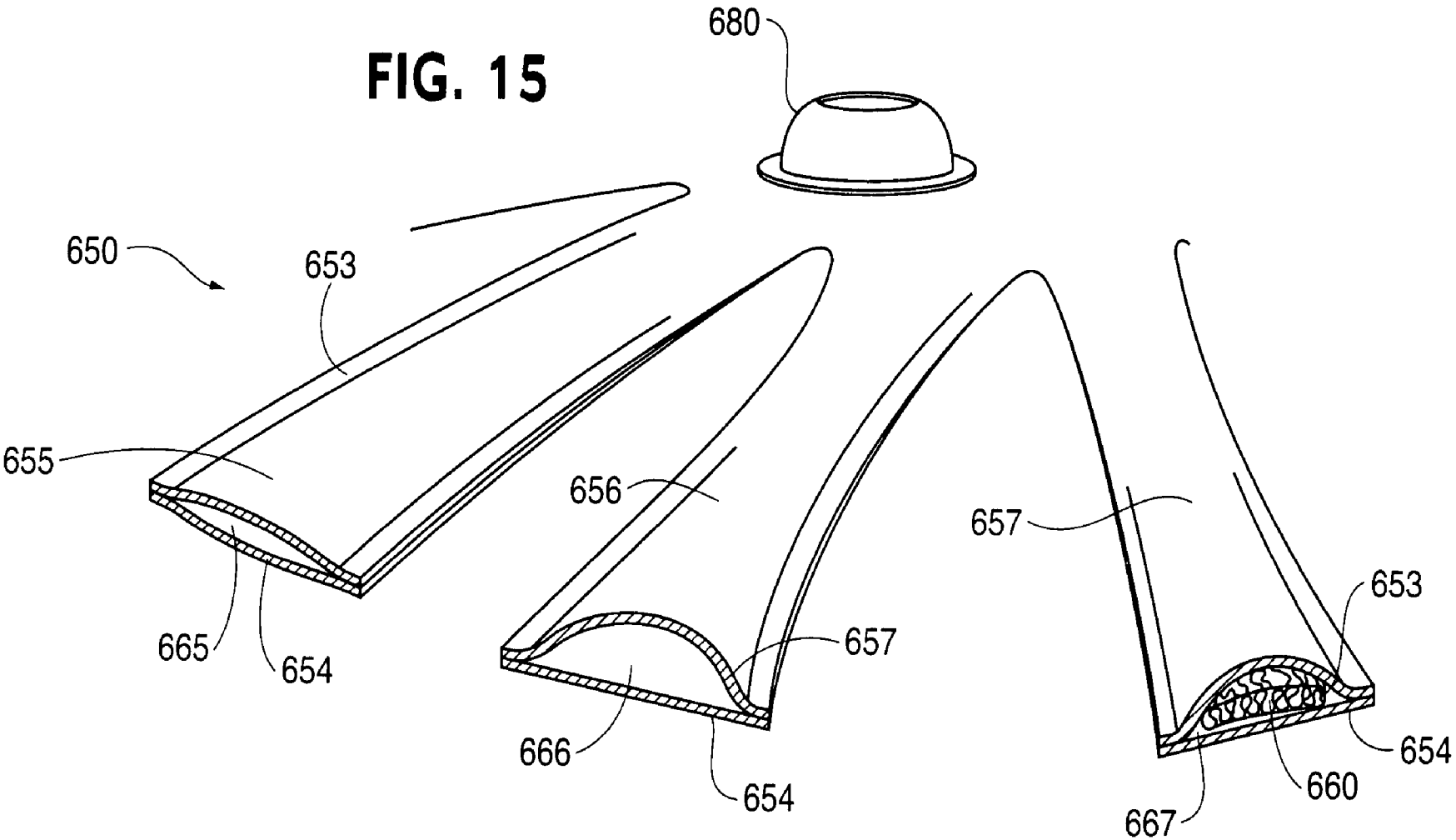
FIG. 15 illustrates a partial view of an air distribution device according to the present invention including embodiments of channeling members for use with the air distribution device of the present invention.

FIG. 15 illustrates a partial view of an embodiment of an air distribution device 650 that includes an air conduit 680 and channeling members 655, 656 and 657. Each of the channeling members 655, 656, 657 in the illustrated embodiment includes an outlet 665, 666, and 667, respectively that is defined at the end of the channeling member. Channeling member 657 includes a layer of material 660 between the first membrane 653 and the second membrane 654 as described above in detail with respect to air distribution device 350. Note that FIG. 15 shows alternative configurations for channeling members, only one of which may be included for any one particular embodiment.

The first and second membrane 653, 654 may be coupled together in a variety of configurations to form various outlets. For example, channeling member 655 illustrates an embodiment in which the first and second membranes are coupled together such that they are both arcuate in cross section, and define an opening or air passage 665, to inhibit the collapsing of the channeling member 655.

The first and second membrane 653, 654 that comprise channeling member 656 are configured such that the first membrane 653 is positioned in an arcuate fashion above the second membrane 654 which is taut in configuration such that the first membrane 653 does not collapse thereby closing an opening or air passage 666, inhibiting air flow through the channeling member 656.

Channeling member 657 includes a layer of material 660 disposed therein to prevent the first membrane 653 from collapsing onto the second membrane 654 thereby closing an opening or air passage 667, inhibiting the flow of air through the channeling member 657 as previously described. As will be appreciated, other configurations of the channeling members of the air distribution device that allow the passage of air, but resist the collapsing of the channeling member are contemplated by the present invention.

Figure 16:
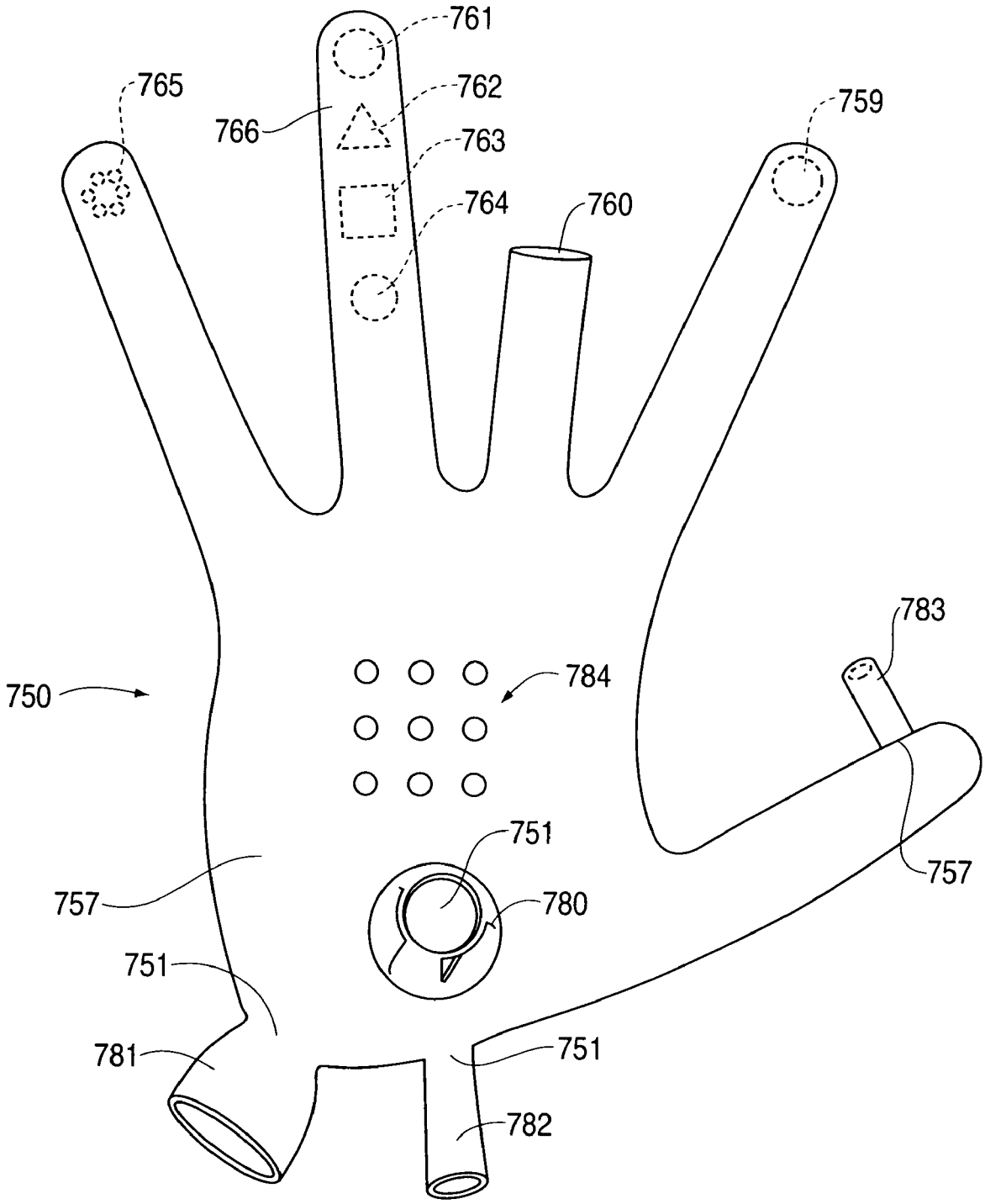
FIG. 16 illustrates an exemplary air distribution device according to the present invention including illustrations of embodiments of air inlets, and air outlets.

FIG. 16 illustrates an embodiment of an air distribution device 750 that depicts various inlets and outlets according to the present invention. Any one or all of the illustrated inlets and outlets may be included on the air distribution device 750. It is contemplated that one particular type and location of an inlet and one particular type and set of locations of outlets will be implemented for a given embodiment. Inlet 751 may be located adjacent any of the illustrated conduits 780, 781, 782, or 783. Additionally, quilting 784 may be included in the air chamber 757 to prevent the air chamber 757 from over-expanding when air is introduced.

Several alternative embodiments of outlets of the air distribution device are illustrated in FIG. 16. For example, outlet 765 may include openings defined on the second membrane of the air distribution device. The outlets may be various shapes and sizes and may be positioned along the length of a channeling member 766 of the air distribution device as illustrated by outlets 761, 762, 763, and 764. Alternatively, the outlet may be a single opening 759 defined proximate the end of the second membrane as discussed above. The outlet may also be defined at the end of the channeling member as illustrated by outlet 760.

Figure 18:
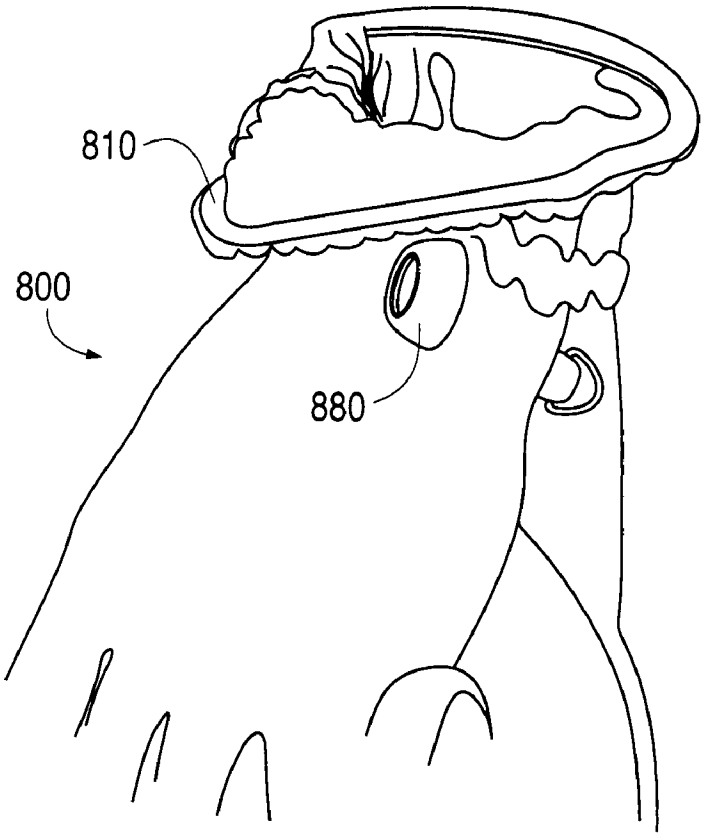
FIG. 18 illustrates a partial perspective view of the hand covering illustrated in FIG. 17 in a second configuration.
Figure 17:
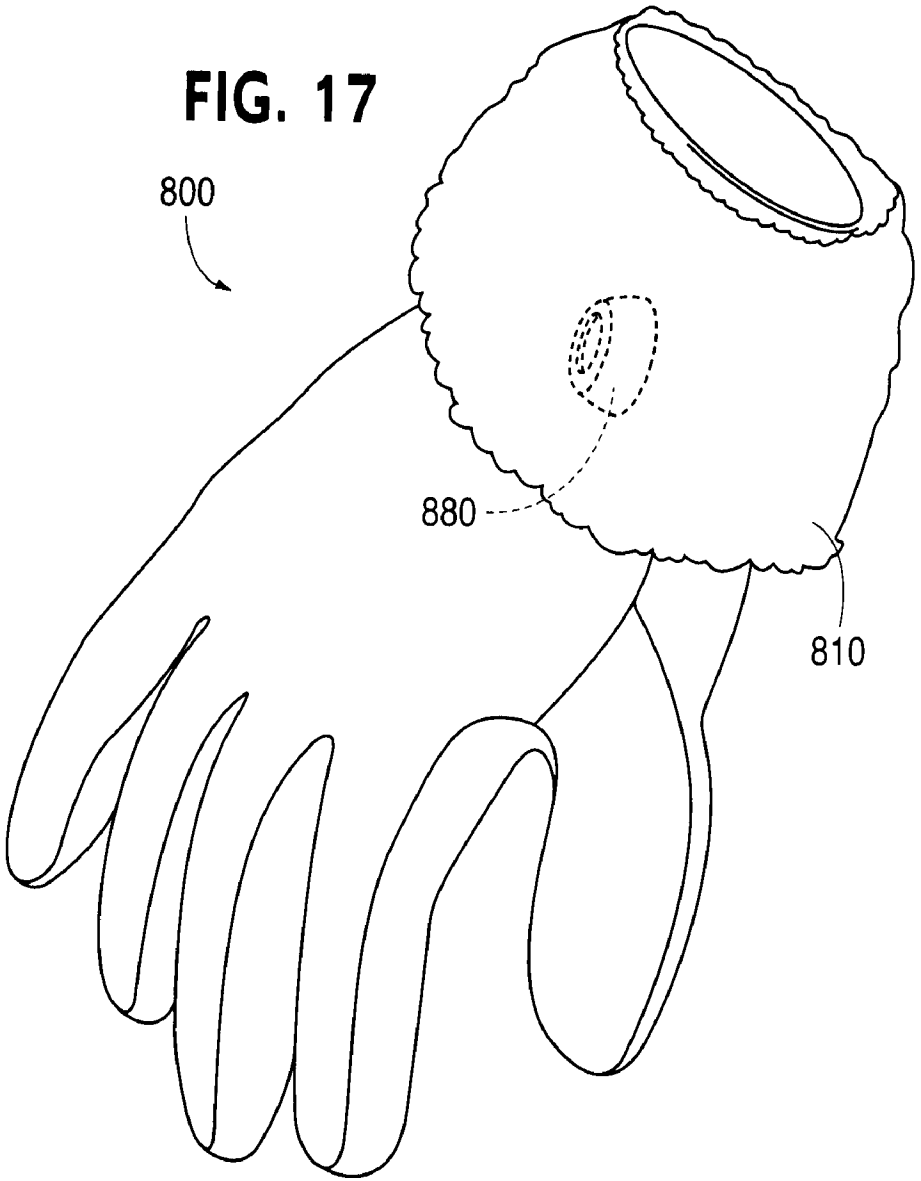
FIG. 17 illustrates an alternative embodiment of the hand covering according to the present invention in a first configuration.

FIGS. 17 and 18 illustrate an alternative embodiment of the hand covering 800 in which the conduit 880 is concealed by a cuff 810 that is folded over to shield the conduit. To provide access to the conduit 880, the cuff 810 is folded back as illustrated in FIG. 18.

Figure 19:
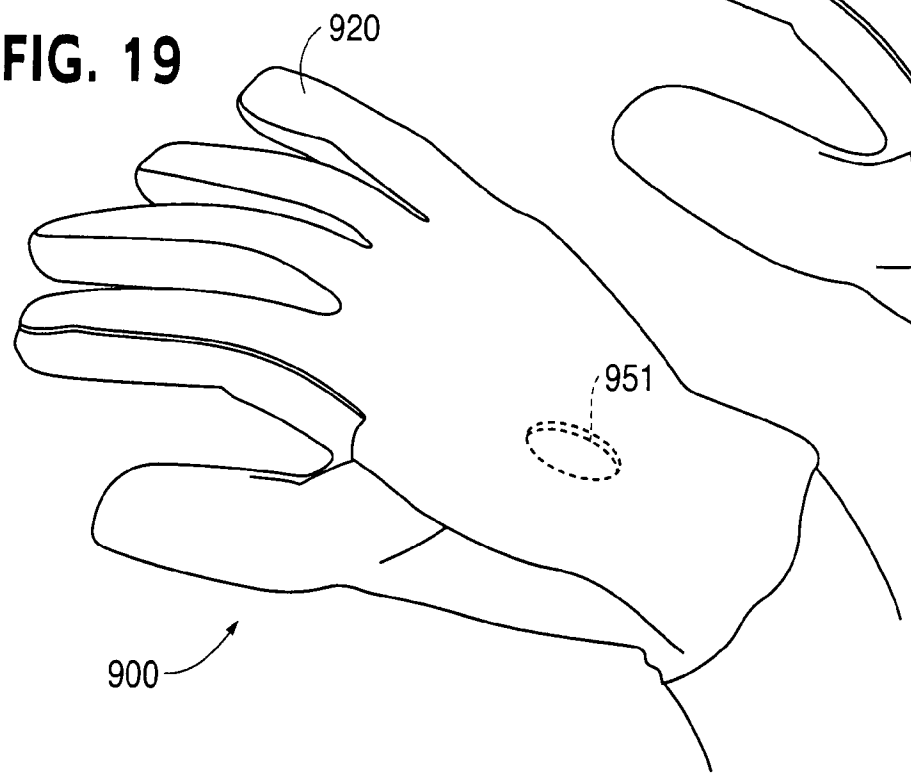
FIG. 19 illustrates another alternative embodiment of the hand covering according to the present invention.

FIG. 19 illustrates an embodiment of the hand covering 900 in which no air conduit or air intake is provided. Instead, air is introduced into the inlet 951 of the air distribution device through the cover 920. In such an embodiment, the cover may include an opening or may simply be permeable to air.

Figure 21:
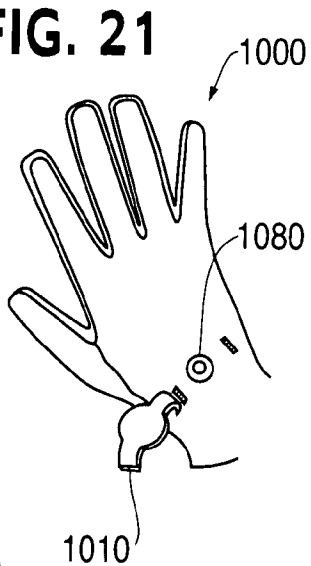
FIG. 21 illustrates the hand covering illustrated in FIG. 20 in a second configuration.
Figure 20:
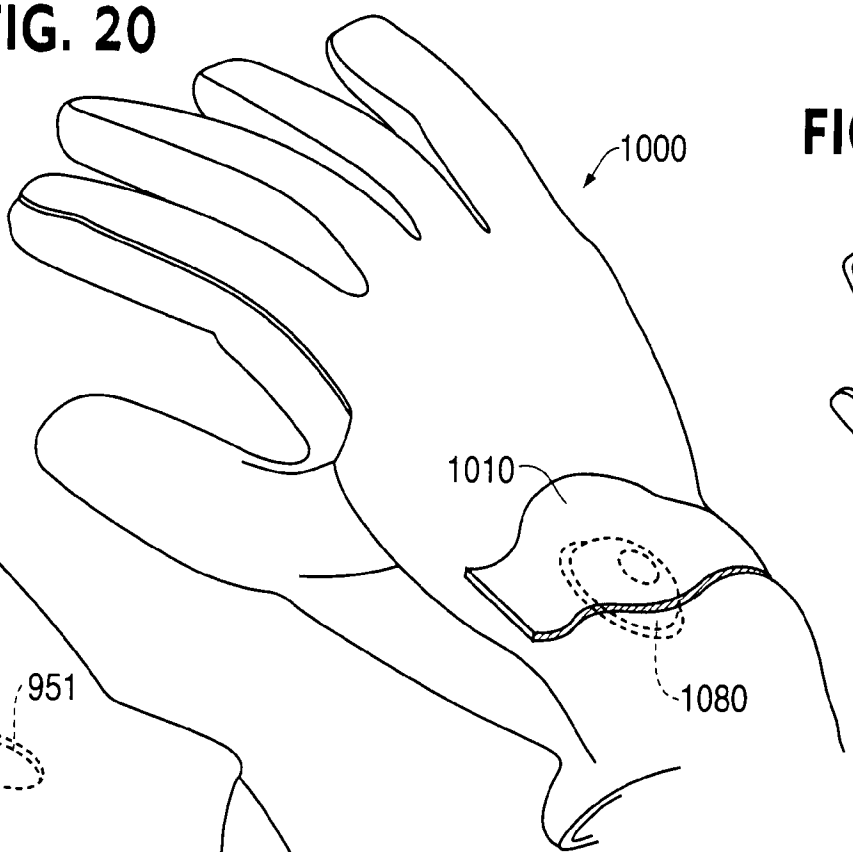
FIG. 20 illustrates a further alternative embodiment of the hand covering according to the present invention in a first configuration.

FIGS. 20 and 21 illustrate a further embodiment of a hand covering 1000 that includes a strap 1010 that is configured to cover air conduit 1080. By covering the air conduit 1080 debris and moisture are prevented from entering the air conduit, or moisture is prevented from exiting the glove from the air conduit. In use, air is introduced into the air conduit by removing the strap as illustrated in FIG. 21.

FIGS. 22 through 39 illustrate various embodiments of air conduits 1180, 1280, 1380, 1480, 1580, 1680, 1780, 1880, 1980, 2080, 2180, 2280, 2380, 2480, and 2580.

Figure 22:
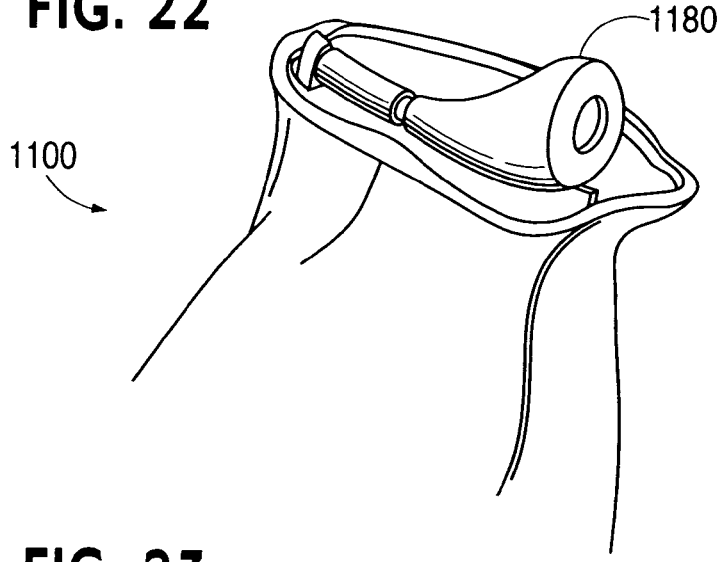
FIG. 22 illustrates an alternative embodiment of an air conduit of the present invention in a first configuration.
Figure 23:
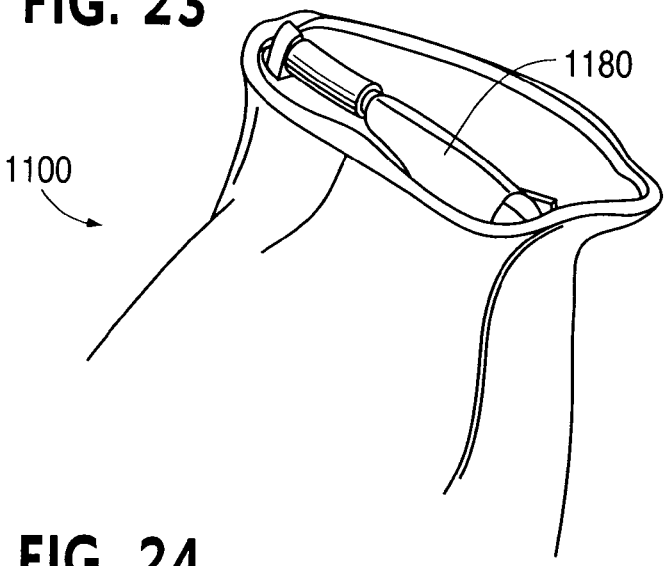
FIG. 23 illustrates the air conduit illustrated in FIG. 22 in a second configuration.

FIGS. 22 and 23 illustrate an embodiment of a hand covering 1100 having an air conduit 1180 that can be moved from a first position as illustrated in FIG. 22 to a second position illustrated in FIG. 23. When the air conduit 1180 is in its first position, it is accessible by a user. The air conduit can be moved to its second position to conceal it from view when not in use. When in the second position, the air conduit 1180 is also protected from debris and moisture.

Figure 24:
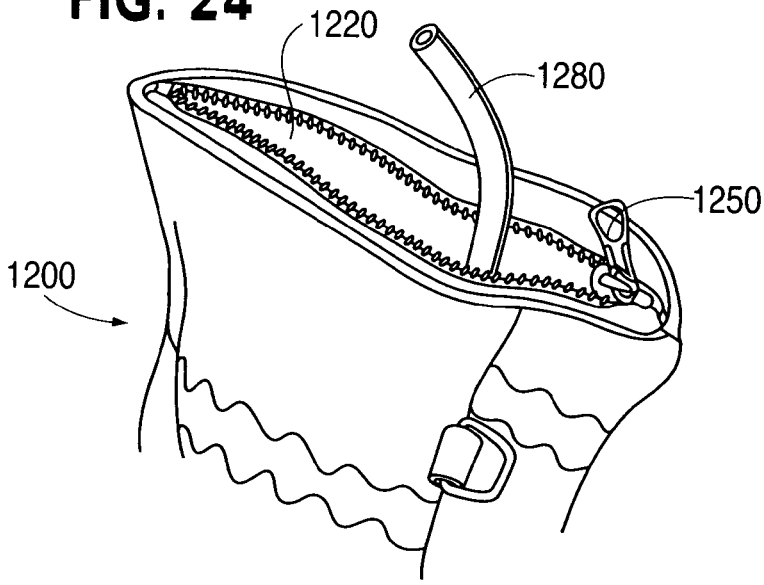
Figure 28:
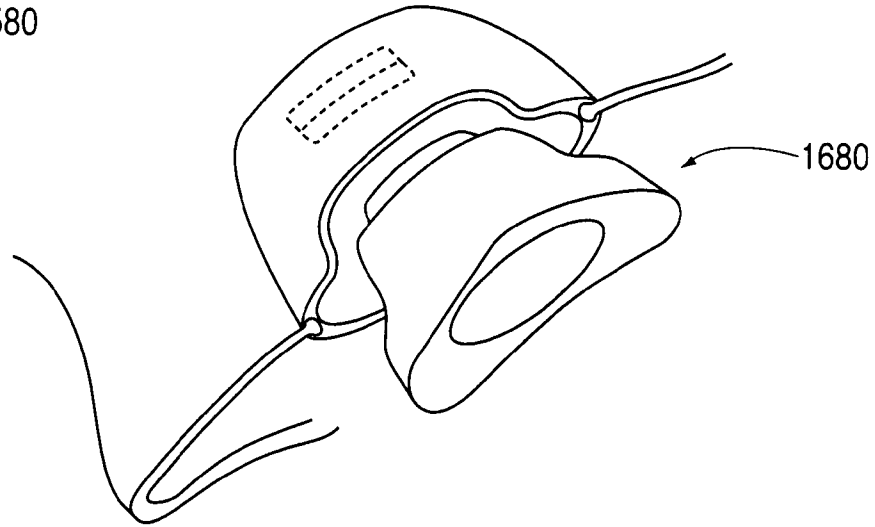
Figure 27:
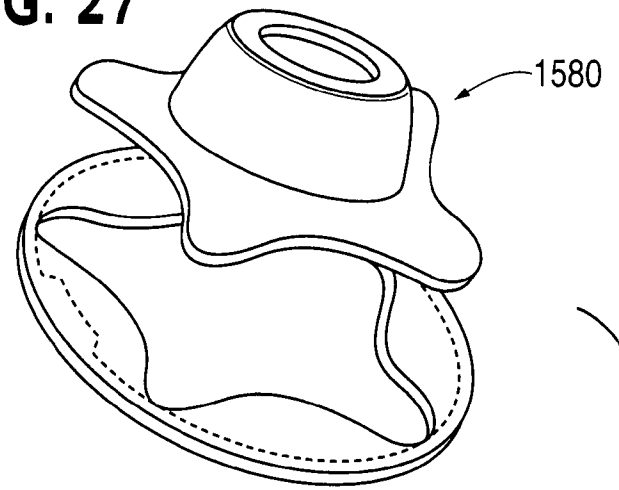
Figure 30:
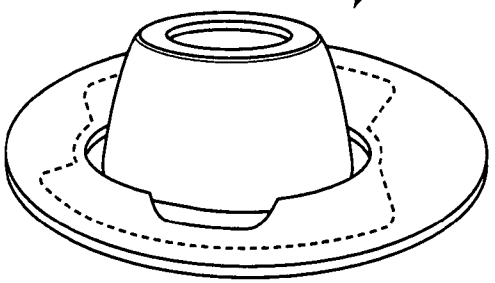
Figure 29:
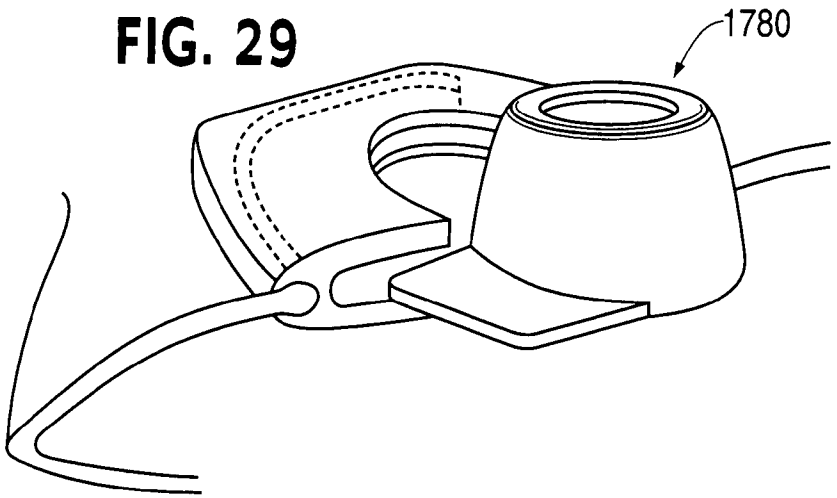

A further embodiment of an air conduit 1280 is illustrated in FIG. 24 in which the air conduit 1280 can be concealed within the hand covering 1200 in an opening 1220. The opening can be secured in a closed position by a fastener 1250 such as a zipper.

FIG. 25 illustrates an alternative embodiment of an air conduit 1480 that also includes a removable screen 1485. The screen 1485 prevents debris from entering the air distribution device 1450, prevents moisture from entering the device, and/or prevents moisture from exiting the glove. The screen 1485 can be removed and cleaned and/or replaced. In an alternative embodiment, a wicking material 1487 is removably disposed with air conduit 1480.

FIGS. 26 through 30 illustrate embodiments of air conduits 1380, 1580, 1680, 1780 and 1880 that can be removed from and cleaned and/or replaced into a hand covering such as hand covering 1300 illustrated in FIG. 26.

Figure 32:
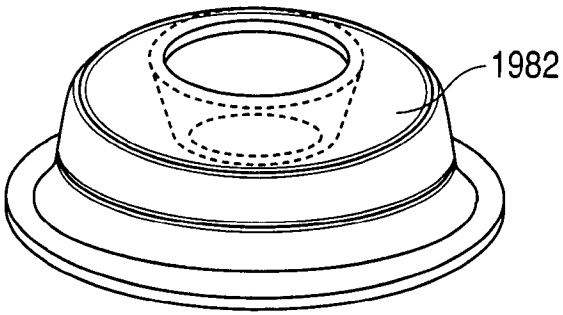
Figure 31:
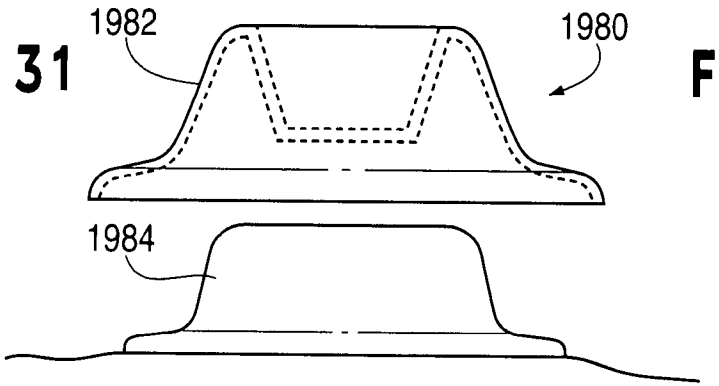

FIGS. 31 and 32 illustrate an embodiment of an air conduit 1980 that includes a removable cover 1982. The removable cover 1982 is coupled to a base 1984 for example by friction fit or snap fit. The removal cover 1982 can be removed for cleaning and/or replacement.

Figure 33:
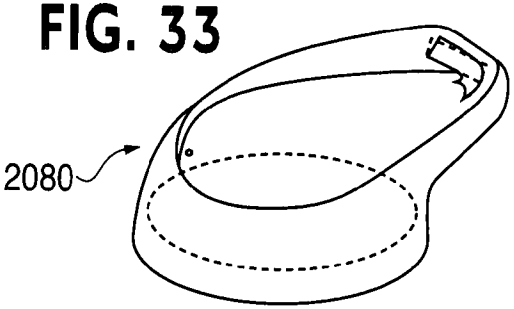
Figure 35:
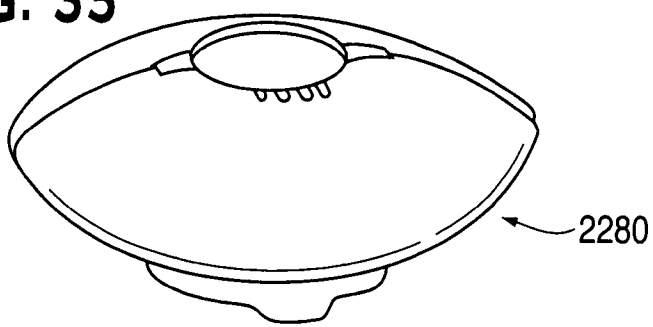
Figure 34:
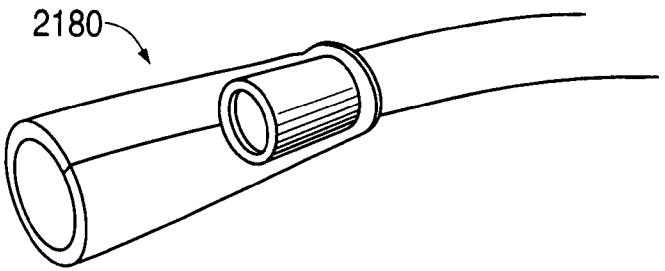

FIGS. 33 through 35 illustrate alternative shapes for air conduits 2080, 2180, 2280.

Figure 38:
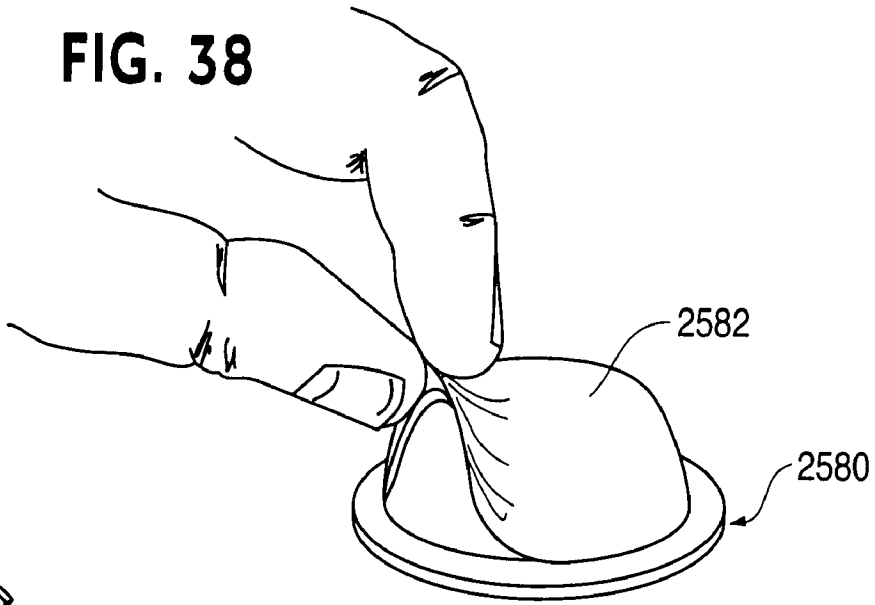
Figure 39:
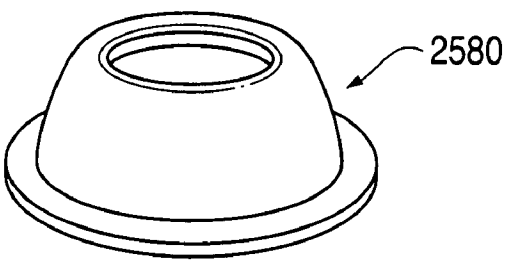
Figure 37:
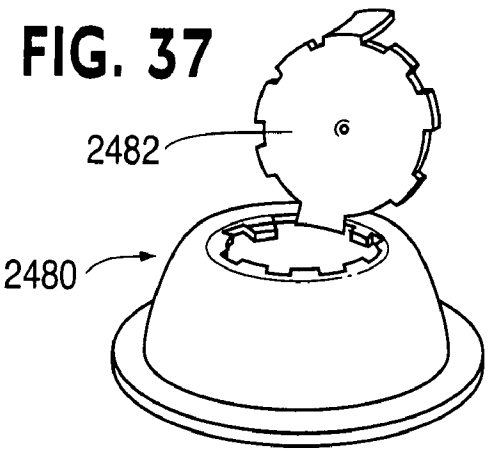
Figure 36:
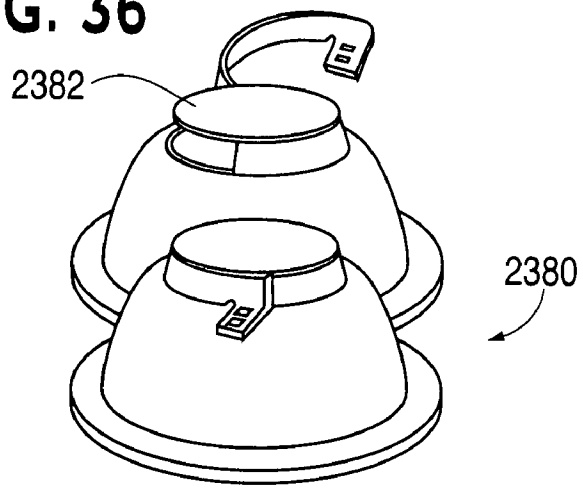

FIGS. 36 through 39 illustrate embodiments of air conduits that include protective covers that are intended to be maintained in place until purchased by a user and then removed and discarded. The covers 2382, 2482 and 2582 are intended to be sealed in place for sanitary or prophylactic purposes. FIG. 39 illustrates the air conduit 2580 that is illustrated in FIG. 38 with the cover 2582 removed.

Figure 40:
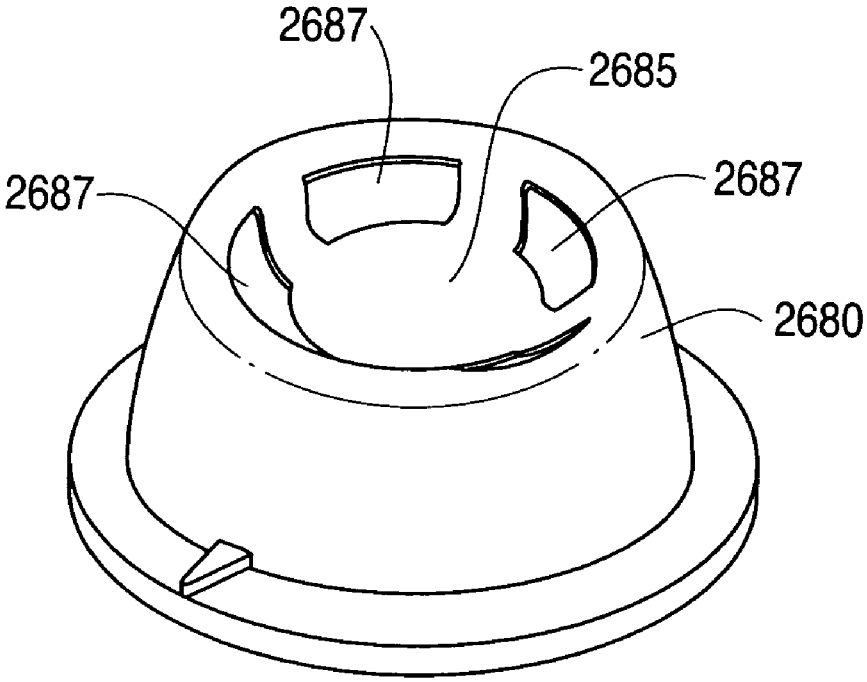

FIG. 40 illustrates an embodiment of an air conduit 2680 having an insert 2685 that allows air to pass through via openings 2687 while preventing some debris from entering the air conduit. The insert 2685 also provides and aesthetically pleasing appearance.

Any of the alternative air conduits described with respect to FIGS. 22 through 40 can be utilized with any of the embodiments of the air distribution device and hand covering described herein. Additionally, the hand covering and air distribution device can be configured to accommodate a variety of interchangeable air conduits.

Figure 42:
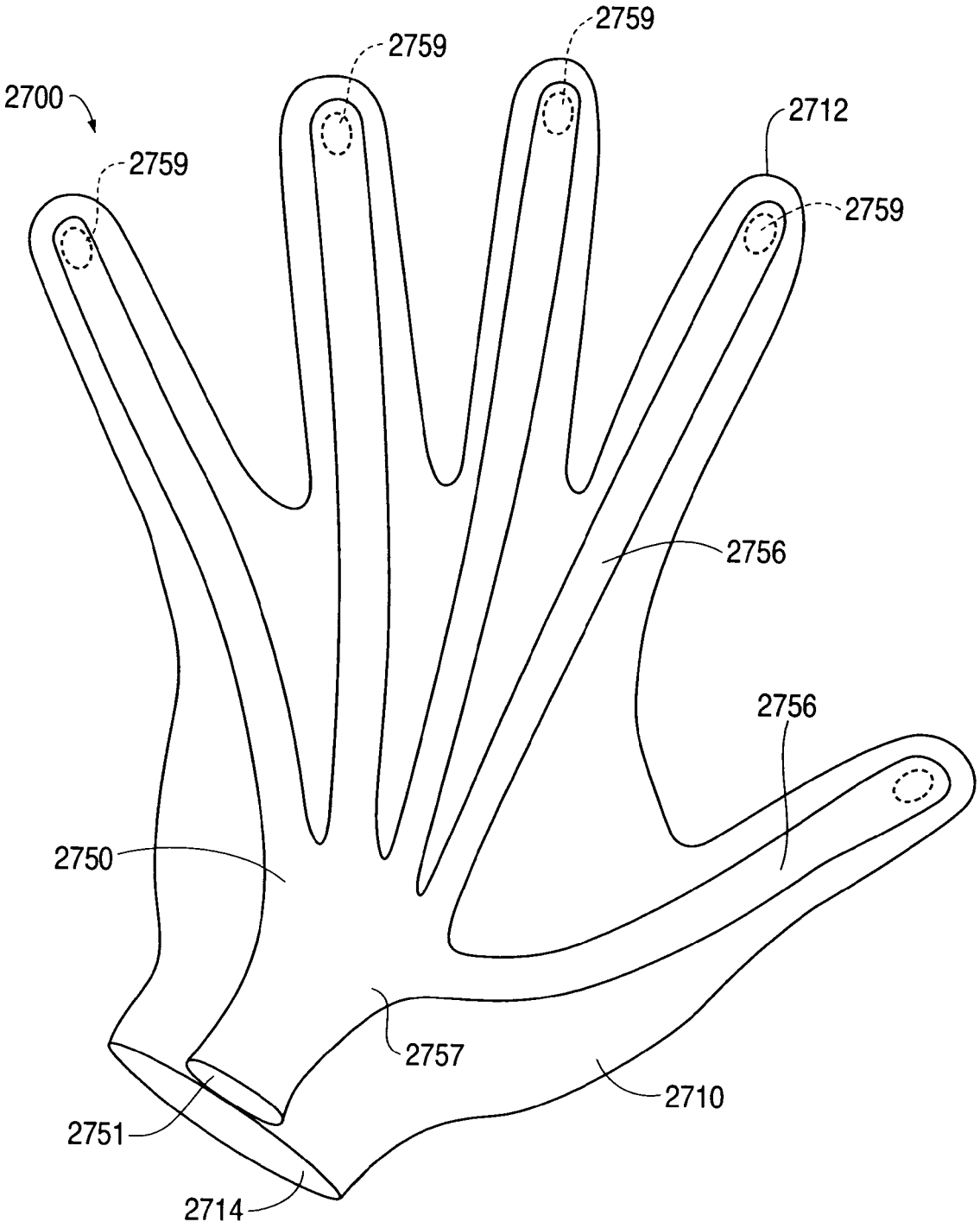
FIG. 42 illustrates an alternative embodiment of the hand covering according to the present invention.

FIG. 42 illustrates an alternative embodiment of a hand covering 2700 according to the present invention. The illustrated embodiment can be used alone, or as a liner that can be inserted into, for example, a glove, mitten, or similar article. In this manner, the air distribution device of the present invention can be used inside of existing hand coverings.

The hand covering 2700 includes a hand receiving portion 2710 having a first end 2712 and a second end 2714. An air distribution device 2750 is coupled to the hand receiving portion 2710 and includes an inlet 2751 and outlets 2759. An air chamber 2757 is located adjacent the inlet 2751. The air distribution device includes air channels 2756 that extend between the air chamber 2757 and the outlets 2759.

The air distribution device 2750 may be constructed from two membranes as described above or, alternatively, may include a single membrane coupled adjacent to one side of the hand receiving portion 2710.

In use, when the hand covering 2700 is used as a liner to be inserted into a glove or a mitten, the first end 2712 of the hand covering 2750 can be positioned adjacent to the closed end of the glove or mitten and the second end 2714 can be positioned adjacent to the open end of the glove or mitten.

Figure 43:
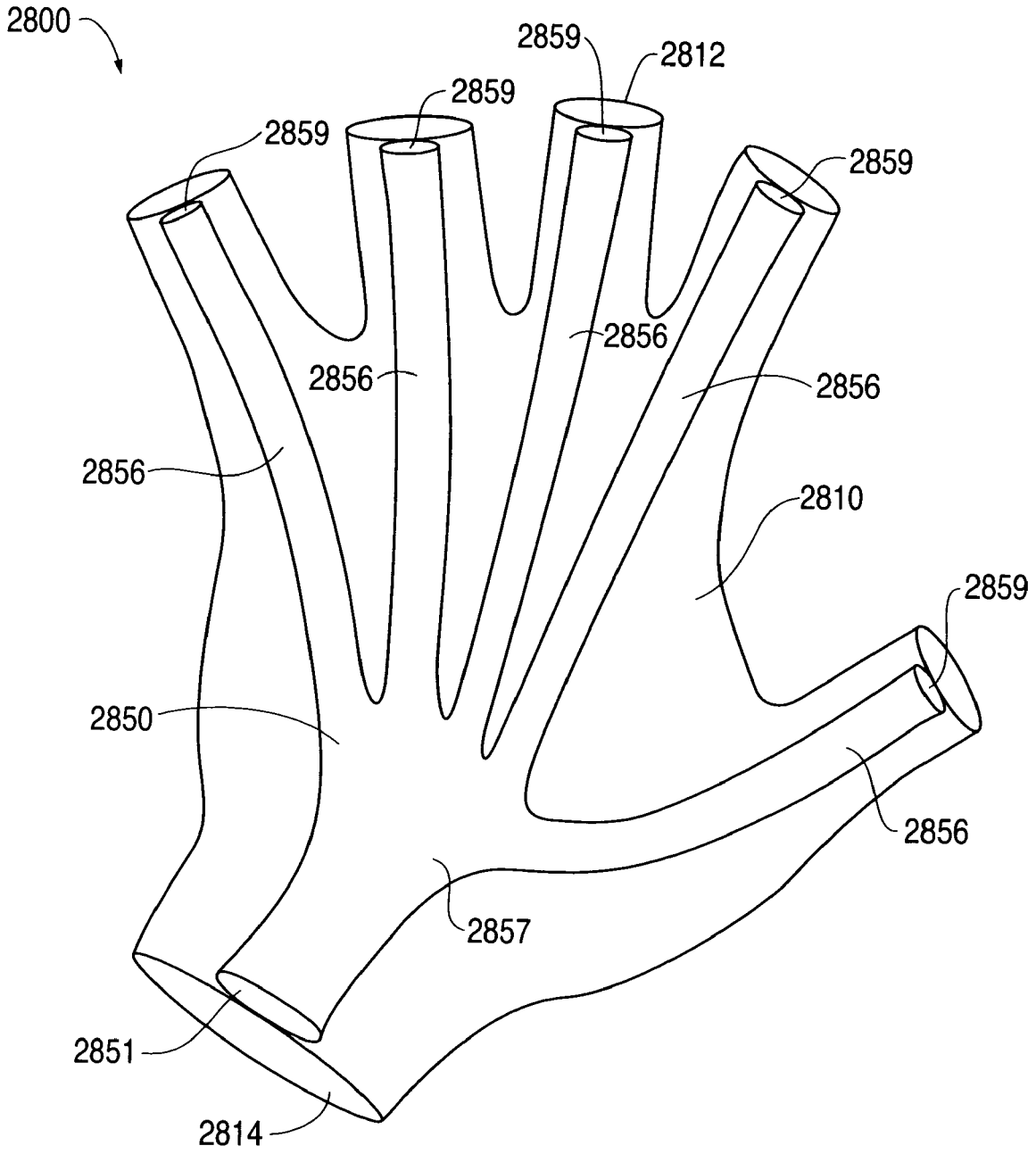
FIG. 43 illustrates a further alternative embodiment of the hand covering according to the present invention.

FIG. 43 illustrates a further embodiment of the invention in which hand covering 2800 includes a hand receiving portion 2810 having a first end 2812 and a second end 2814. The hand receiving portion 2810 defines a first opening at the second end 2814 for receiving a user's hand. The hand receiving portion 2810 also defines multiple openings at the first end 2812 configured to receive the fingers of a user therethrough.

An air distribution device 2850 is coupled to the hand receiving portion 2810 and includes an inlet 2851, and multiple outlets 2859 spaced apart from the inlet 2851. The air distribution device 2850 is configured to communicate air from the inlet 2851 to the multiple outlets 2859 through multiple air channels 2856 such that the temperature and pressure of the air at the inlet 2851 are substantially the same as the temperature and pressure at the outlets 2859. Alternatively, the pressure of the air at the inlet 2851 may be different than the pressure of the air at the multiple outlets 2859. The air distribution device 2850 can include an air chamber 2857 located between the inlet 2851 and the air channels 2856.

The inlet 2851 of the air distribution device 2850 is substantially coplanar with the opening defined at the second end 2814 of the hand receiving portion 2810. The outlets 2850 are each substantially coplanar with an opening defined at the first end 2812 of the hand receiving portion 2810. In this manner, air that is distributed through the air distribution device 2850 is exhausted to the portion of the user's hand that protrudes through the openings defined in the first end 2812 of the hand receiving portion 2810. Because the air distribution device 2850 does not dissipate a substantial amount of heat along the length of the air passages as previously described, the amount heat exhausted at the outlet is maximized. As illustrated in FIG. 43, each of the membrane and the hand-receiving portion is substantially arcuate in cross-section and has a concavity with respect to a direction.

The air distribution device may include two membranes, as described above, that define the inlet 2851, the outlets 2859 and the air passages 2856. There may be a material disposed between the two membranes that has the moisture reducing, moisture retaining and/or heat retaining qualities described above.

In alternative embodiments, the air distribution device may include a single membrane coupled adjacent to one side of the hand receiving portion 2810. In such an embodiment, the membrane and the hand receiving portion together define the inlet 2851, the outlets 2859 and the air passages 2856. There may be material disposed between the membrane and the hand receiving portion as previously described.

In use, the hand covering 2800 may be used as a liner that is inserted into another hand covering such as a glove or a mitten.

Figure 44:
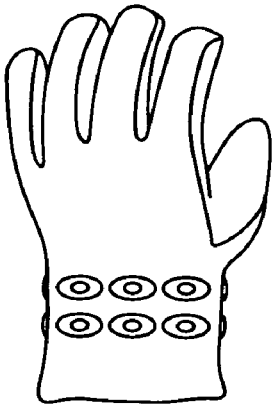
FIGS. 44 through 145 illustrate alternative embodiments of the hand covering according to the present invention.
Figure 145:
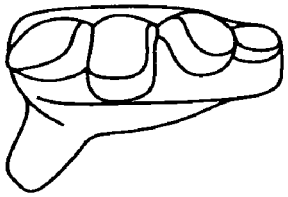

FIGS. 44 through 145 illustrate embodiments of the hand covering illustrating alternative embodiments and locations of the air conduit according to the present invention. The illustrated embodiments include air conduits of varying shape, height (i.e., distance from the surface of the glove to the inlet of the air conduit), position and relative orientation.

Figure 45:
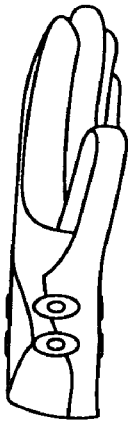
Figure 46:
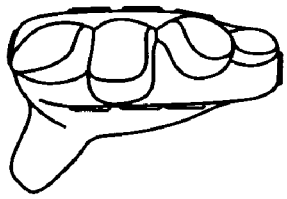
Figure 47:
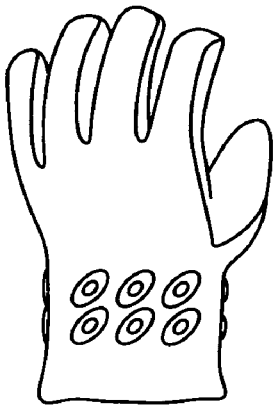
Figure 48:
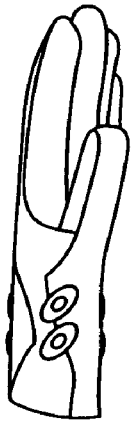
Figure 49:
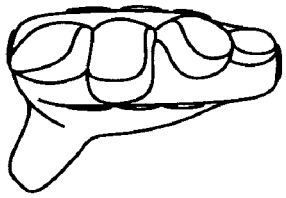
Figure 50:
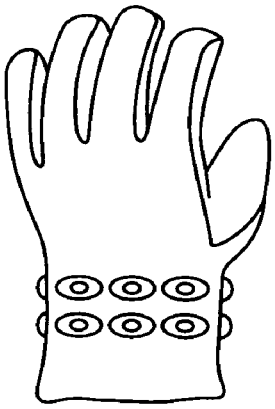
Figure 51:
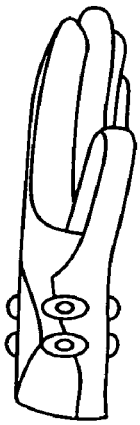
Figure 52:
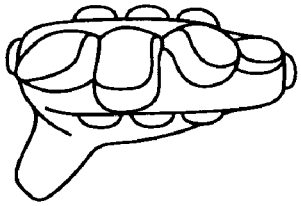
Figure 53:
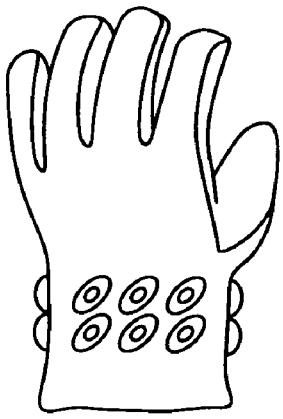
Figure 54:
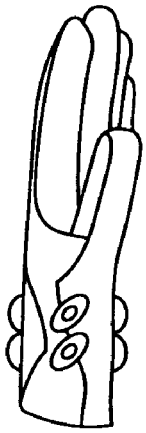
Figure 55:
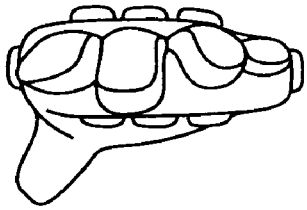
Figure 56:
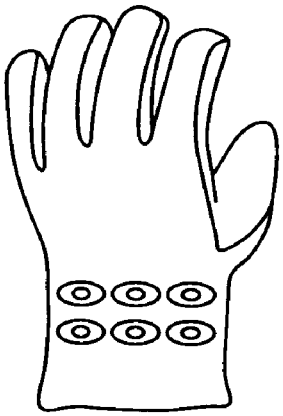
Figure 57:
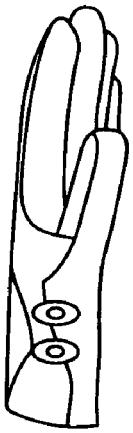
Figure 58:
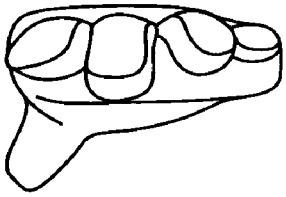
Figure 59:
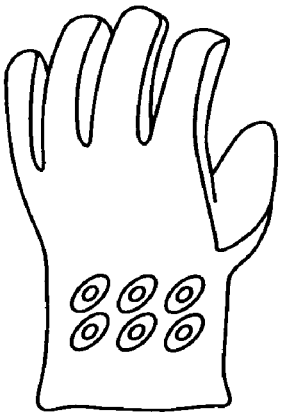
Figure 60:
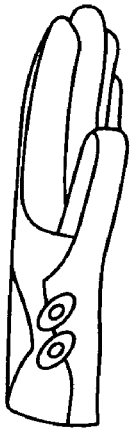
Figure 61:
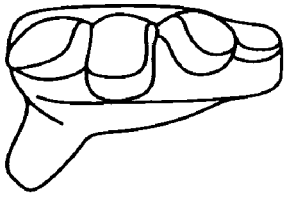
Figure 62:
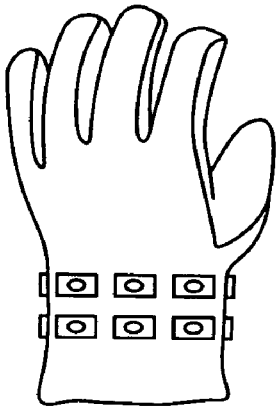
Figure 63:
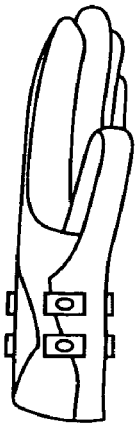
Figure 64:
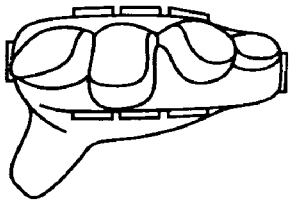
Figure 65:
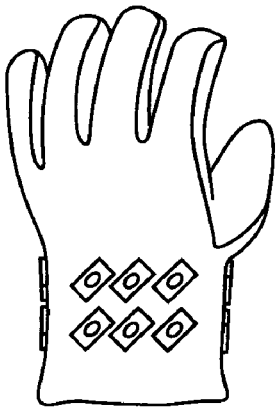
Figure 66:
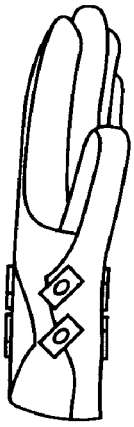
Figure 67:
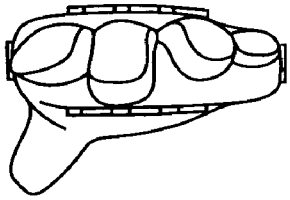
Figure 68:
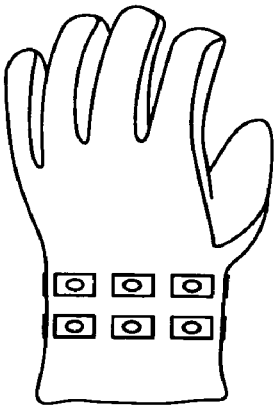
Figure 69:
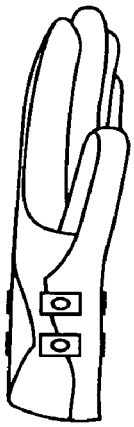
Figure 70:
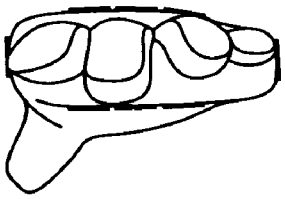
Figure 71:
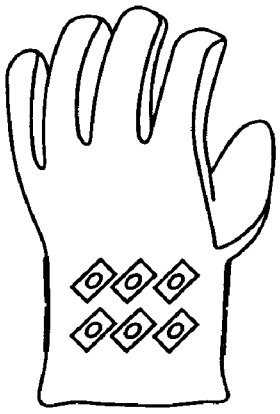
Figure 72:
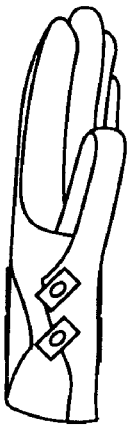
Figure 73:
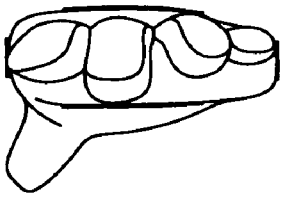
Figure 74:
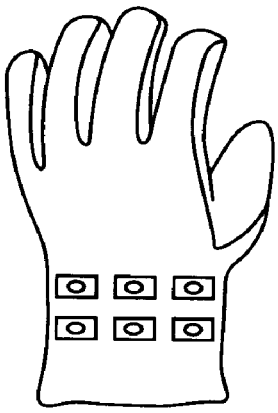
Figure 75:
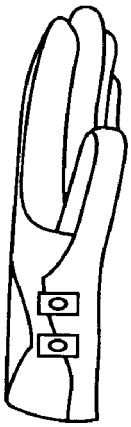
Figure 76:
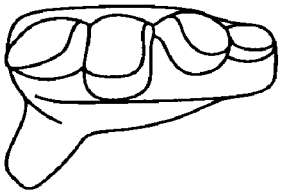
Figure 77:
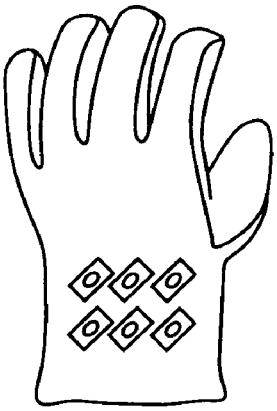
Figure 78:
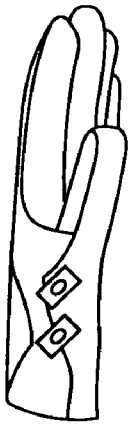
Figure 79:
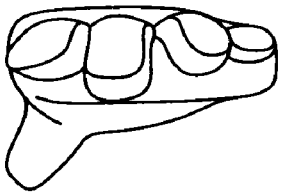
Figure 80:
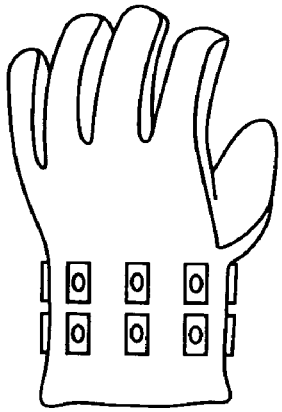
Figure 81:
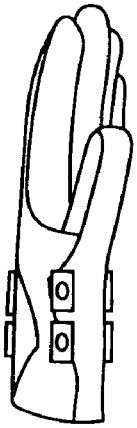
Figure 82:
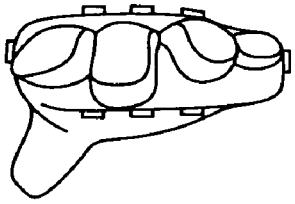
Figure 83:
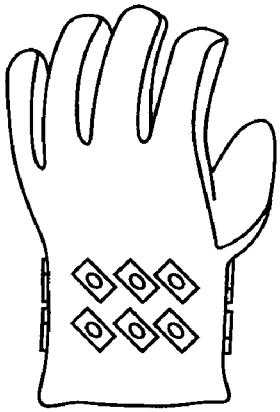
Figure 84:
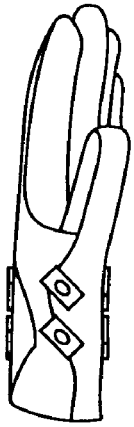
Figure 85:
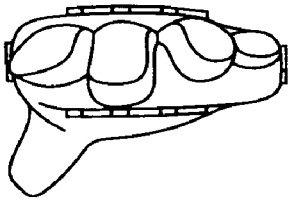
Figure 86:
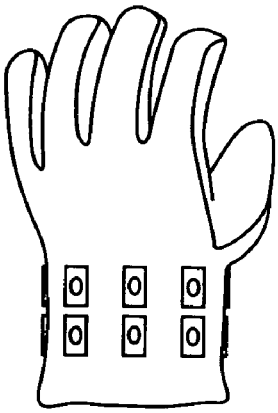
Figure 87:
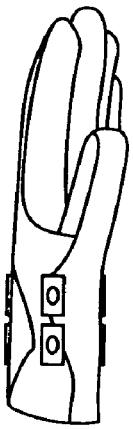
Figure 88:
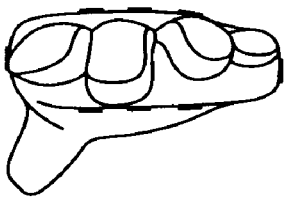
Figure 89:
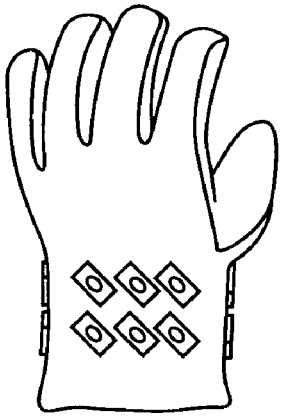
Figure 90:
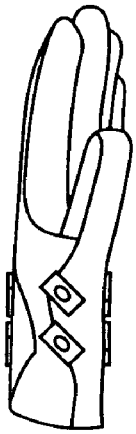
Figure 91:
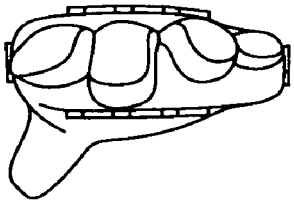
Figure 92:
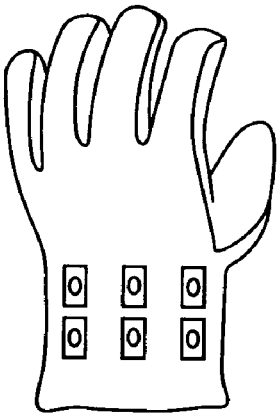
Figure 93:
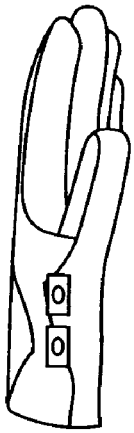
Figure 94:
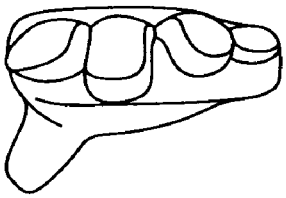
Figure 95:
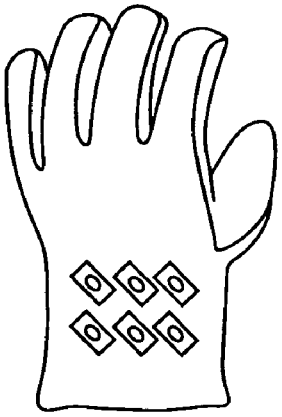
Figure 96:
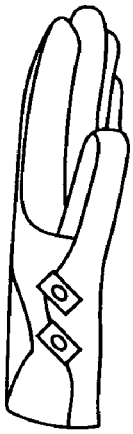
Figure 97:
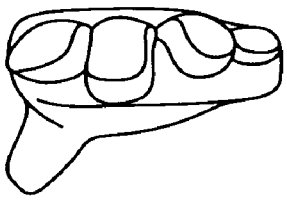
Figure 110:
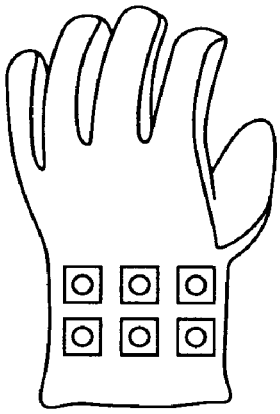
Figure 111:
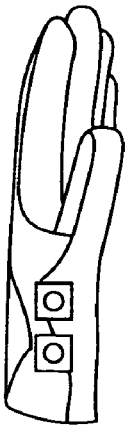
Figure 112:
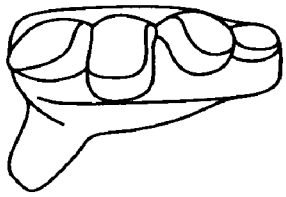
Figure 113:
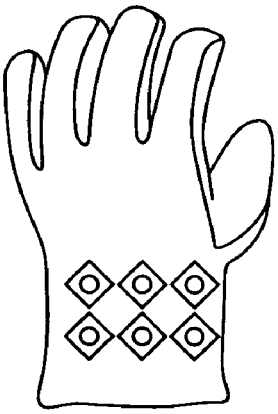
Figure 114:
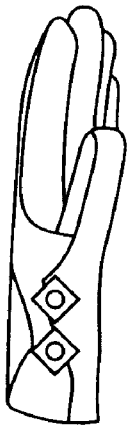
Figure 115:
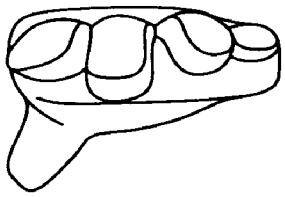
Figure 116:
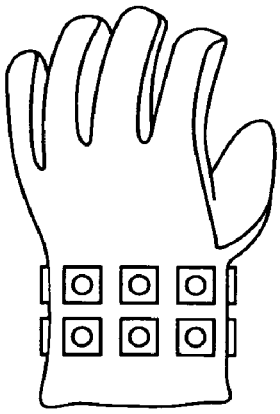
Figure 117:
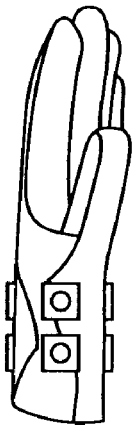
Figure 118:
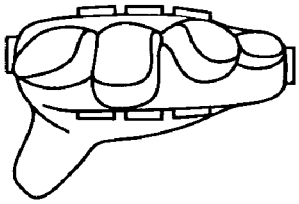
Figure 119:
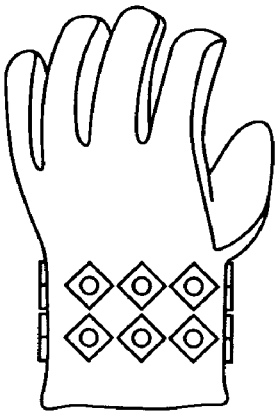
Figure 120:
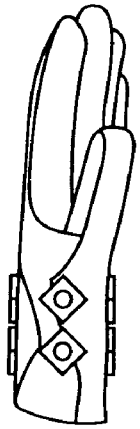
Figure 121:
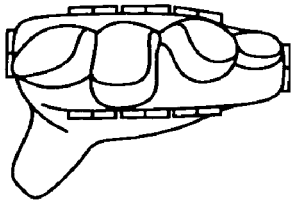
Figure 122:
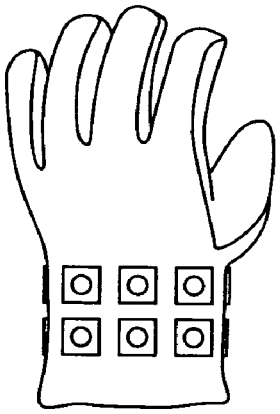
Figure 123:
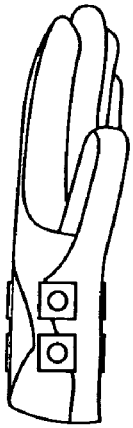
Figure 124:
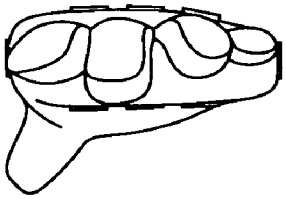
Figure 125:
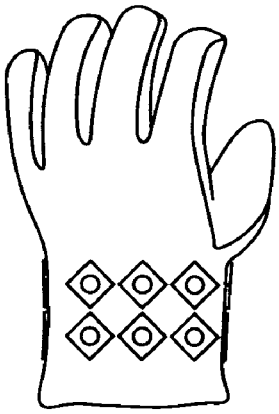
Figure 126:
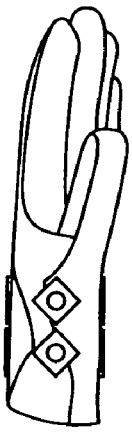
Figure 127:
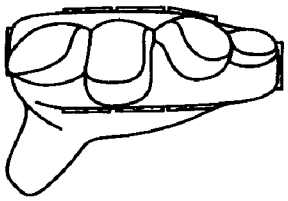
Figure 128:
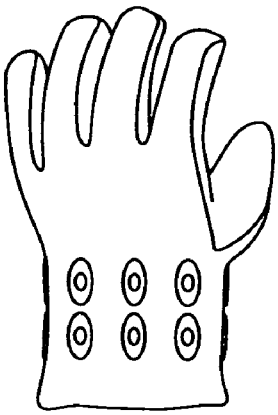
Figure 129:
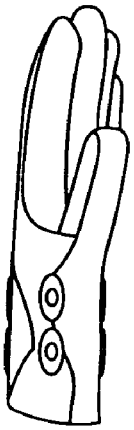
Figure 130:
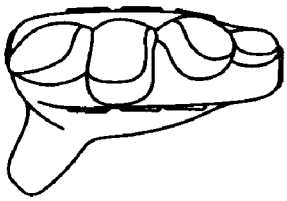
Figure 131:
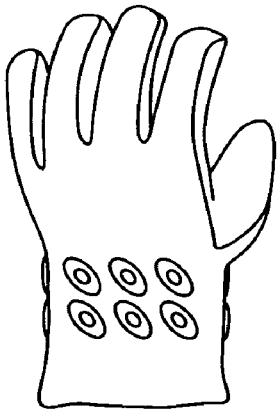
Figure 132:
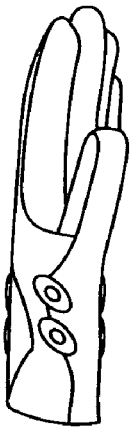
Figure 133:
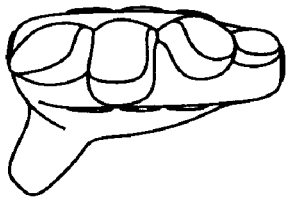
Figure 134:
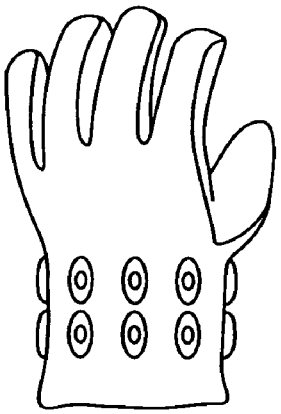
Figure 135:
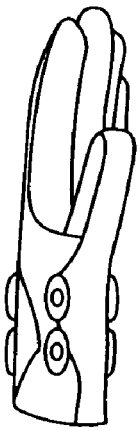
Figure 136:
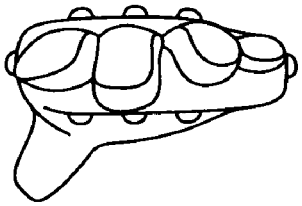
Figure 137:
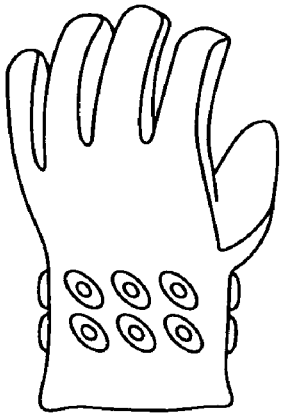
Figure 138:
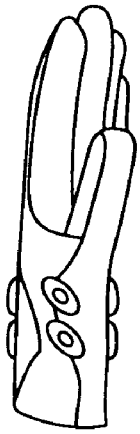
Figure 139:
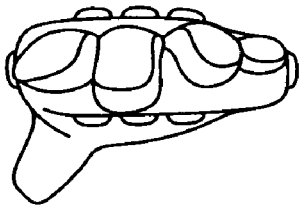
Figure 140:
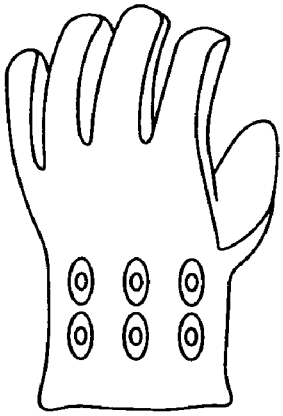
Figure 141:
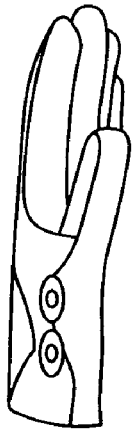
Figure 142:
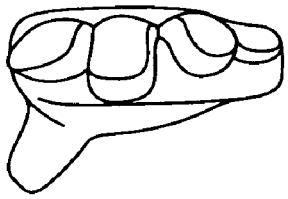
Figure 143:
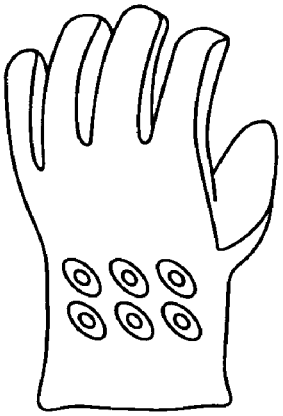
Figure 144:
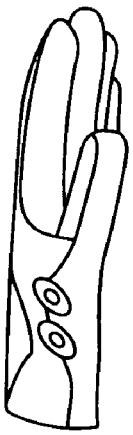

Each group of three figures represents a top, side and front view of the illustrated embodiment. For example, FIG. 44 is a top view of a hand covering illustrating an air conduit in multiple possible locations. The hand covering may include multiple air conduits or may include one air conduit at one of the several illustrated locations. Moreover, an air conduit may be positioned at any other position of the hand covering, whether or not illustrated. FIG. 45 is a side view of the hand covering illustrated in FIG. 44. FIG. 46 is a front view of the hand covering illustrated in FIG. 44.

The hand covering can be manufactured by coupling the first membrane of the air distribution device to the second membrane of the air distribution device to provide the air chamber and air channeling members as described above. The two membranes can be coupled together, for example, by a radio frequency weld adjacent to an edge of each of the first and second membranes, or alternatively, by melting or heat welding the two membranes together. The completed air distribution device is then positioned adjacent the first layer or hand receiving portion of the hand covering and then the second layer or cover is then positioned adjacent the hand receiving portion such that the air distribution device is substantially encapsulated between the first layer and second layer.

The first layer and second layer of the hand covering are then coupled together by, for example, using a single seam. In the embodiment described above in which the air distribution device 450 includes tabs or securing elements 470, 475, the tabs may be sewn along the same seam, or alternatively may be separately attached to the first layer or hand receiving portion. In embodiments in which the hand covering includes an air conduit, the air conduit is coupled adjacent to the inlet of the air distribution device. The air conduit may be coupled directly to the air distribution device, may be coupled to the second layer or cover, or may be coupled to both the air distribution device and the cover.

In embodiments of the invention that include a layer of material between the first and second membrane of the air distribution device, the material is positioned between the two membranes before they are secured together as described above. The material may be positioned throughout the entire air distribution device, or may alternatively be positioned throughout only a portion of the air distribution device.

Figure 41:
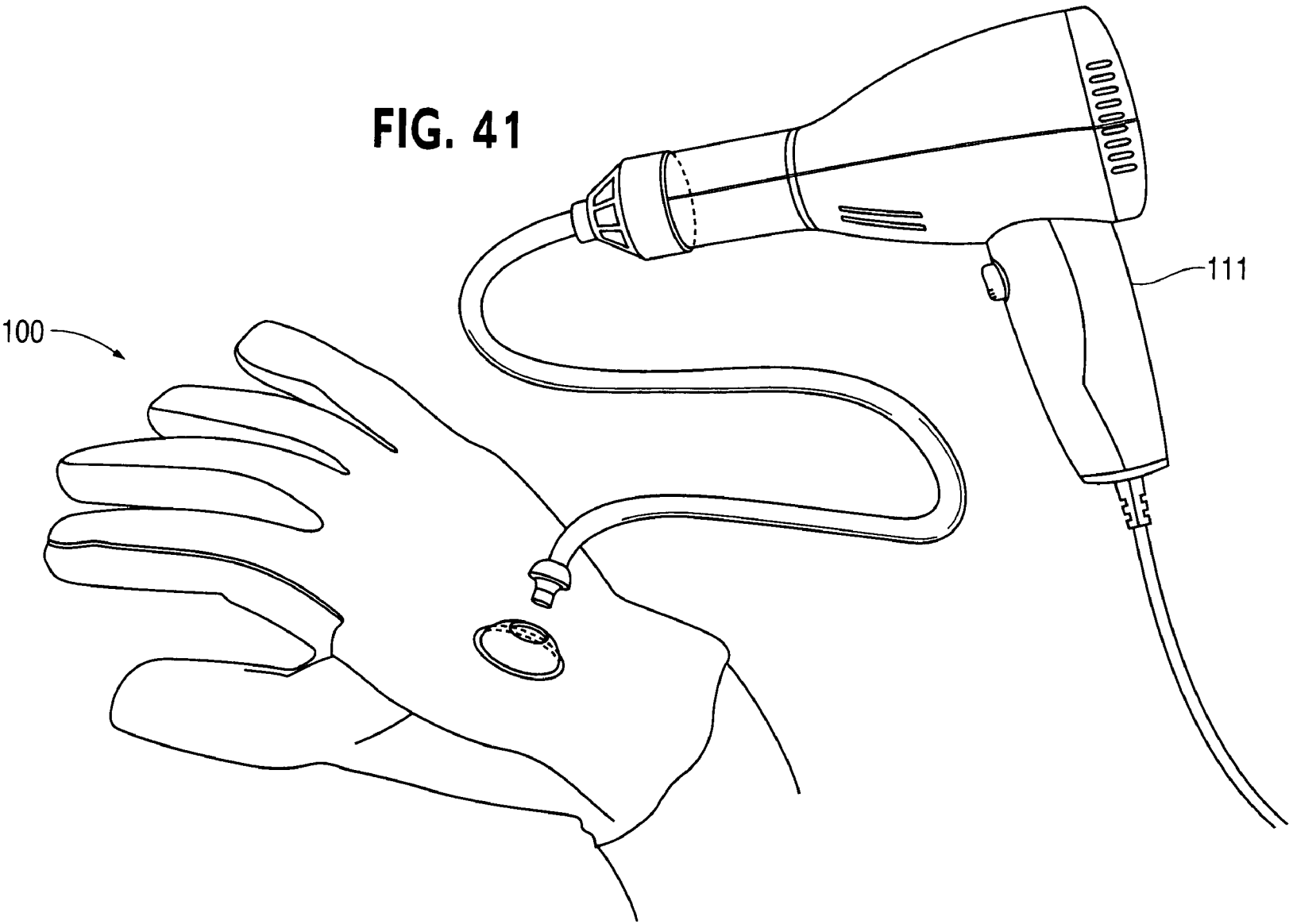
FIG. 41 illustrates a method for providing airflow to the hand covering according to the present invention.

In use, air is distributed to a closed end of the hand covering 100 when pressurized air is received from an air source, such as, for example, a user's mouth. An alternative source of air could be a conventional blow dryer 111 as illustrated in FIG. 41. The pressurized air is then channeled to an air inlet that is defined by the first membrane of the air distribution device and then channeled to the air outlet adjacent to the closed end of the hand covering. The volume of air provided at the inlet is provided at an inlet temperature greater than an ambient temperature (i.e., the user's hand temperature) and is channeled through the air distribution device to the air outlet adjacent the closed end of the hand covering. Substantially all of the volume of air is channeled to the air outlet at a temperature substantially equal to the inlet temperature.

Figure 11:
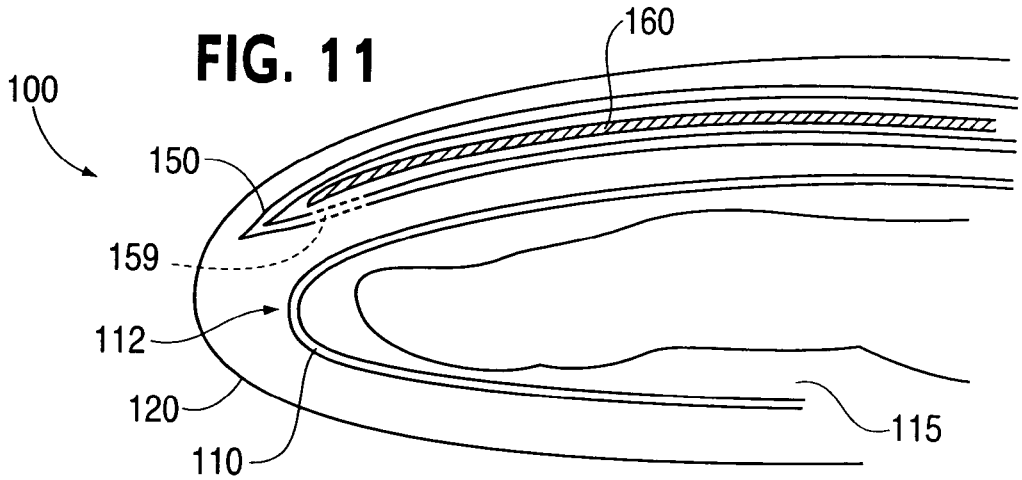
FIG. 11 illustrates a partial cross sectional view of a further embodiment of the present invention taken along the line A—A in FIG. 3.
Figure 146:
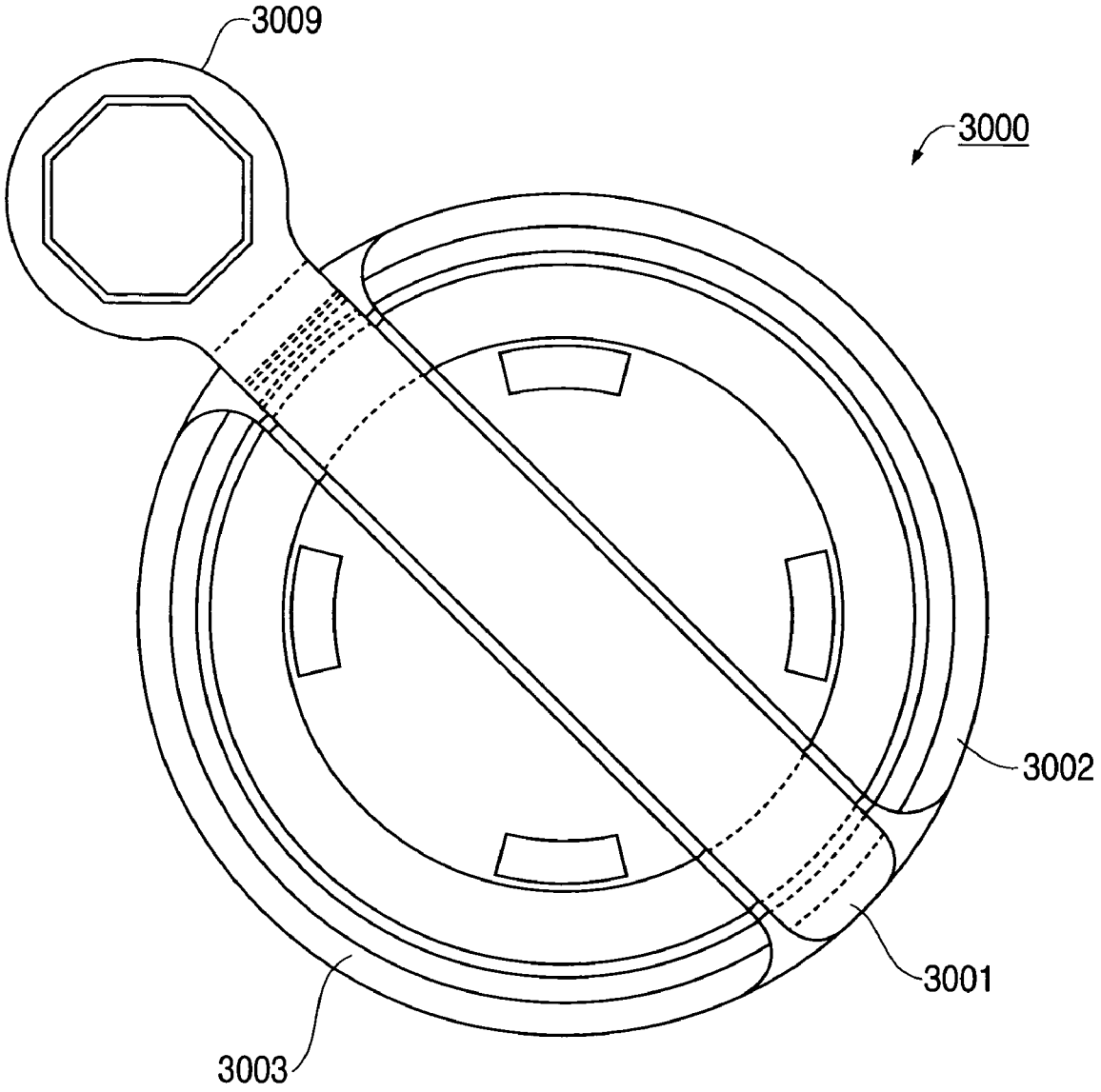
FIGS. 146 through 154 show various views of an air conduit and a removable inlet cover, according to an embodiment of the invention.
Figure 147:
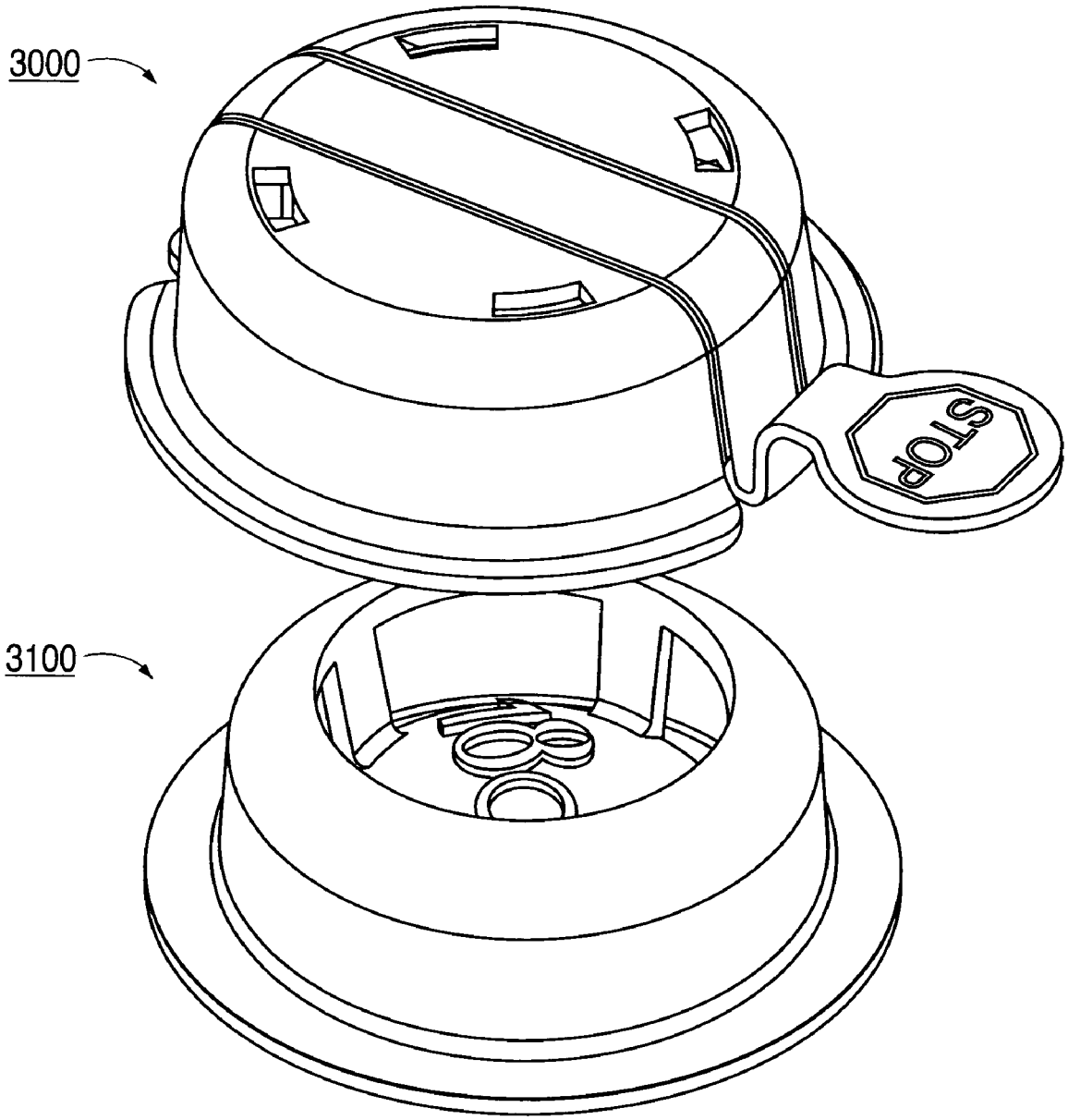
Figure 148:
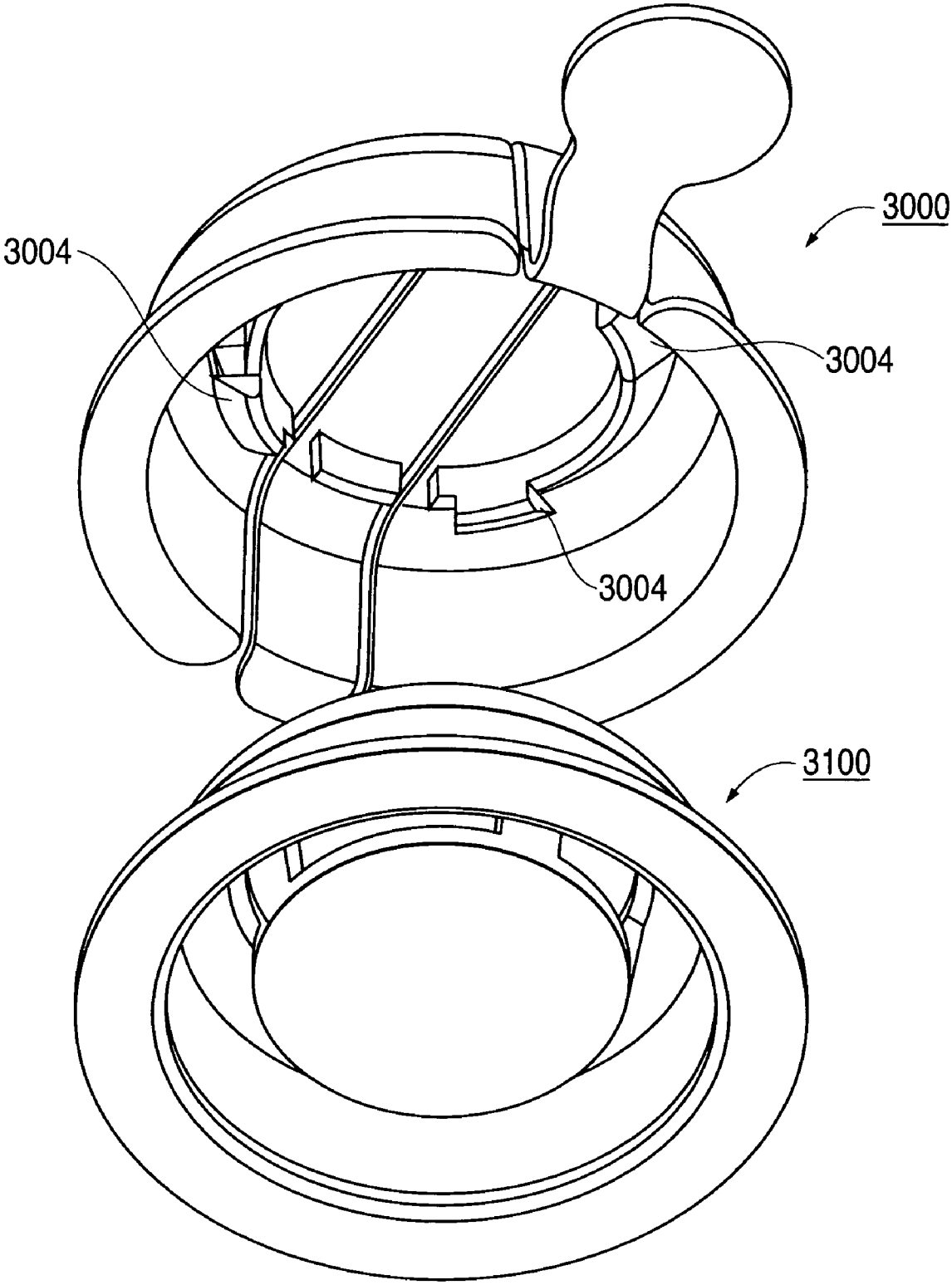
Figure 149:
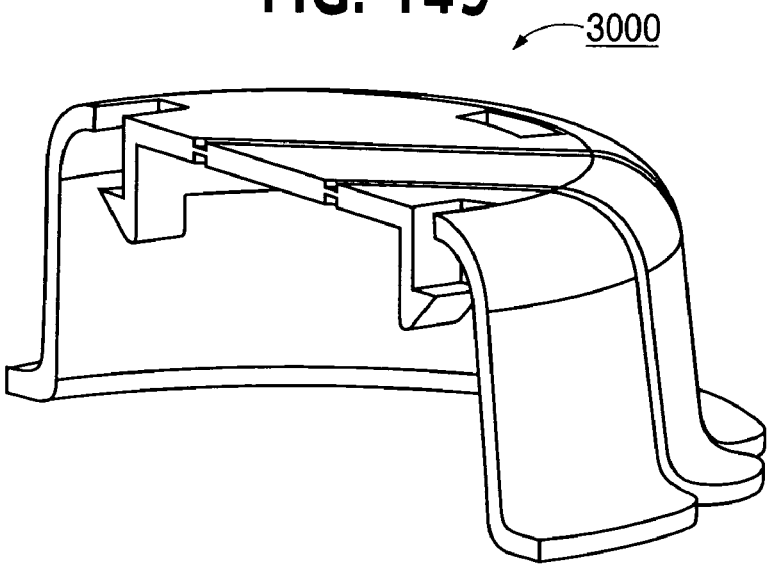
Figure 150:
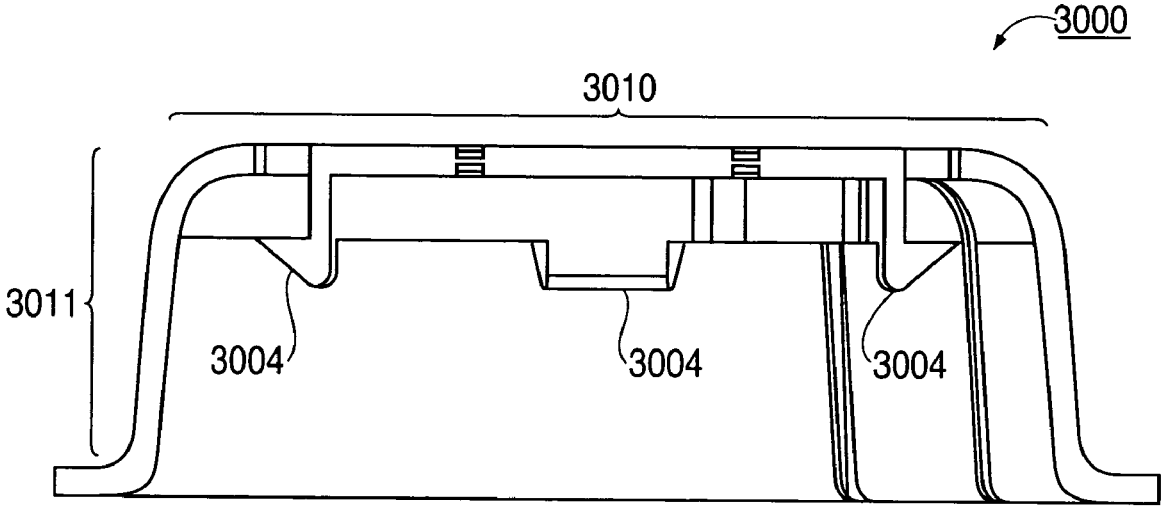
Figure 151:
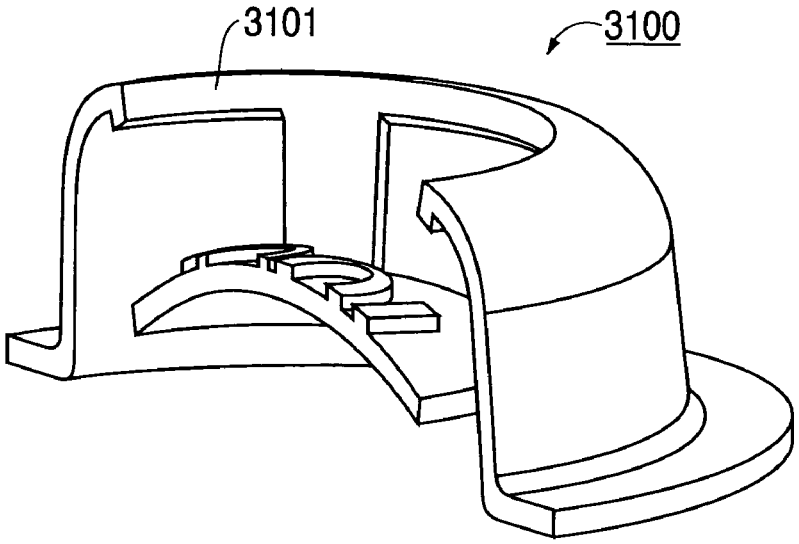
Figure 152:
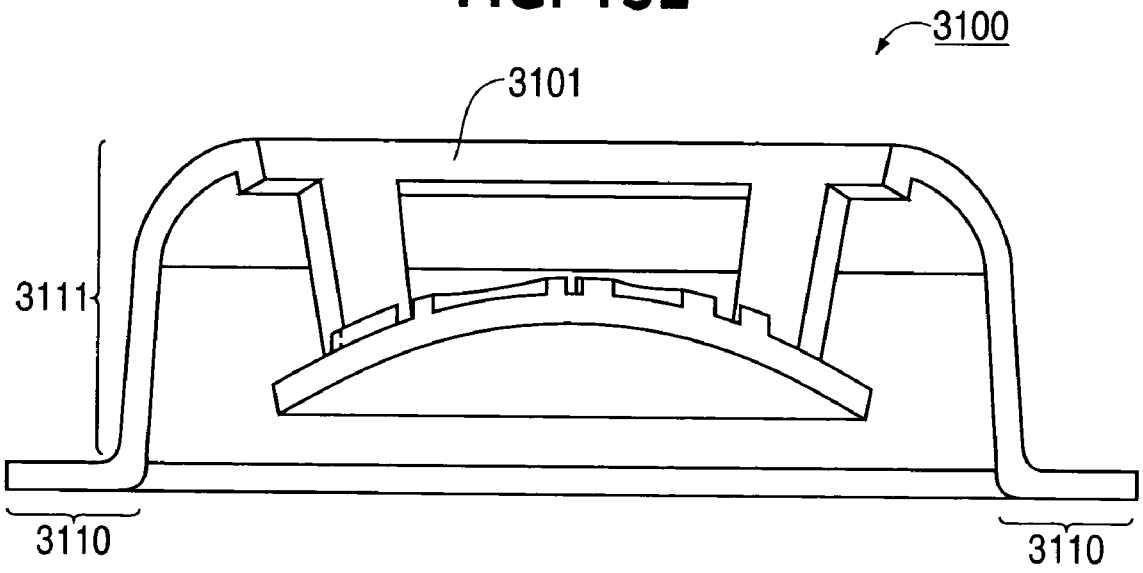
Figure 153:
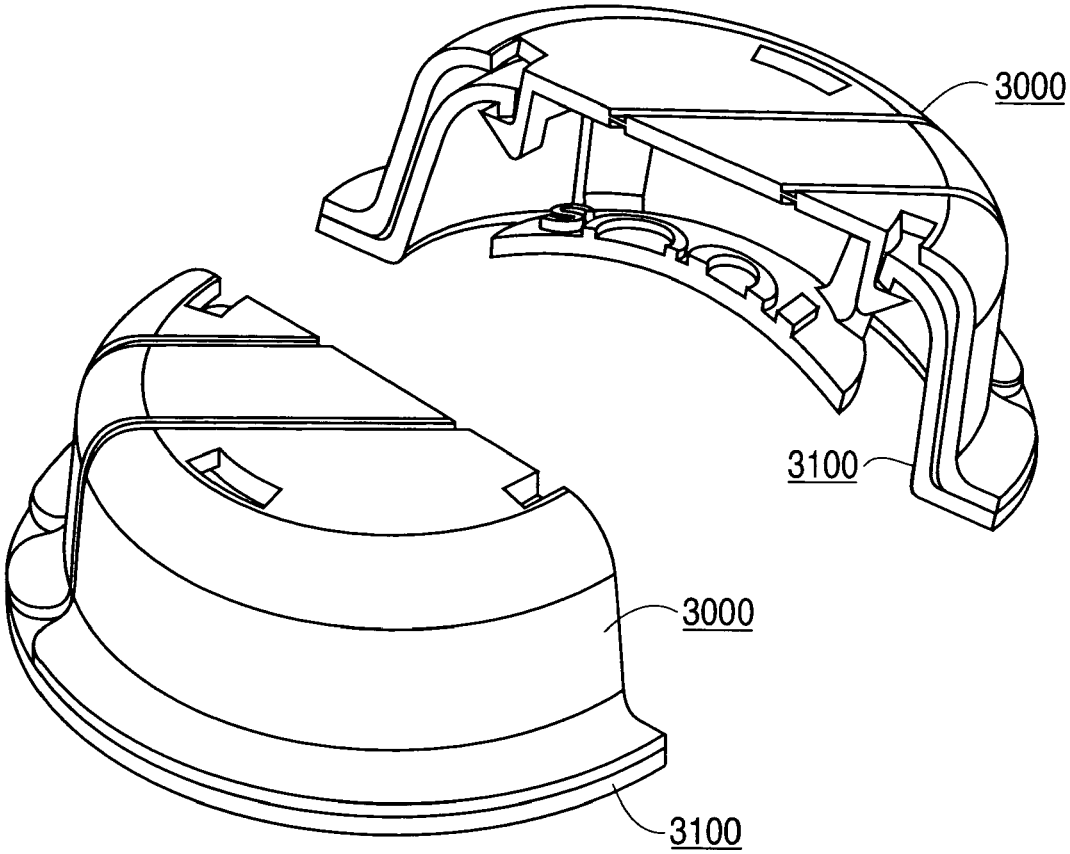
Figure 154:
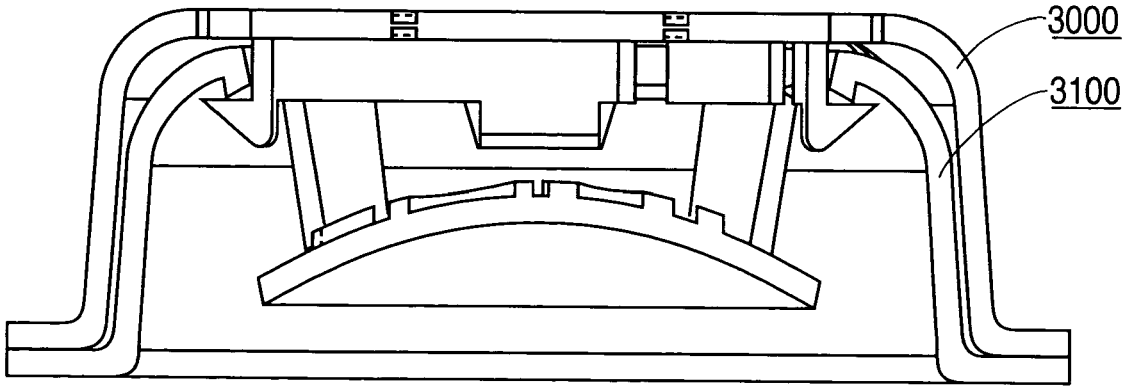

FIGS. 146 through 154 show various views of an air conduit and a removable inlet cover, according to an embodiment of the invention. More specifically, FIG. 146 shows a top view of an inlet cover 3000. FIGS. 147 and 148 show a top exploded view and a lower exploded view of inlet cover 3000 and air conduit 3100, respectively. FIGS. 149 and 150 show a perspective cut-away view and a side cut-away view, respectively, of inlet cover 3000. FIGS. 151 and 11 show a perspective cut-away view and a side cut-away view, respectively, of air conduit 3100. FIGS. 153 and 154 show a perspective cut-away view and a side cut-away view, respectively, of the inlet cover 3000 coupled to the air conduit 3100.

As shown in FIG. 146, the inlet cover 3000 includes a central portion 3001, a portion 3002 and a portion 3003. The central portion 3001 is disposed between and removably attached to the portions 3002 and 3003. The central portion 3001 includes a tab 3009. As best shown in FIG. 150, the inlet cover 3000 has an upper portion 3010 and a protrusion portion 3011. As best shown in FIG. 148, portions 3002 and 3003 each include two retaining portions 3004 (one of which is not explicitly shown in FIG. 148).

As shown in FIG. 151, for example, the air conduit 3100 includes an interior rim portion 3101. As best shown FIG. 152, air conduit 3100 has a base portion 3110 and a protrusion portion 3111.

Inlet cover 3000 and air conduit 3100 can be used in combination so that the inlet cover 3000 is removable from air conduit 3100, but not reattached to air conduit 3100 once inlet cover 3000 has been removed. Inlet cover 3000 can be attached to air conduit 3100 by placing the inlet cover 3000 over air conduit 3100 and snapping the inlet cover 3000 so that the retaining portions 3004 engage the interior rim portion 3101 of air conduit 3100. Once the retaining portions 3004 are snap-fit engaged onto the interior rim portion 3101 of air conduit 3100, the inlet cover 3000 maintains its position covering the air conduit 3100 until a user pulls the central portion 3001 of inlet cover 3000.

By pulling the tab 3009 of the central portion 3001, the central portion 3001 is permanently separated from portions 3002 and 3003. Once the central portion 3001 is separated from portions 3002 and 3003, the snap-fit by which the retaining portions 3004 engage the interior rim 3101 of air conduit 3100 no longer remains and the inlet cover 3000 can be removed from the inlet of air conduit 3100.

Although shown with two retaining portions 3004 for each portion 3002 and 3003, these portions in alternative embodiments can have as few as a single retaining portion and many more than two retaining portions. In yet another embodiment, the inlet cover can include only a single portion and a central portion.

Figure 155:
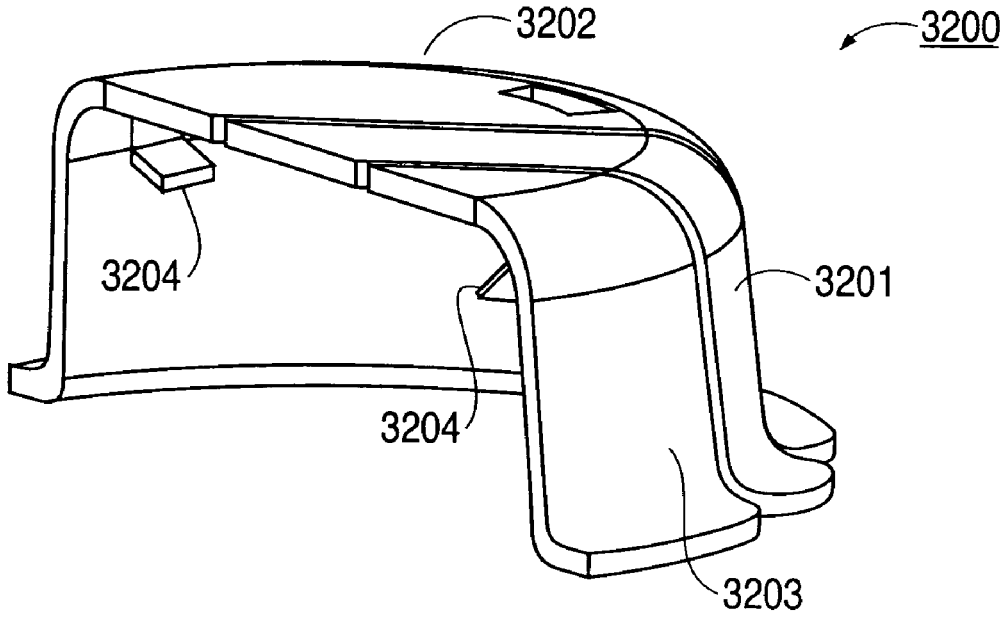
FIGS. 155 and 156 show a perspective cut-away view of an inlet cover and air conduit, respectively, according to another embodiment of the invention.
Figure 156:
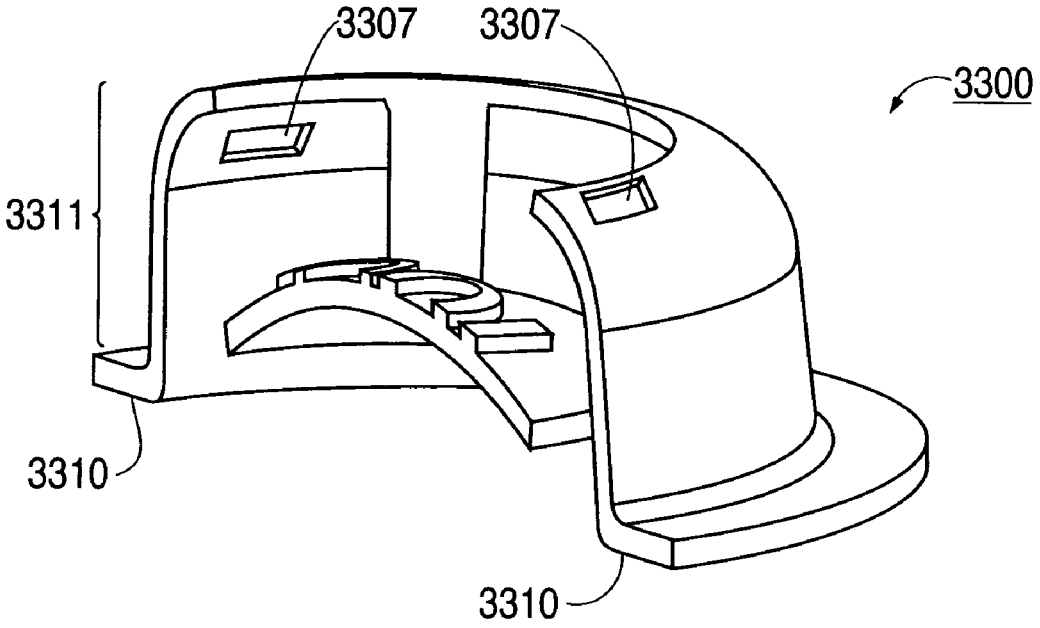

FIGS. 155 and 156 show a perspective cut-away view of an inlet cover and air conduit, respectively, according to another embodiment of the invention. As shown in FIG. 155, inlet cover 3200 includes a central portion 3201, a portion 3202 and a portion 3203. The central portion 3201 is disposed between and removably attached to the portions 3202 and 3203. The inlet cover 3200 has an upper portion and a protrusion portion. Portions 3202 and 3203 each include a retaining portion 3204. As shown in FIG. 156, the air conduit 3300 includes a base portion 3310 and a protrusion portion 3311. The air conduit 3300 also includes openings 3307.

Inlet cover 3200 and air conduit 3300 can be used in combination so that the inlet cover 3200 is removable from air conduit 3300, but not reattached to air conduit 3300 once inlet cover 3200 has been removed. Inlet cover 3200 can be attached to air conduit 3300 by placing the inlet cover 3200 over air conduit 3300 and snapping the inlet cover 3200 so that the retaining portions 3204 engage the openings 3307 of air conduit 3300. Once the retaining portions 3204 are engaged into the openings 3307 of air conduit 3300, the inlet cover 3200 maintains its position covering the air conduit 3300 until a user pulls the central portion 3201 of inlet cover 3200. The inlet cover 3200 can be removed from air conduit 3300 in a manner similar to that described above in reference to the embodiment shown in FIGS. 146 through 154.

Although shown with two retaining portions 3204, in alternative embodiments inlet cover 3200 can have as few as a single retaining portion and more than two retaining portions. In yet another embodiment, one portion for the embodiment shown in FIG. 155 (i.e., portion 3202 or 3203) can be replaced with a portion of the inlet cover for the embodiment shown in FIGS. 146 through 154 (i.e., portion 3002 or 3003). In such an alternative embodiment, the air conduit includes an interior rim and an opening with which retaining portions of the inlet cover can removably engage.

Figure 157:
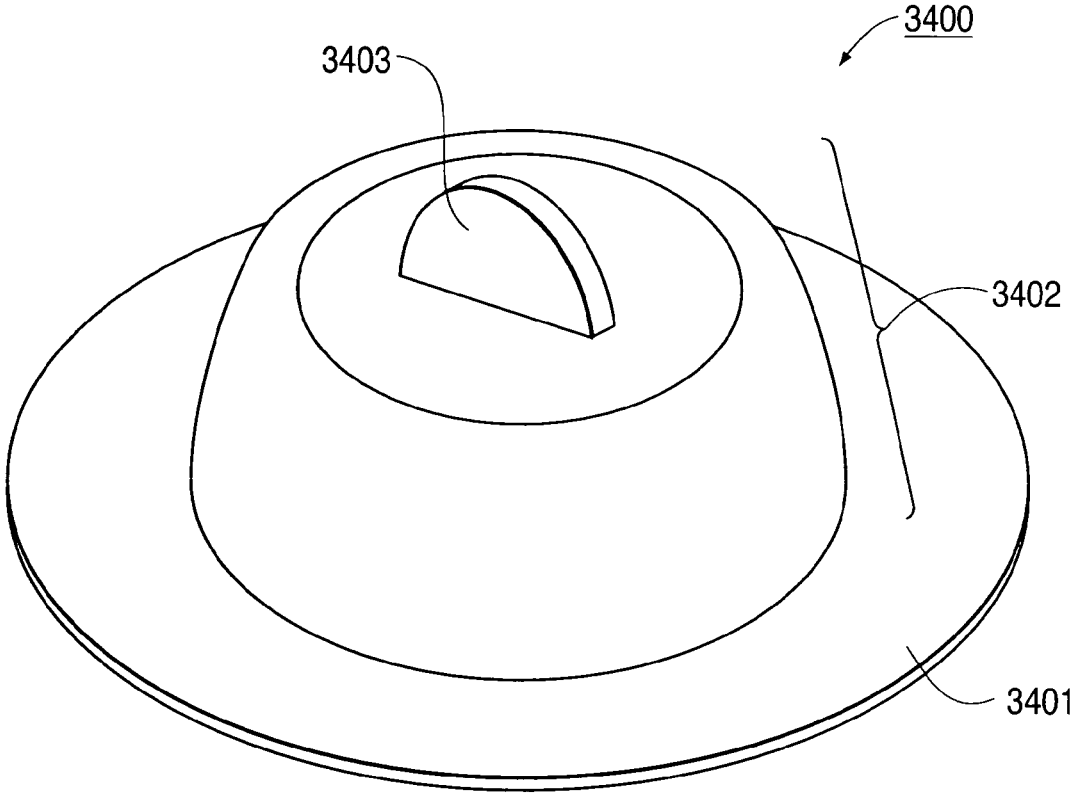
FIG. 157 shows a perspective view of an inlet cover, according to another embodiment of the invention.

FIG. 157 shows a perspective view of an inlet cover, according to another embodiment of the invention. Inlet cover 3400 has an upper portion 3401 and an external portion 3402. The external portion 3402 includes a pull tab 3403.

Inlet cover 3400 can be coupled to the hand covering in a number of ways. For example, inlet cover 3400 can be removably disposed between the cover 120 (not shown in FIG. 157) and the air distribution device 150 using a friction fit. In this configuration, the inlet cover 3400 can be removed by a user pulling the pull tab 3403 thereby separating the inlet cover 3400 from the cover 120 and air distribution device 150. By providing a snug fit, the inlet cover 3400 can be removed, but not reattached.

In another configuration the upper portion 3401 of the air cover 3400 can be fixedly attached to the cover 120 and/or air distribution device 150. In this configuration, the external portion 3402 and/or the pull tab 3403 can be separated from upper portion 3401. For example, the external portion 3402 or the pull tab 3403 can be torn from the remaining portions of the air cover 3400. In this manner, the external portion 3402 or the pull tab 3403 can be removed to expose the inlet of the air distribution device without being reattached.

Figure 158:
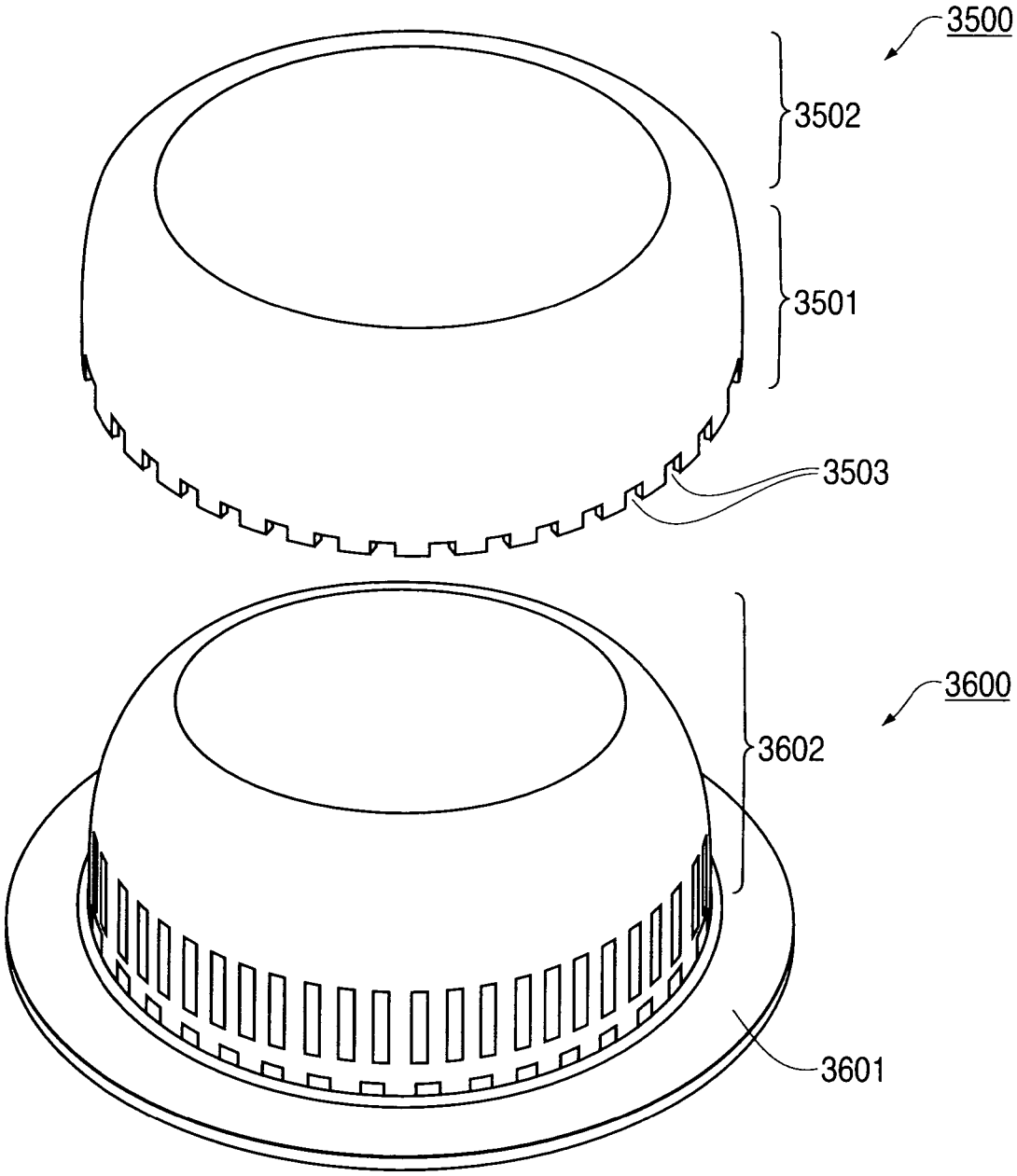
FIG. 158 shows a perspective exploded view of an inlet cover and an air conduit according to another embodiment of the invention.

FIG. 158 shows a perspective exploded view of an inlet cover and an air conduit according to another embodiment of the invention. Inlet cover 3500 has an upper portion 3502 and external portion 3501. The external portion 3501 includes locations 3503 disposed around its perimeter. Air conduit 3600 has a base portion 3601 and a protrusion portion 3602.

The locations 3503 of the external portion 3501 of the inlet cover 3500 can be removably attached around the perimeter of the protrusion portion 3601. A rotation motion that tears locations 3503 of inlet cover 3500 from the air conduit 3600, for example, can remove the inlet cover 3500 from the air conduit 3600. In this manner, the inlet cover 3500 can be removed to expose the inlet of air conduit 3600 without being reattached.

Figure 159:
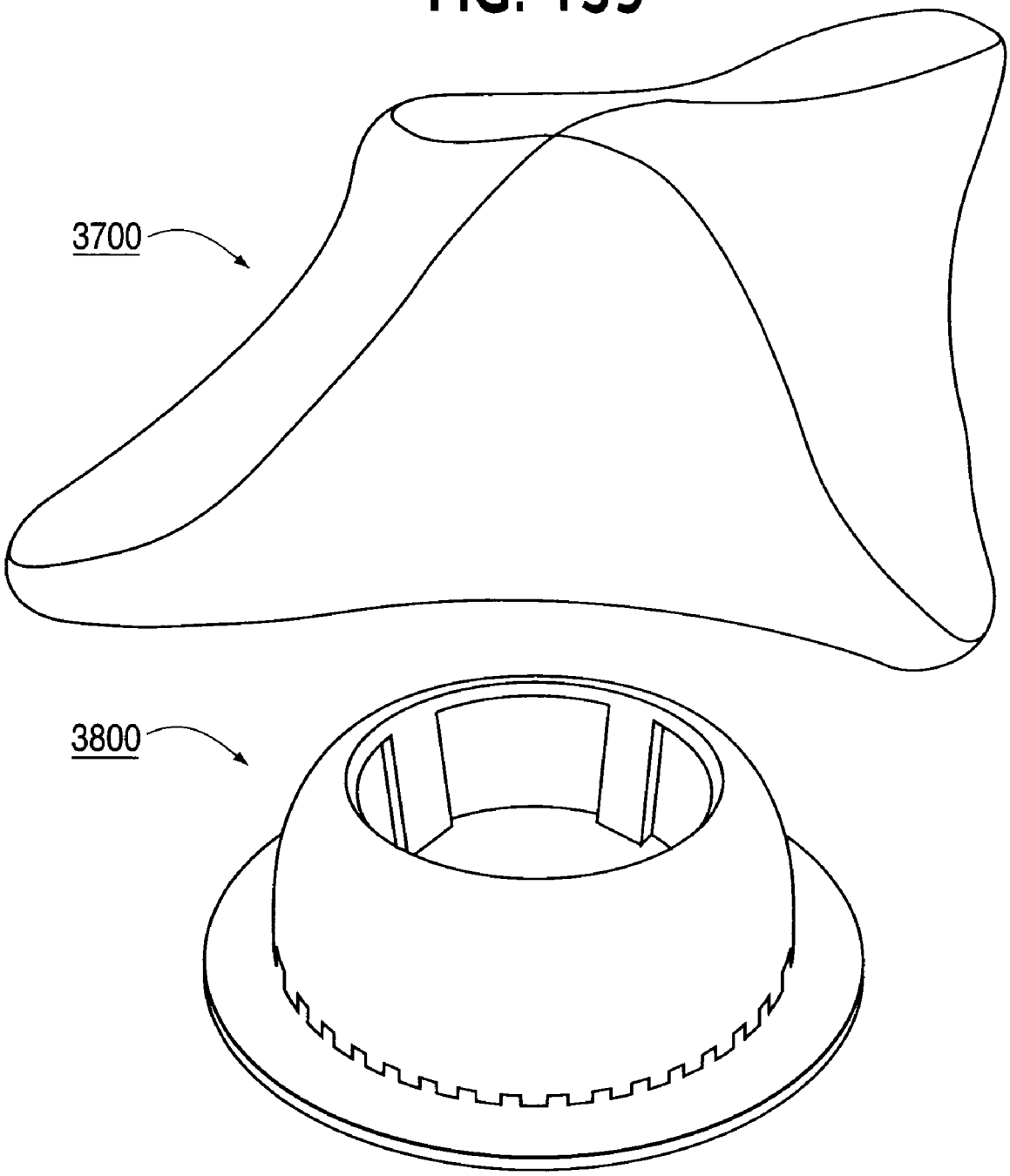
FIG. 159 shows a perspective exploded view of an inlet cover and an air conduit according to another embodiment of the invention.

FIG. 159 shows a perspective exploded view of an inlet cover and an air conduit according to another embodiment of the invention. The inlet cover 3700 can be, for example, a sheet of plastic or polyurethane. Inlet cover 3700 can be coupled to the air conduit 3800 or the hand covering cover 120 (not shown in FIG. 159) by, for example, a glue or heat wrap along a suitable portion of the inlet cover 3700 such as an outer perimeter. A user, for example, can remove inlet cover 3700 by tearing it. For example, the user can tear an interior portion of inlet cover 3700. Alternatively, the user can remove the entire inlet cover 3700. In an alternative embodiment, the inlet cover 3700 can include a perforated portion. The user can tear the inlet cover 3700 along the perforated portion.

Figure 160:
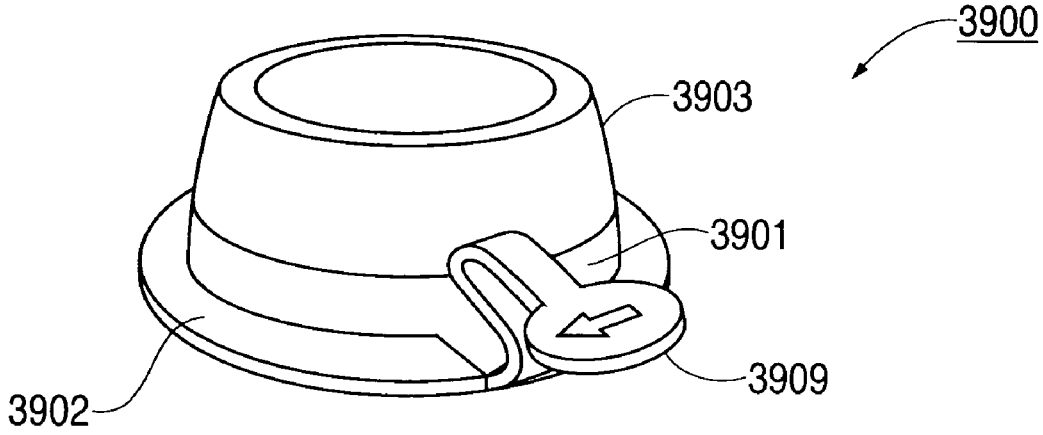
FIGS. 160 and 161 show a perspective view of an inlet cover in an assembled configuration and an intermediate position between the assembled configuration and a disassembled configuration, respectively, according to an embodiment of the invention.
Figure 161:
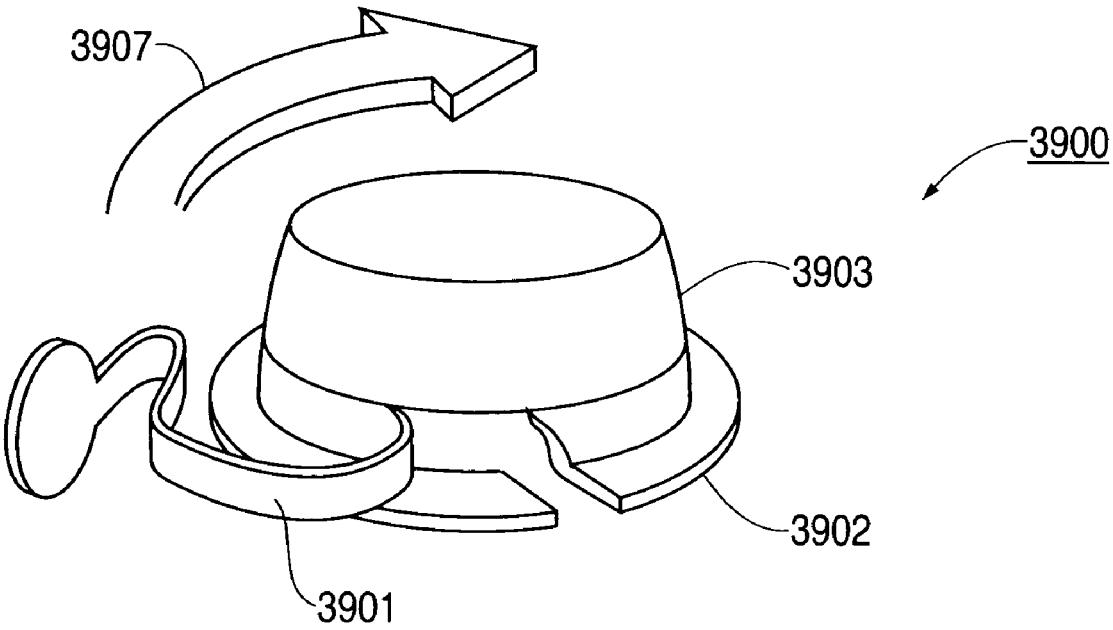

FIGS. 160 and 161 show a perspective view of an inlet cover in an assembled configuration and an intermediate position between the assembled configuration and a disassembled configuration, respectively, according to an embodiment of the invention. The inlet cover 3900 includes central portion 3901, retaining portions 3902 and 3903. Central portion 3901 is disposed between the retaining portions 3902 and 3903, and includes a tab 3909. Central portion 3901 is removably attached to the retaining portions 3902 and 3903.

Retaining portion 3902 is coupled to the air conduit and/or the hand covering cover 120 (not shown in FIGS. 160 and 161). The retaining portion 3902 can be coupled to the air conduit and/or the hand covering cover 120, for example, by glue or any other appropriate type of attachment. Alternatively, the retaining portion 3902 can be coupled to the air conduit for example, by RF welding.

FIG. 160 shows the inlet cover 3900 in the assembled configuration. By pulling the tab 3909 of the central portion 3901 in the direction 3907, the central portion 3901 is permanently separated from retaining portions 3902 and 3903. FIG. 161 shows the inlet cover 3900 in an intermediate position between the assembled configuration and the disassembled configuration. Once the central portion 3901 is separated from retaining portions 3902 and 3903, retaining portion 3903 is separated from retaining portion 3902 thereby exposing the inlet of the air distribution device (not shown in FIGS. 160 and 161). When the retaining portion 3903 is separated from retaining portion 3902, the inlet cover 3900 is in the disassembled configuration.

Figure 162:
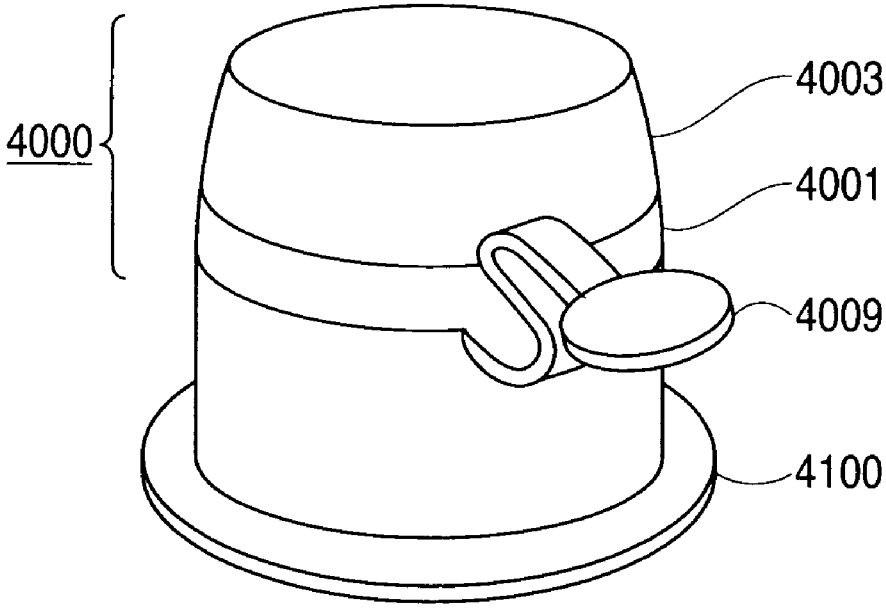
FIG. 162 shows a perspective view of an inlet cover and an air conduit according to an embodiment of the invention.

FIG. 162 shows a perspective view of an inlet cover and an air conduit according to an embodiment of the invention. Inlet cover 4000 includes a central portion 4001 and a retaining portion 4003. Central portion 4001 includes a tab 4009. Central portion 4001 is coupled to the air conduit 4100. Central portion 4001 is removably attached to the retaining portion 4003 and the air conduit 4100.

FIG. 162 shows the inlet cover 4000 in the assembled configuration. By pulling the tab 4009 of the central portion 4001, the central portion 4001 is permanently separated from retaining portions 4003 and the air conduit 4100. Once the central portion 4001 is separated from retaining portions 4003 and air conduit 4100, the inlet of the air distribution device is exposed. When the retaining portion 4003 and central portion 4001 are separated from air conduit 4100, the inlet cover 4000 is in the disassembled configuration.

Figure 163:
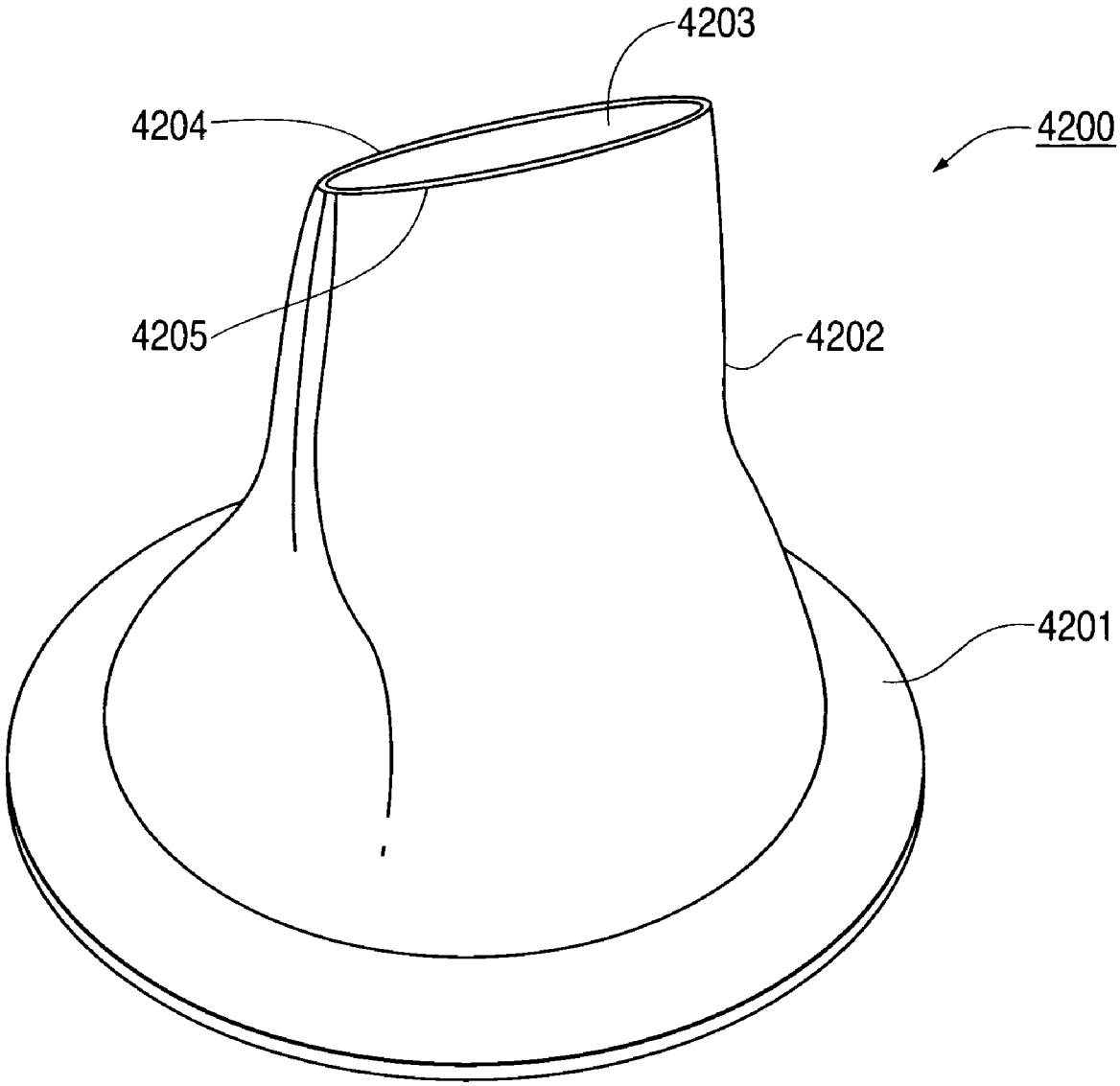
FIGS. 163 and 164 show a perspective view of an inlet of an air conduit in a closed configuration and an open configuration, respectively, according to an embodiment of the invention.
Figure 164:
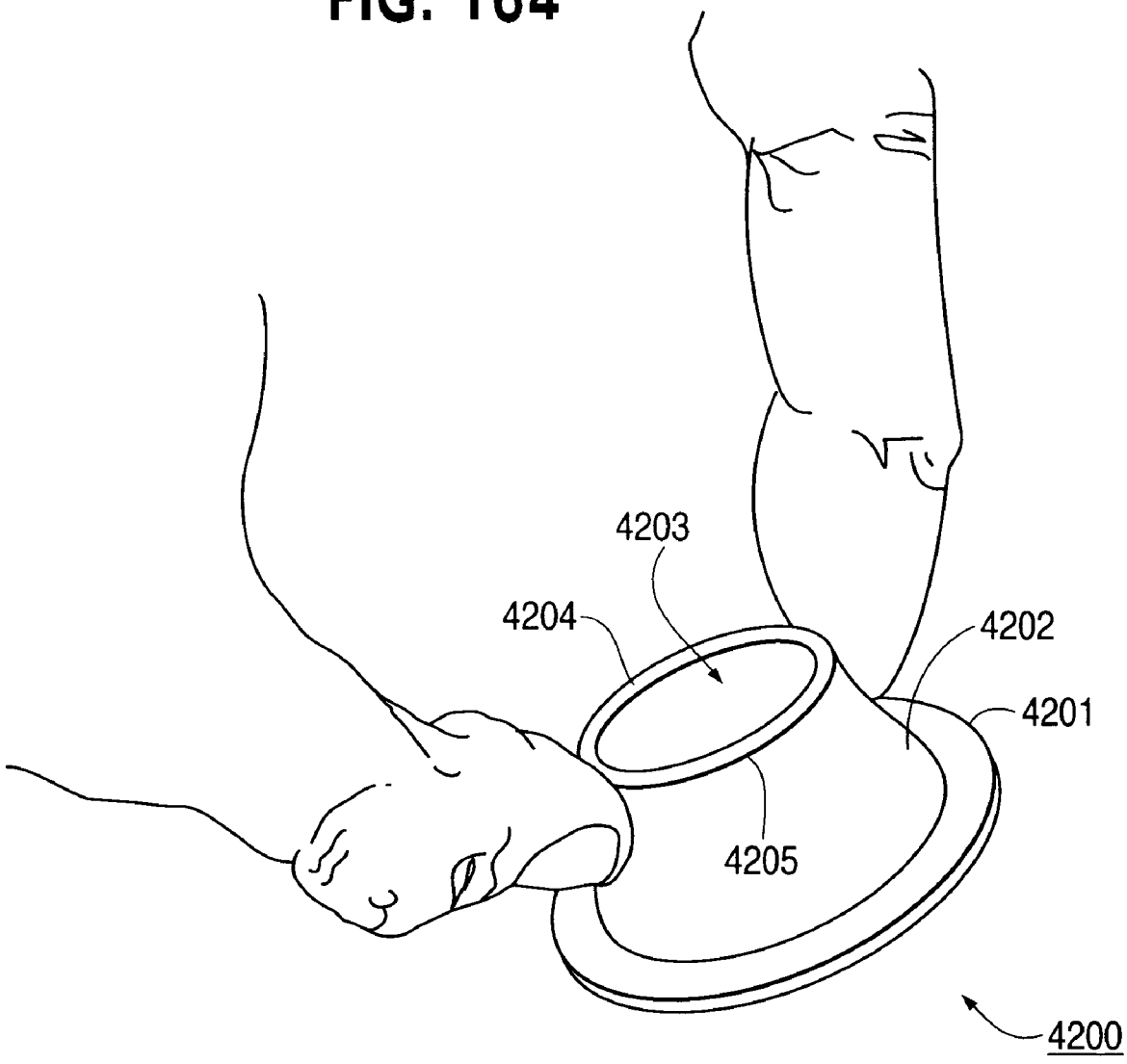

FIGS. 163 and 164 show a perspective view of an inlet of an air conduit in a closed configuration and an open configuration, respectively, according to an embodiment of the invention. The air conduit 4200 includes a base portion; 4201 and a body portion 4202 that defines an opening 4203. The shape of opening 4203 is defined by side portions 4204 and 4205, each of which include a flexible ribbing or a resilient batten that can return to its original shape when no pressure is applied.

More specifically, FIG. 163 shows the air conduit 4200 in a closed configuration. In this closed configuration, the opening 4203 is temporarily reduced or substantially closed. FIG. 164 shows the air conduit 4200 in an open configuration. In this open configuration, a user squeezes the side portions 4204 and 4205 to open temporarily opening 4203. In other words, by placing pressure on the end portions of each side portion 4204 and 4205 to bend these side portions, opening 4203 is expanded. For example, side portions 4204 and 4205 may be squeezed together with a user's fingers (as illustrated in FIG. 164) or with the user's mouth. While opening 4203 is expanded in the open configuration, a user can blow through the opening 4203 so that the air traverses the body portion 4202 and base portion 4201 though air conduit 4200 into the air distribution device.

Figure 165:
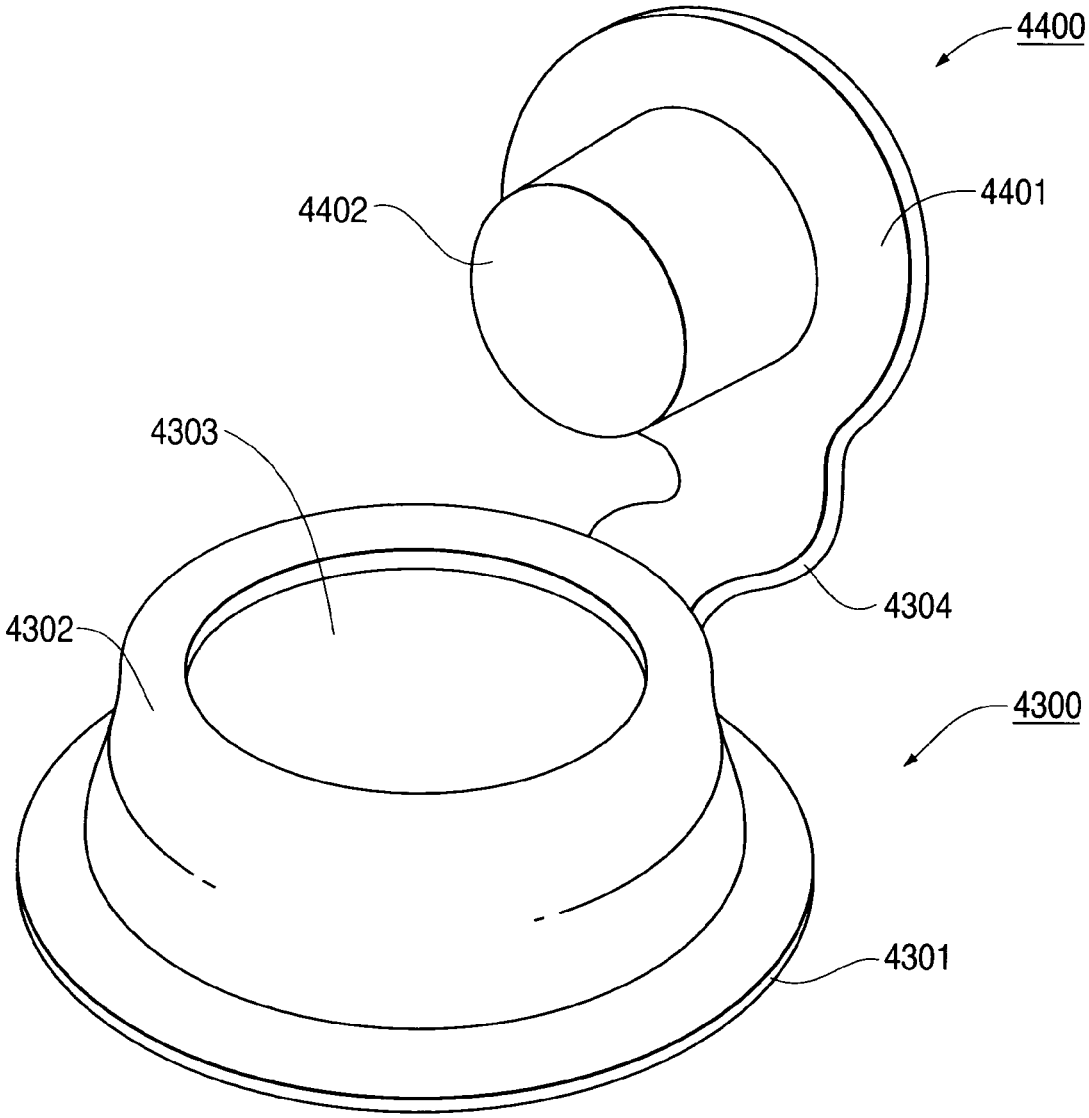
FIG. 165 shows a perspective view of an inlet cover and an air conduit in an open configuration, according to another embodiment of the invention.

FIG. 165 shows a perspective view of an inlet cover and an air conduit in an open configuration, according to another embodiment of the invention. Air conduit 4300 includes a base portion 4301, a protrusion portion 4302 and a connector 4304. The protrusion portion 4302 is substantially non-planar to the base portion 4301, and defines an opening 4303. Inlet cover 4400 includes upper portion 4401 and protrusion portion 4402. Protrusion portion 4402 can be, for example, a plug integrally formed with the upper portion 4401. Inlet cover 4400 can be coupled to air conduit 4300 by connector 4304. In an alternative embodiment, it is not necessary that the inlet cover includes an upper portion.

Protrusion portion 4402 of inlet cover 4400 can be inserted into opening 4303, removed from opening 4303 and reinserted into opening 4303 of air conduit 4300. When protrusion portion 4402 is inserted into opening 4303, the air conduit 4300 is in a closed configuration. A user can remove protrusion portion 4402 and blow through the opening 4303 so that the air traverses the protrusion portion 4302 and base portion 4301 through air conduit 4300 and into the air distribution device.

Figure 166:
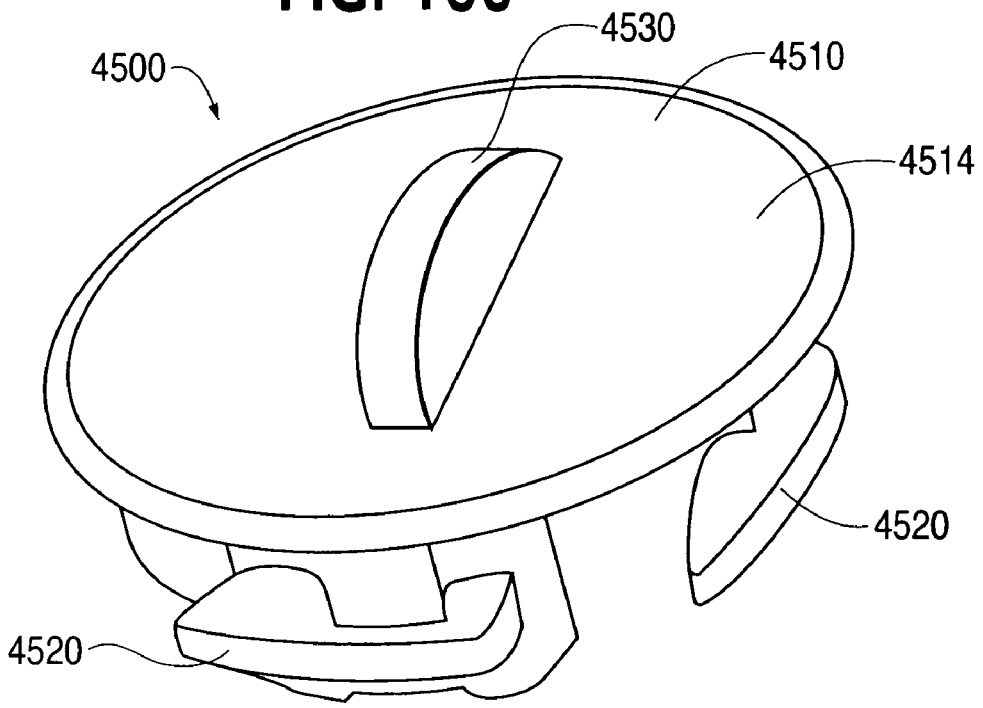
FIGS. 166 through 169 illustrate alternative embodiments of the inlet cover according to the invention.
Figure 167:
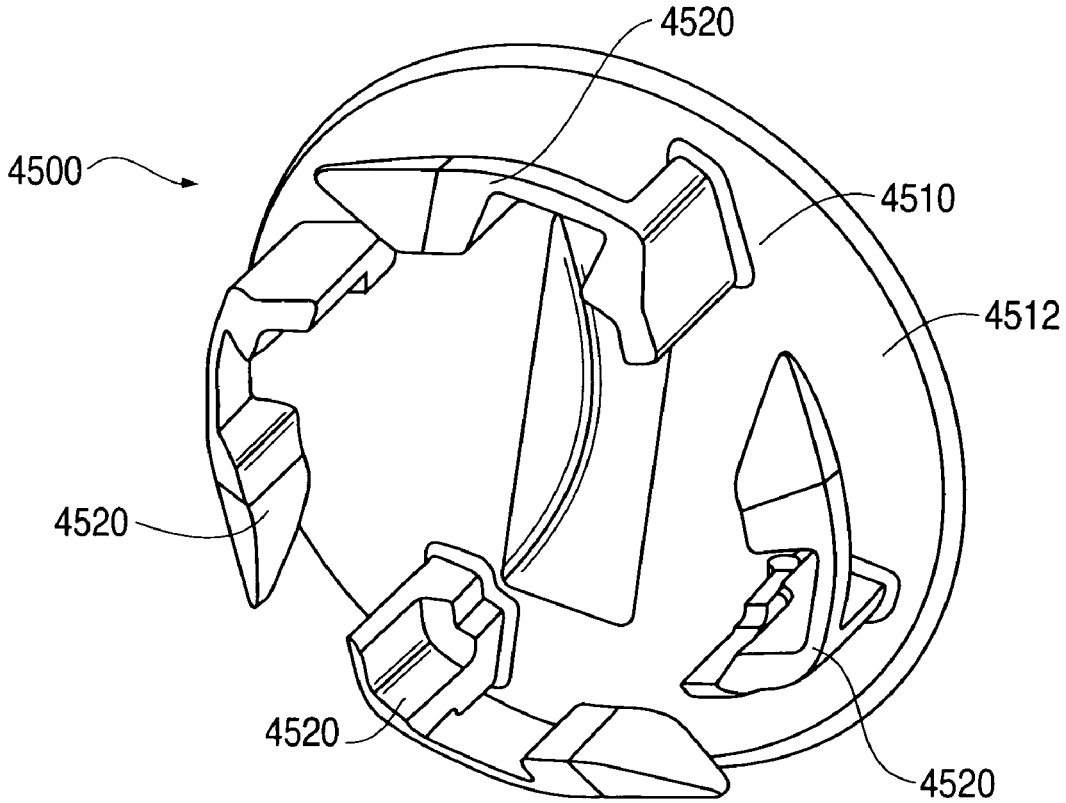

FIGS. 166 through 169 illustrate alternative embodiments of the inlet cover. FIGS. 166 and 167 show an upper perspective view and a lower perspective view of an alternative embodiment of an inlet cover 4500, respectively. The inlet cover 4500 includes an upper portion 4510, coupling members 4520 that protrude from a first side 4512 of the upper portion, and an activation member 4530 that protrudes from a second side 4514 of the upper portion.

The coupling members 4520 are configured to interact with the air conduit (not illustrated) such that the inlet cover 4500 is removably couplable to the air conduit. Thus, the inlet cover may be coupled to the air conduit, removed from the air conduit, and recoupled to the air conduit. To facilitate the coupling of the inlet cover 4500 to the air conduit and the removal of the inlet cover from the air conduit, a user may grasp the inlet cover via the activation member 4530. In the illustrated embodiment, the removal of the inlet cover 4500 from the air conduit includes twisting the inlet cover with respect to the air conduit. In an alternative embodiment, the removal of the inlet cover from the air conduit does not require twisting.

In the illustrated embodiment, the inlet cover 4500 is configured to be removably coupled to the air conduit. In alternative configurations, the inlet cover is configured to be removably coupled to other portions of the hand covering, such as the glove or the air distribution device.

In the illustrated embodiment, the inlet cover 4500 includes four coupling members 04520. It is not, however, necessary that the inlet cover include four coupling members. For example, in alternative embodiments, the inlet cover includes 1, 2, 3, 5, or any other number of coupling members.

Figure 168:
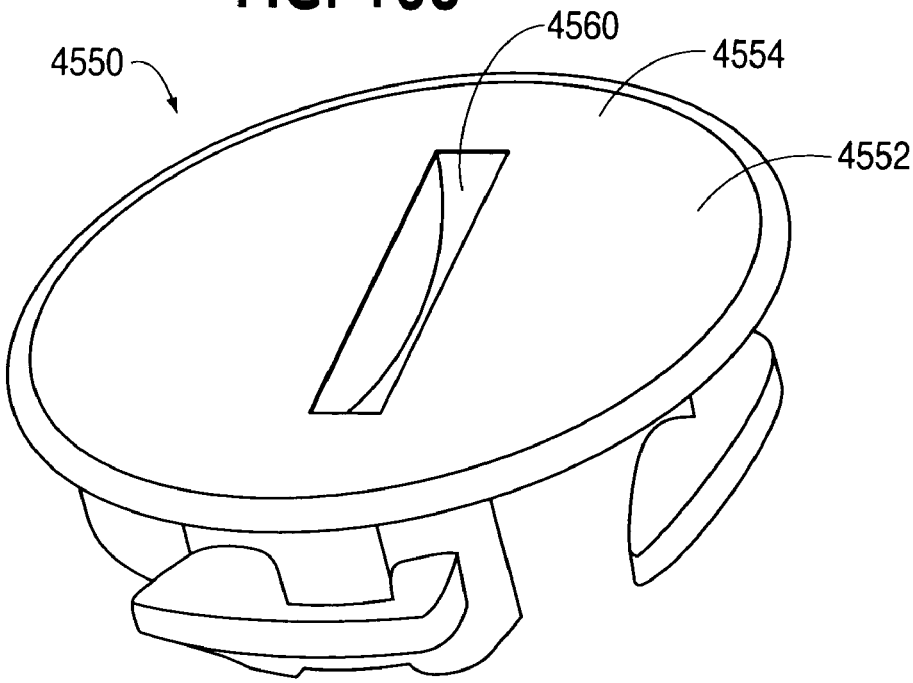
Figure 169:
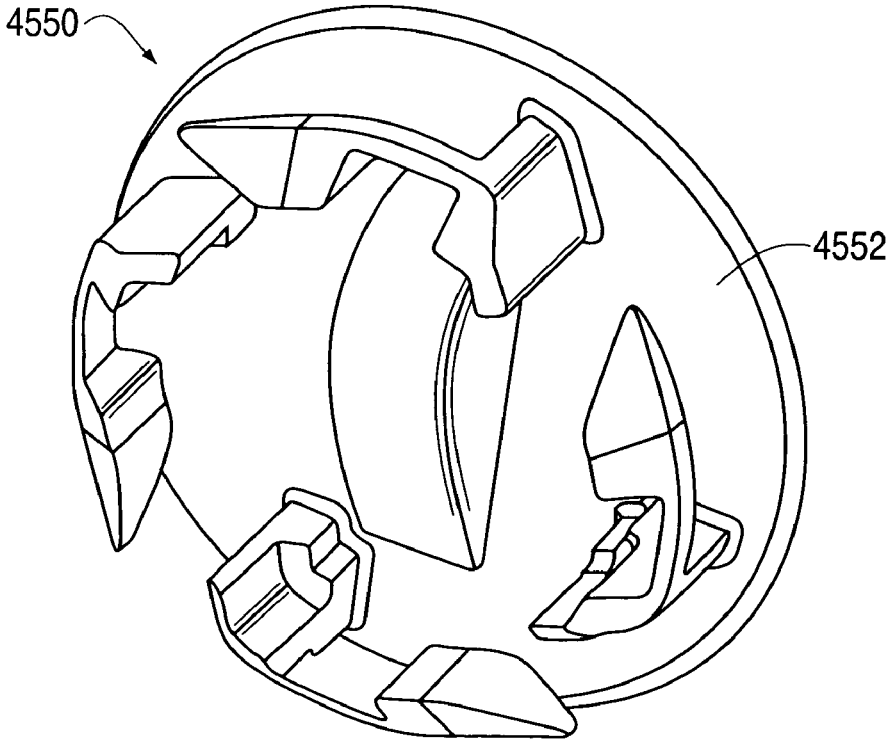

Another alternative embodiment of the inlet cover is illustrated in FIGS. 168 and 169. In this embodiment, an inlet cover 4550 includes a groove 4560 in one side 4554 of an upper portion 4552. To facilitate the coupling of the inlet cover 4550 to the air conduit and the removal of the inlet cover from the air conduit, the user may insert an item, such as a fingernail or a coin, into the groove 4560. The inlet cover can then be twisted with respect to the air conduit and removed from the air conduit.

Figure 170:
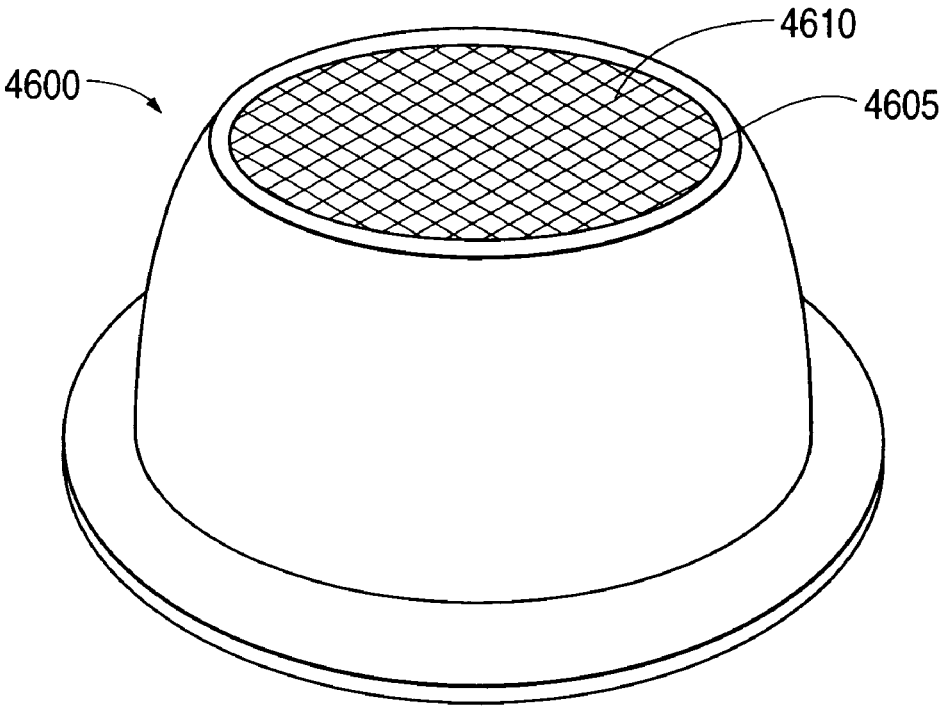
FIGS. 170 through 173 illustrate alternative embodiments of the air conduit according to the invention.

FIGS. 170 through 173 illustrate alternative embodiments of an air conduit. FIG. 170 illustrates an air conduit 4600 having a mesh portion 4610 that covers the opening 4605 of the air conduit. The mesh portion 4610 allows air to freely pass through the opening of the air conduit, yet prevents some debris from passing through the opening of the air conduit. In one embodiment, the mesh portion is made of nylon. In further embodiments, the mesh portion is made of aluminum or any other material that would provide a mesh type structure to keep some debris from entering the opening of the air conduit.

Figure 171:
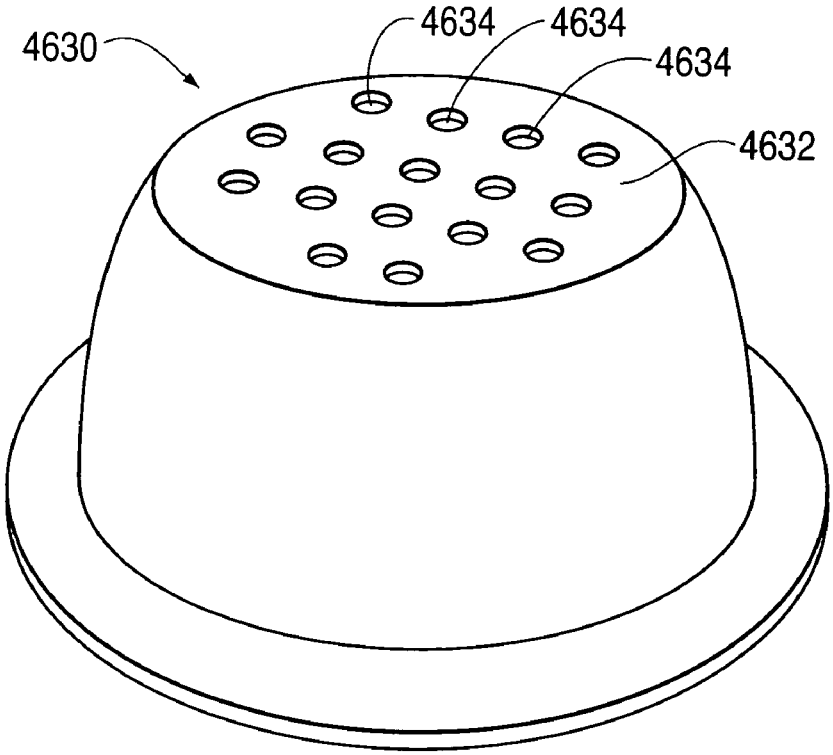
Figure 172:
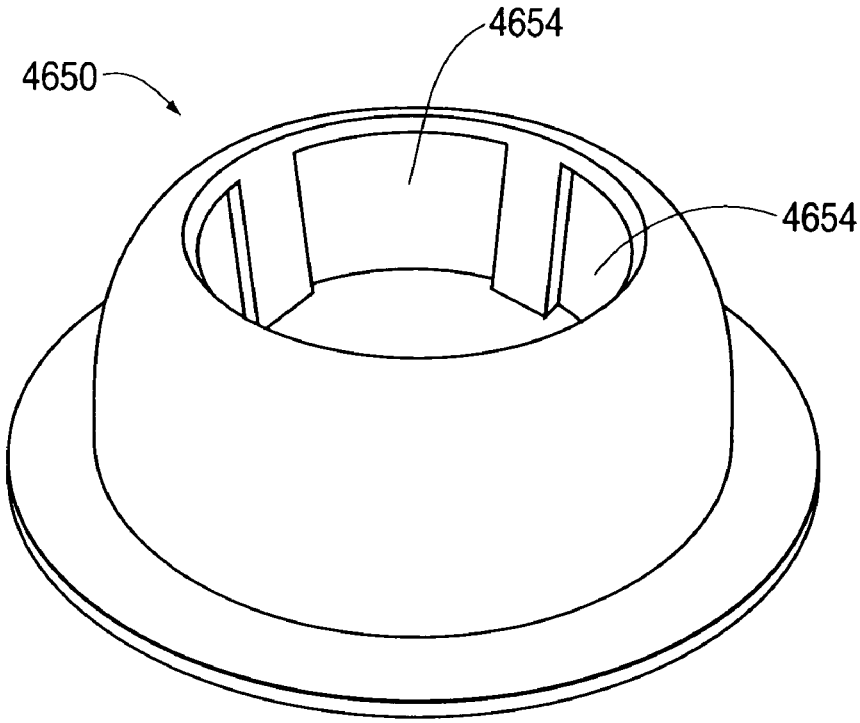
Figure 173:
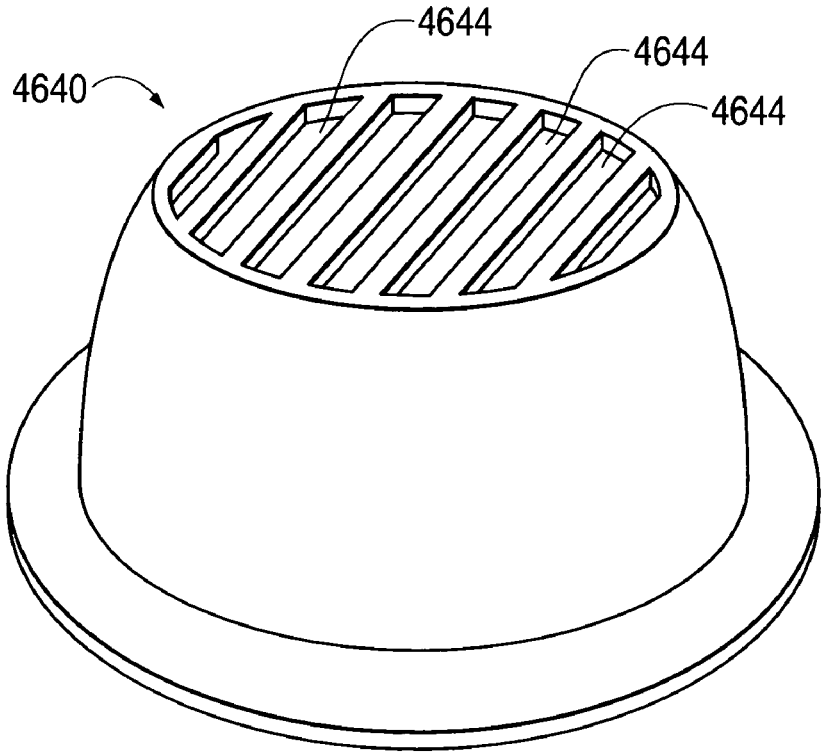

FIG. 171 illustrates an air conduit 4630 that has a cover portion 4632 having several openings 4634. The openings 4634 allow air to freely pass through the air conduit 4630, yet prevent some debris from entering into the air conduit. In the illustrated embodiment, the openings are circular. As illustrated in FIG. 173, in an alternative embodiment, the air conduit 4640 includes elongated openings 4644. In further embodiments, the openings are of different shapes, such rectangles, triangles or other polygons. As illustrated in FIG. 172, in an alternative embodiment, the air conduit 4650 includes openings 4654 that are oriented vertically.

FIGS. 174 through 209 illustrate alternative embodiments of the air distribution device. The illustrated embodiments include channeling members of varying shapes and sizes and outlets of varying sizes and shapes. Although only a single channeling member is shown for each embodiment, it should be understood that the air distribution device may include more than one channeling member. Additionally, for simplicity purposes, only one end of the channeling members is illustrated. However, it should be understood that the air distribution devices also include at least a second end and an air inlet (not shown in FIGS. 174–209).

Two figures illustrate each of the embodiments shown in FIGS. 174 through 209. One of the figures for each embodiment is a side view of the air distribution device shown in relation to a hand of a user. For discussion purposes, the illustrated embodiments of the air distribution device show the hand of a user in direct contact with the air distribution device. It should be understood, however, that the air distribution device is configured to be used with a hand covering and may not be in direct contact with the hand of a user. The other figure is a top view of the illustrated portion of the air distribution device.

Figure 174:
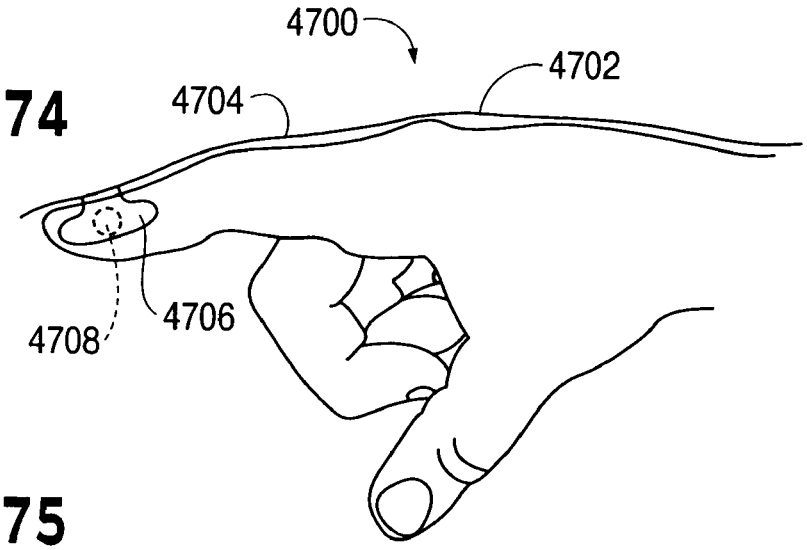
FIGS. 174 through 209 illustrate alternative embodiments of the air distribution device according to the invention.
Figure 175:
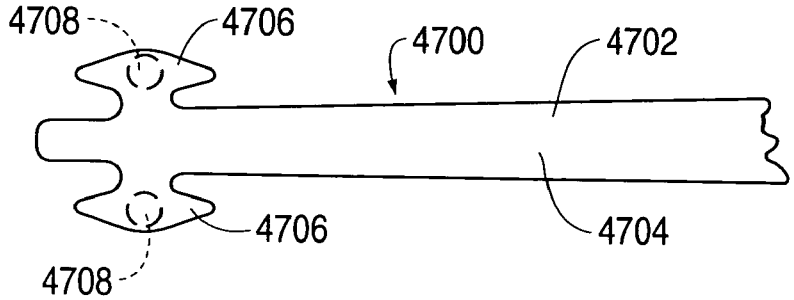

FIGS. 174 and 175 illustrate an air distribution device 4700 that includes a channeling member 4702. The channeling member 4702 has an elongated top portion 4704 and a pair of "half-moon" shaped side portions 4706. Each of the side portions 4706 includes a circular outlet 4708 located proximate its end.

Figure 176:
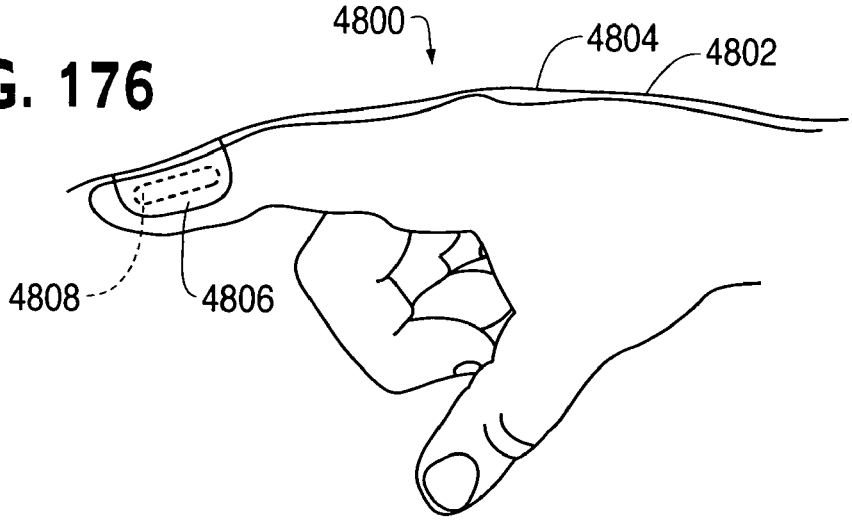
Figure 177:
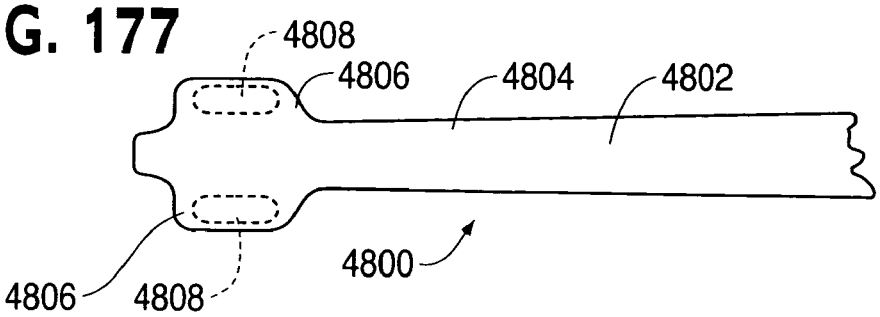

FIGS. 176 and 177 illustrate an air distribution device 4800 that includes a channeling member 4802. The channeling member 4802 has an elongated top portion 4804 and a pair of rectangular-like side portions 4806. Each of the side portions 4806 includes an elongated outlet 4808. The elongated outlets 4808 allow the air exiting the outlets to exit proximate a large portion of the finger of a user.

Figure 178:
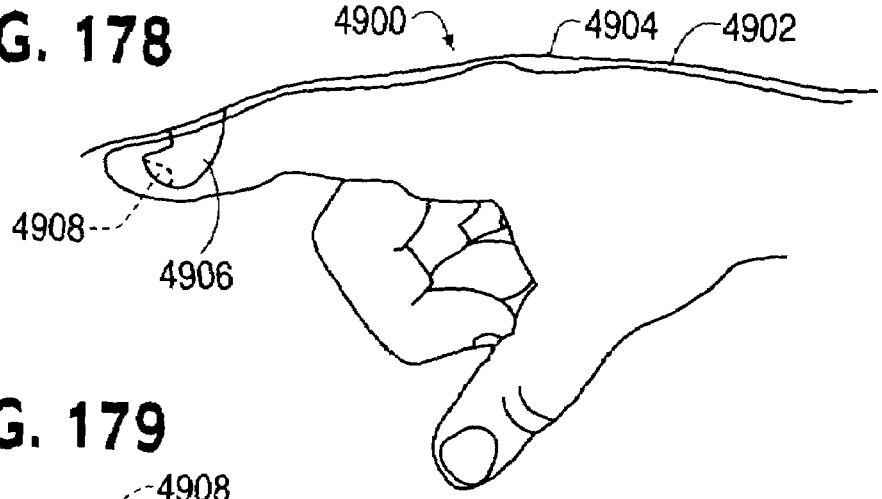
Figure 179:
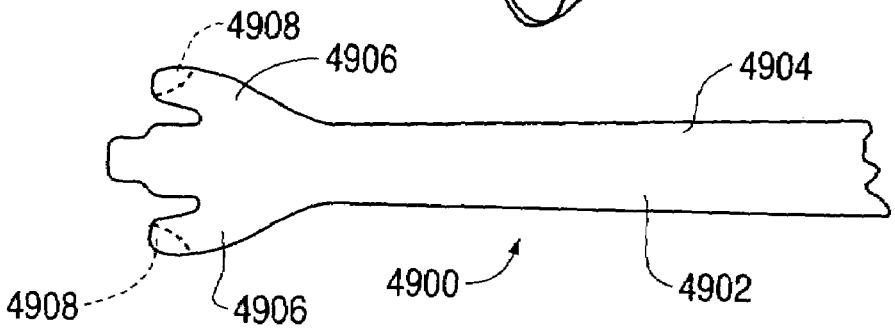

FIGS. 178 and 179 illustrate an air distribution device 4900 that includes a channeling member 4902. The channeling member 4902 has an elongated top portion 4904 and a pair of elongated side portions 4906. Each of the side portions 4906 includes an outlet 4908 located at its end . Thus, the air that exits the outlets 4908 is directed toward the tip of the user's finger.

Figure 180:
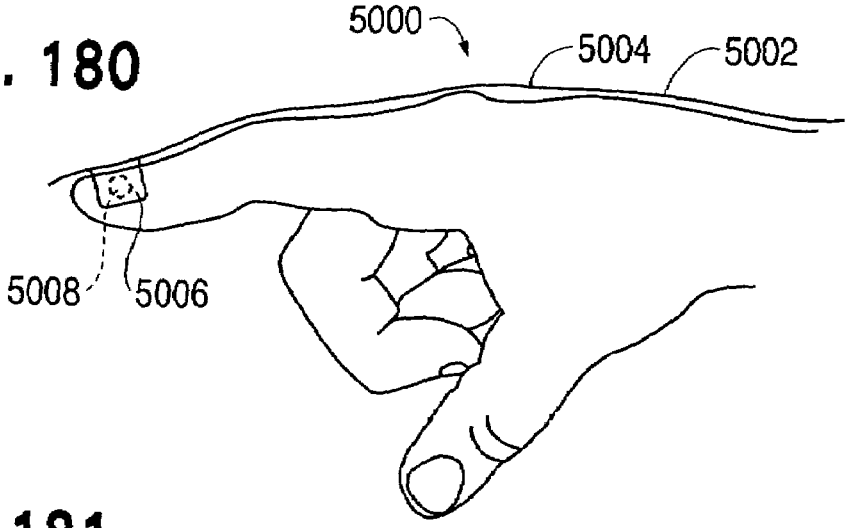
Figure 181:
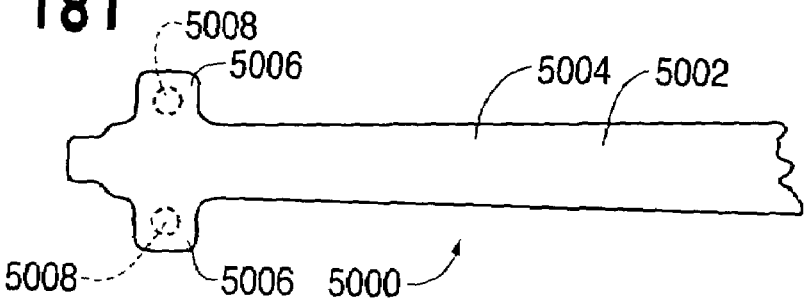

FIGS. 180 and 181 illustrate an air distribution device 5000 that includes a channeling member 5002. The channeling member 5002 has an elongated top portion 5004 and a pair of square side portions 5006. Each of the side portions 5006 includes a circular outlet 5008 located proximate its end.

Figure 182:
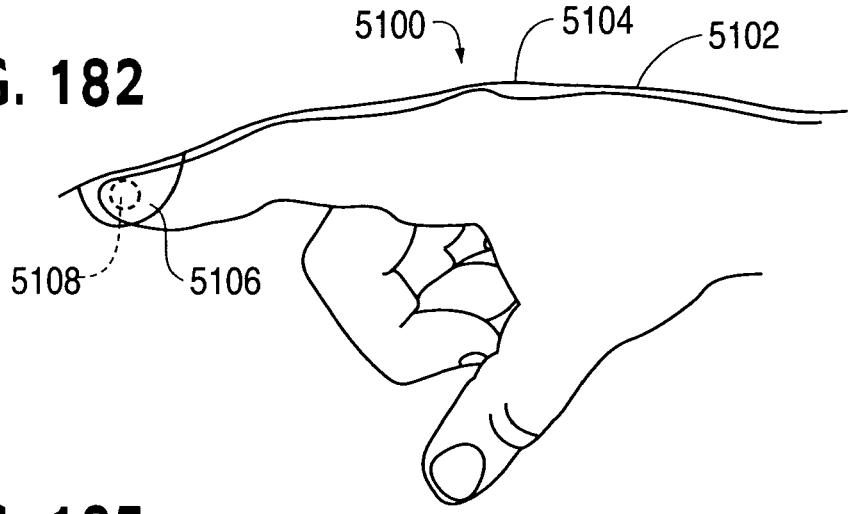
Figure 183:
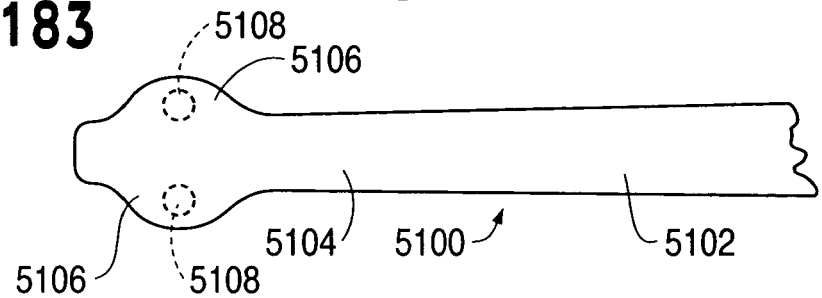

FIGS. 182 and 183 illustrate an air distribution device 5100 that includes a channeling member 5102. The channeling member 5102 has an elongated top portion 5104 and a pair of rounded side portions 5106. Each of the side portions 5106 includes a circular outlet 5108.

Figure 184:
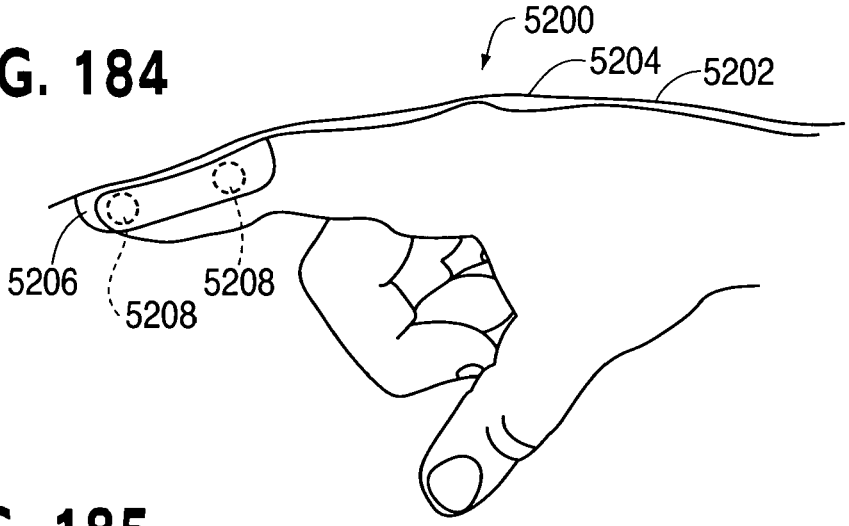
Figure 185:
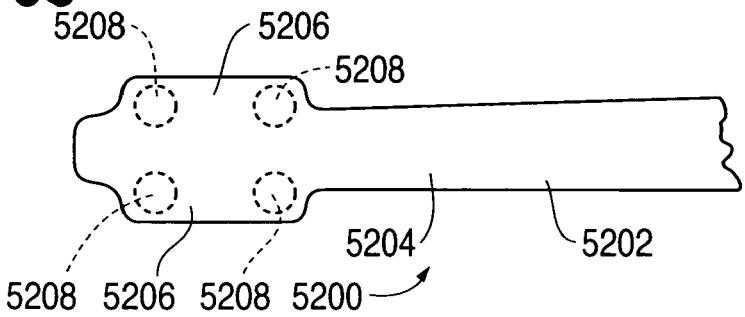

FIGS. 184 and 185 illustrate an air distribution device 5200 that includes a channeling member 5202. The channeling member 5202 has an elongated top portion 5204 and a pair of elongated side portions 5206. Each of the side portions 5206 includes two circular outlets 5208. Thus, the air that exits the distribution device 5200 exits proximate different portions of the user's finger.

Figure 186:
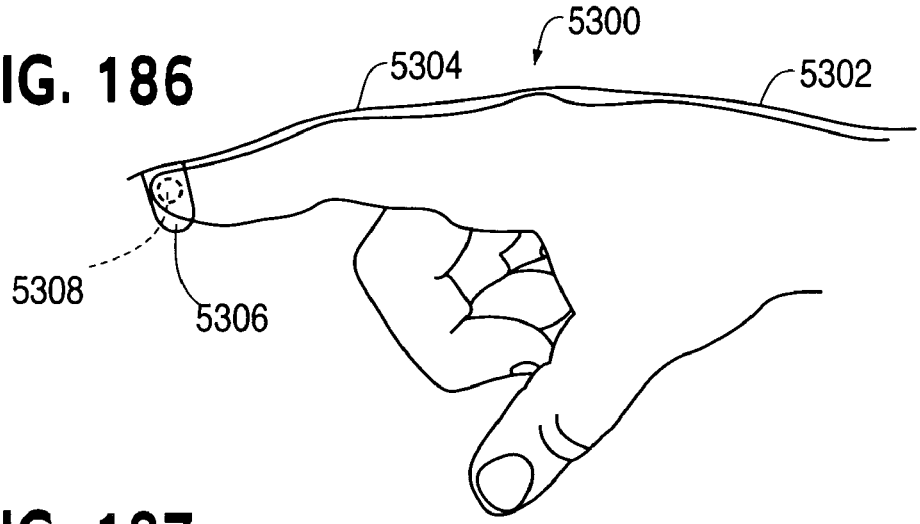
Figure 187:
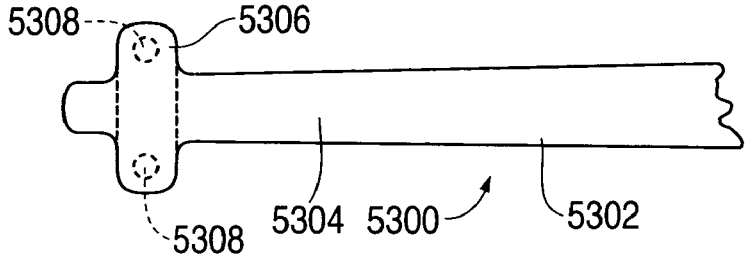

FIGS. 186 and 187 illustrate an air distribution device 5300 that includes a channeling member 5302. The channeling member 5302 has an elongated top portion 5304 and a ring portion 5306 located near one end of the channeling member. The ring portion 5306 is configured so as to fit around the tip of a user's finger. Additionally, the ring portion 5306 includes two circular outlets 5308 located along the circumference of the ring portion.

Figure 188:
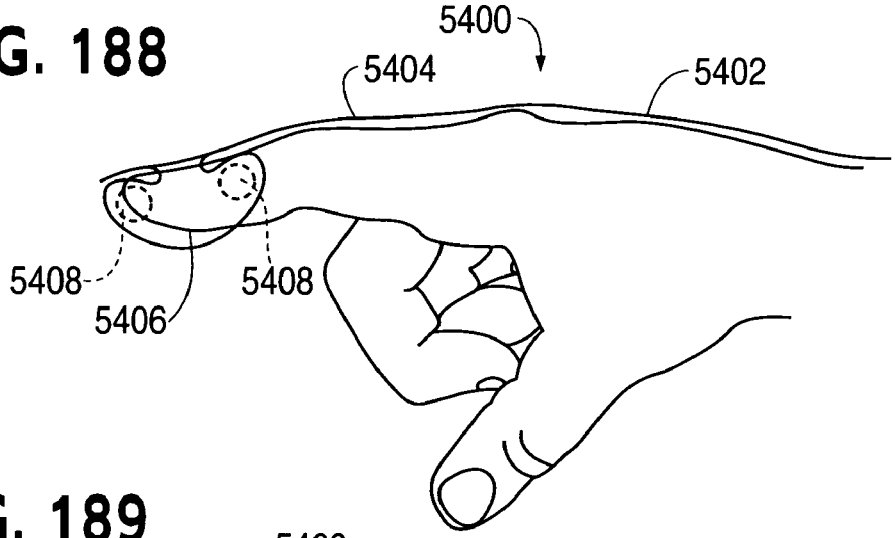
Figure 189:
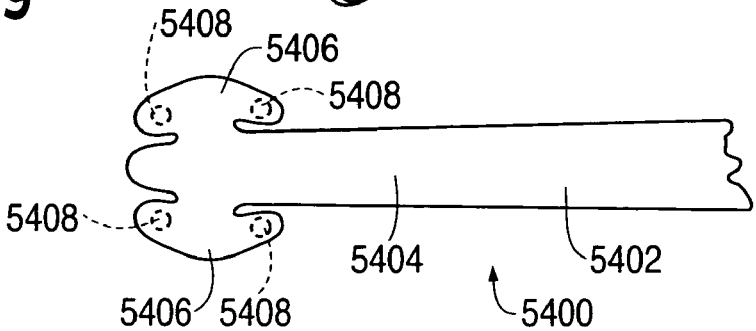

FIGS. 188 and 189 illustrate an air distribution device 5400 that includes a channeling member 5402. The channeling member 5402 has an elongated top portion 5404 and a pair of "half-moon" shaped side portions 5406. Each of the side portions 5406 includes two circular outlets 5408. Thus, the air that exits the distribution device 5400 exits proximate different portions of the user's finger.

Figure 190:
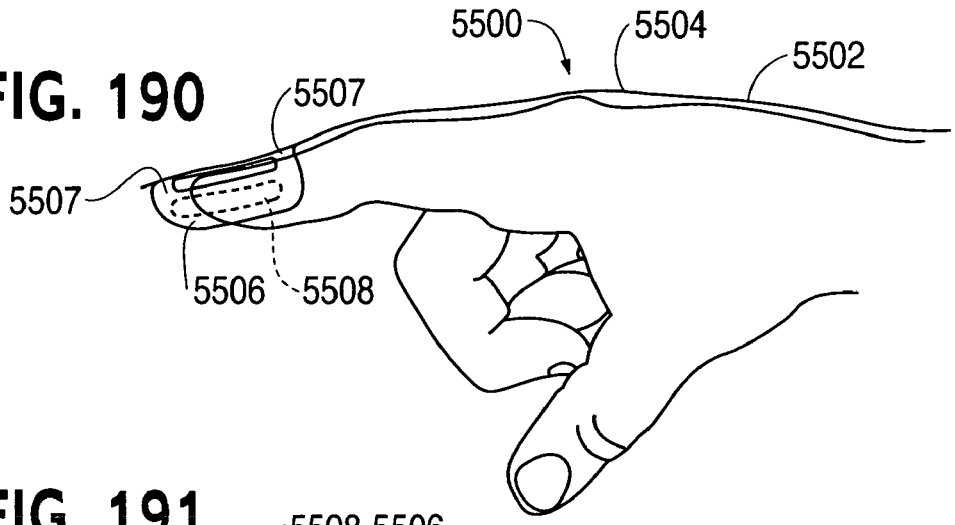
Figure 191:
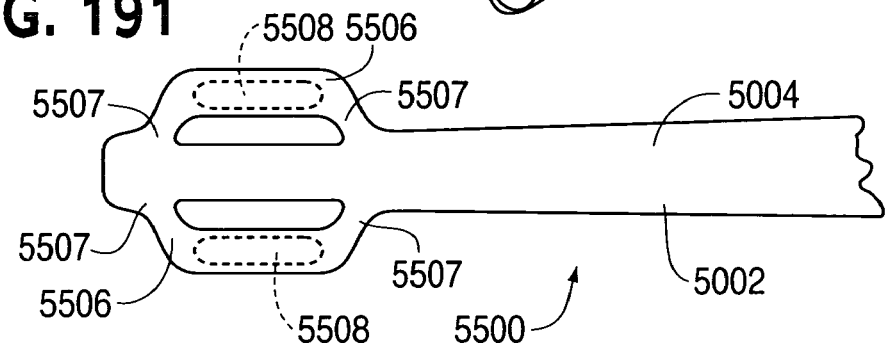

FIGS. 190 and 191 illustrate an air distribution device 5500 that includes a channeling member 5502. The channeling member 5502 has an elongated top portion 5504 and a pair of elongated side portions 5506. Each of the side portions 5506 is connected to the top portion via a pair of channels 5507. The different channels 5507 provide additional paths for air to travel through the air distribution device 5500. Additionally, each of the side portions 5506 includes an elongated outlet 5508. The elongated outlets 5508 allow the air exiting the outlets to exit proximate a large portion of the finger of a user.

Figure 192:
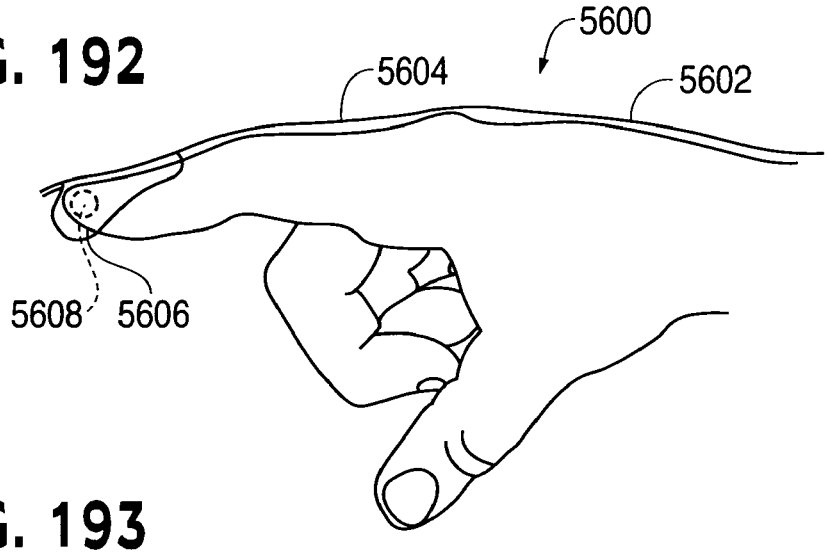
Figure 193:
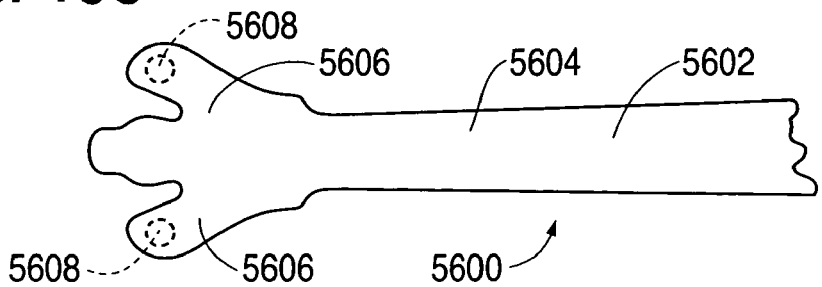

FIGS. 192 and 193 illustrate an air distribution device 5600 that includes a channeling member 5602. The channeling member 5602 has an elongated top portion 5604 and a pair of elongated side portions 5606. Each of the side portions 5606 includes a circular outlet 5608 located proximate its end. The elongated side portions 5606 extend in a semi-fashion with respect to the top portion 5604. Thus, the air that passes through the air distribution device 5600 can easily exit though the outlets 5608.

Figure 194:
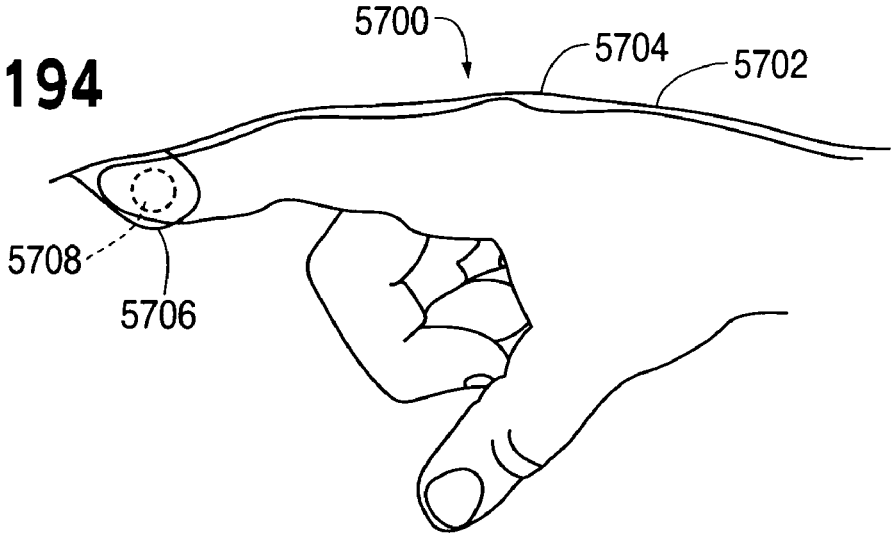
Figure 195:
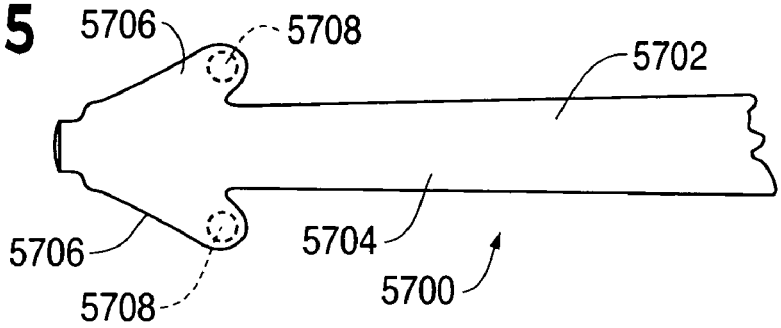

FIGS. 194 and 195 illustrate an air distribution device 5700 that includes a channeling member 5702. The channeling member 5702 has an elongated top portion 5704 and a pair of side portions 5706. Each of the side portions includes a circular outlet 5708 located proximate its end.

Figure 196:
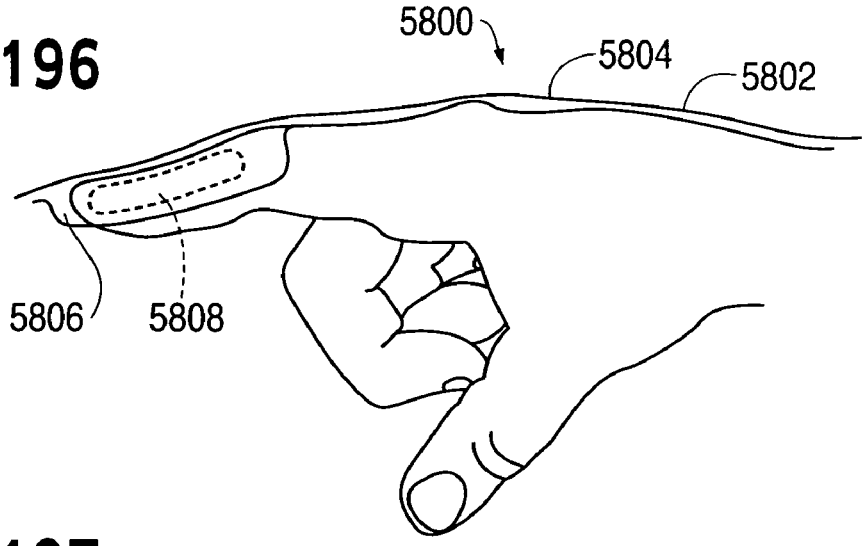
Figure 197:
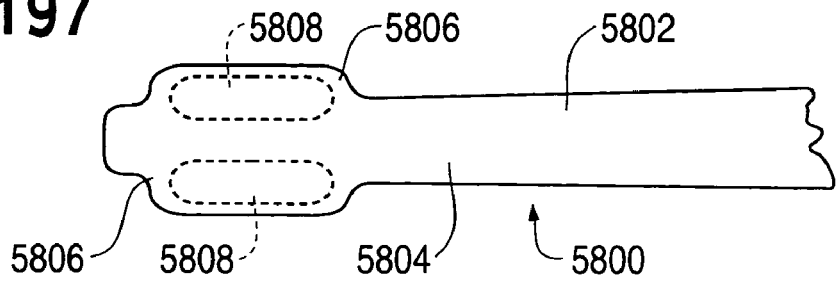

FIGS. 196 and 197 illustrate an air distribution device 5800 that includes a channeling member 5802. The channeling member 5802 has an elongated top portion 5804 and a pair of elongated side portions 5806 that extend parallel to the top portion. Each of the side portions 5806 includes an elongated outlet 5808. The elongated outlets 5808 allow the air that travels though the air distribution device 5800 to exit proximate to a large area of a user's finger.

Figure 198:
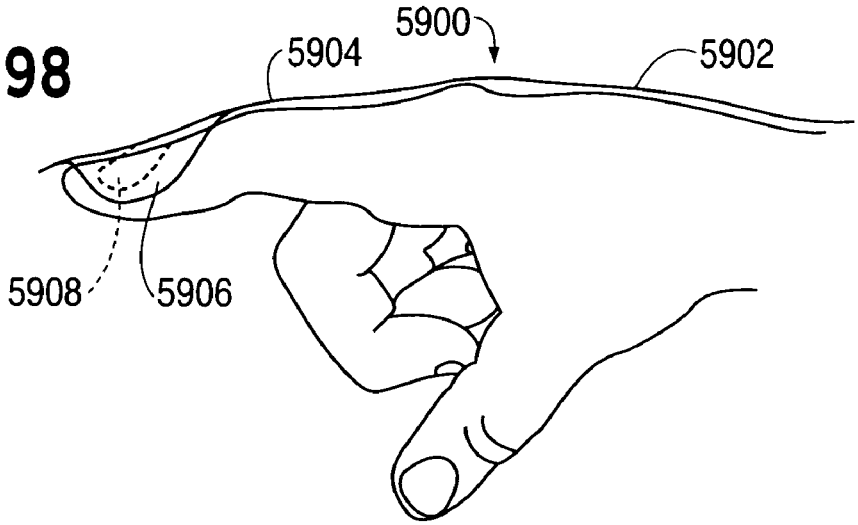
Figure 199:
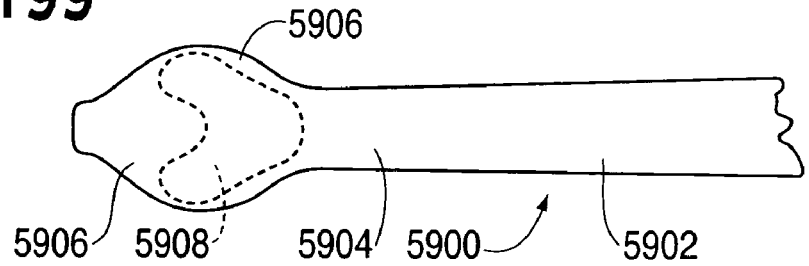
Figure 200:
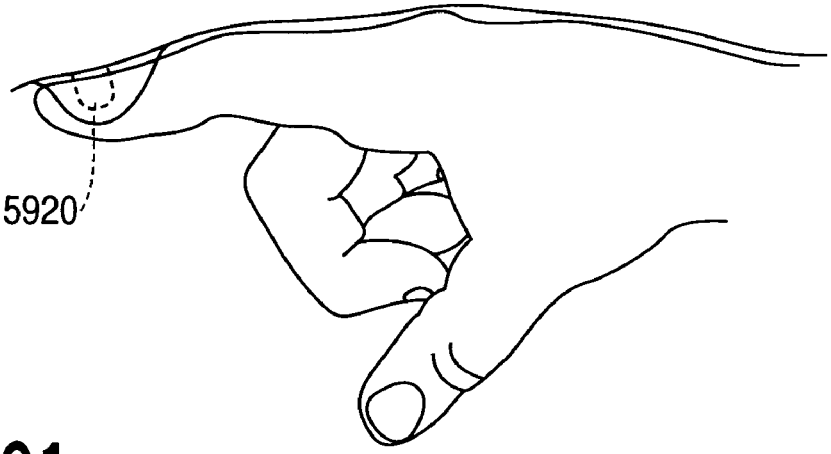
Figure 201:
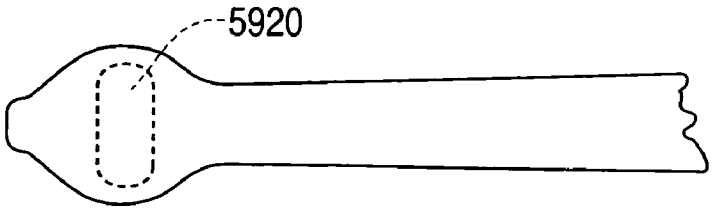

FIGS. 198 and 199 illustrate an air distribution device 5900 that includes a channeling member 5902. The channeling member 5902 has an elongated top portion 5904 and a pair of rounded side portions 5906. The air distribution device 5900 also includes a "V" shaped outlet 5908 that extends from one side portion to the other side portion. The "V" shaped outlet 5908 allows the air that travels though the air distribution device 5900 to exit proximate the top of the finger of a user as well as proximate both sides of the finger of a user.

In an alternative embodiment (illustrated in FIGS. 200 and 201), the air distribution device includes a linear outlet 5920 that extends from one side portion to the other side portion. The linear outlet 5920 allows the air that travels though the air distribution device to exit proximate the top of the finger of a user as well as proximate both sides of the finger of a user.

Figure 202:
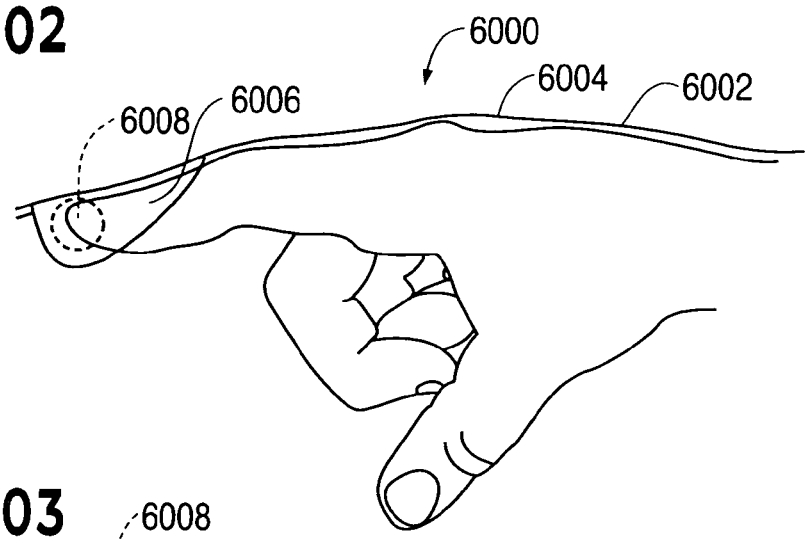
Figure 203:
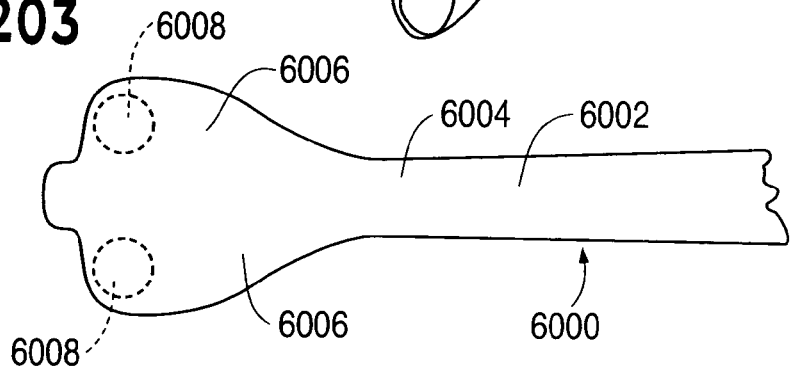

FIGS. 202 and 203 illustrate an air distribution device 6000 that includes a channeling member 6002. The channeling member 6002 has an elongated top portion 6004 and a pair of side portions 6006. Each of the side portions 6006 includes a circular outlet 6008.

Figure 204:
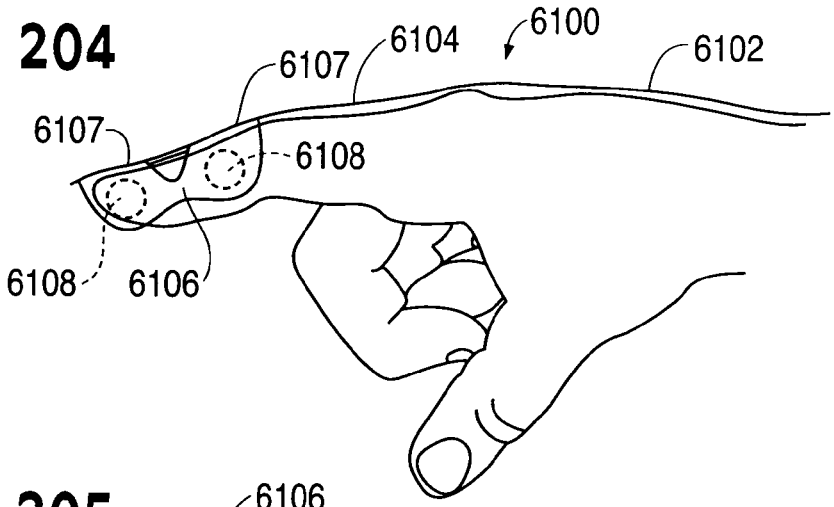
Figure 205:
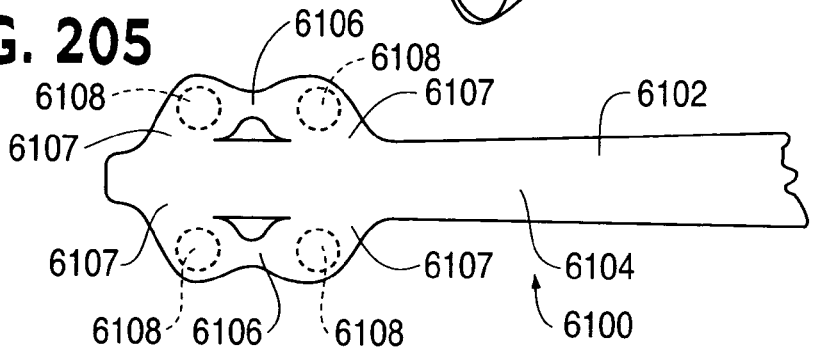

FIGS. 204 and 205 illustrate an air distribution device 6100 that includes a channeling member 6102. The channeling member 6102 has an elongated top portion 6104 and a pair of side portions 6106. Each of the side portions 6106 are connected to the top portion via a pair of channels 6107. The two channels 6107 provide additional paths for air to travel through the air distribution device 6100. Each of the side portions 6106 includes two outlets 6108. Thus, the air that exits the distribution device 6100 exits proximate different portions of the user's finger.

Figure 206:
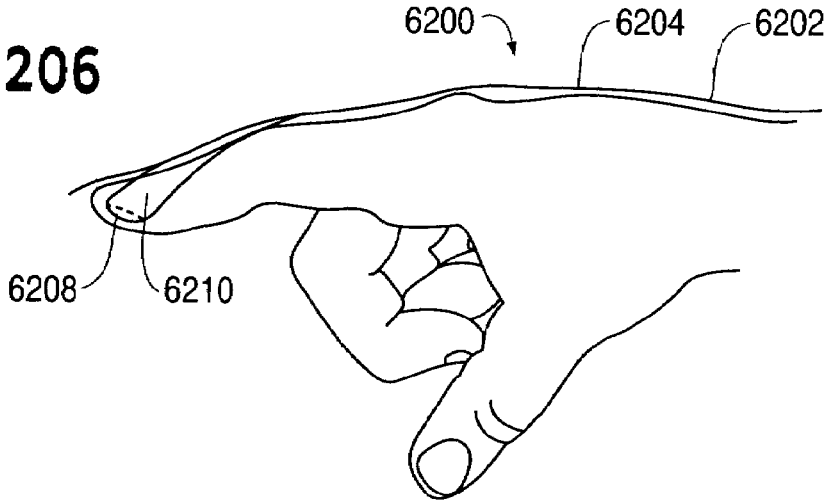
Figure 207:
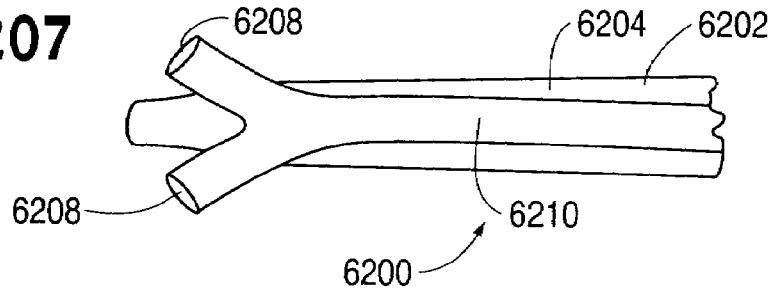

FIGS. 206 and 207 illustrate an air distribution device 6200 that includes a channeling member 6202. The channeling member 6202 has an elongated top portion 6204 and a "Y" shaped tubular member 6210. The air distribution device 6200 also includes two outlets 6208 located at the distal ends of the tubular member 6210. The tubular member 6210 is configured to extend around and along the side of the finger of a user. The outlets 6208 are configured to direct the air that exists the air distribution device toward the tip of the user's finger.

Figure 208:
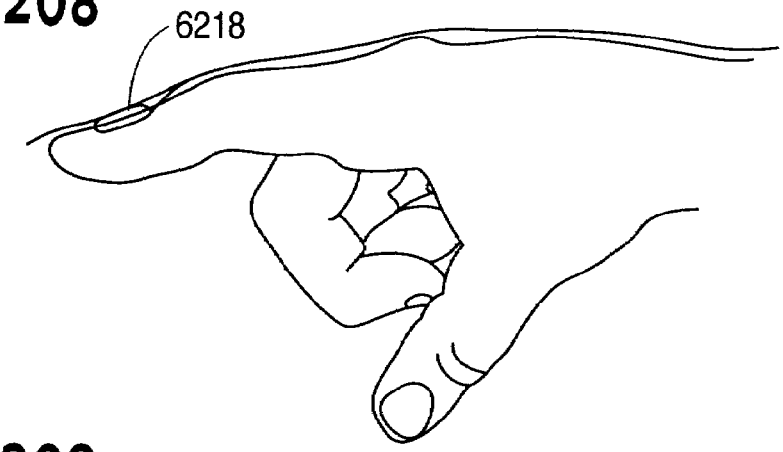
Figure 209:
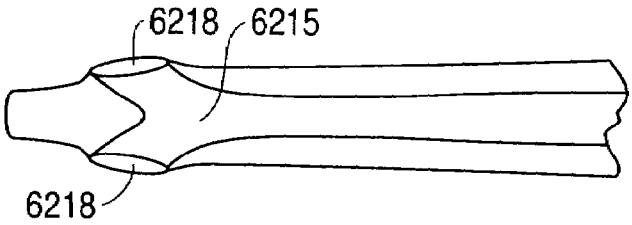

An alternative embodiment is illustrated in FIGS. 208 and 209. In this embodiment the tubular member 6215 is not configured to extend along the sides of the user's finger, rather the tubular member is configured to extend across the top of the user's finger. The outlets 6218 are configured to direct the air that passes through the air distribution device toward the sides of the user's finger.

Figure 210:
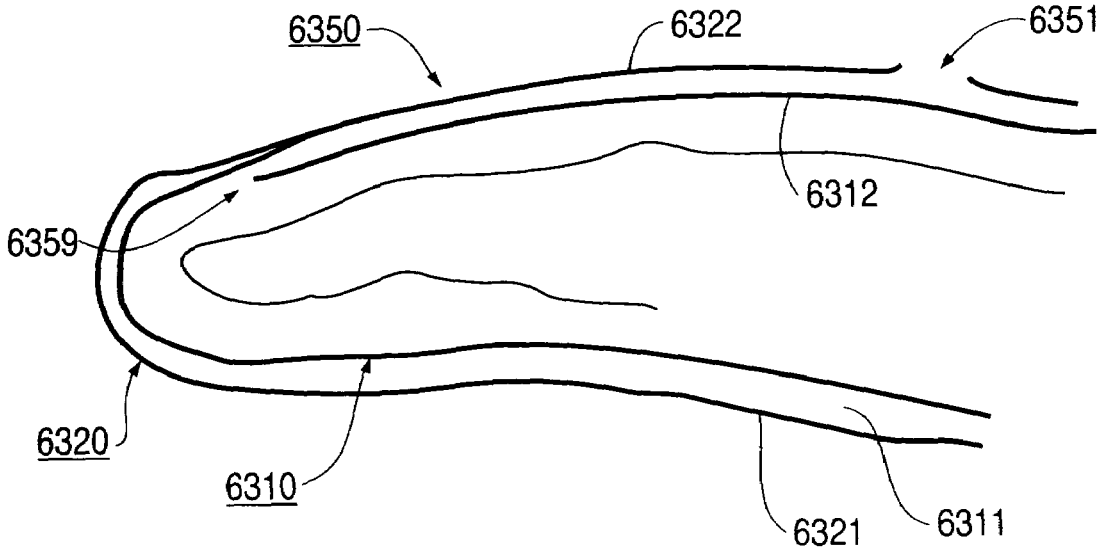

FIG. 210 depicts a partial cross sectional view of another embodiment of the invention along the line A—A of FIG. 3. As shown in FIG. 210, the hand-receiving portion 6310 includes a lower portion 6311 and an upper portion 6312. Cover 6320 includes a lower portion 6321 and an upper portion 6322.

The cover upper portion 6322 and upper hand-receiving portion 6312 collectively define air-distribution device 6350 having an inlet 6351 and outlets 6359 (one of which is shown in FIG. 210). The cover upper portion 6322 includes the inlet 6351. The outlets 6359 are defined between lower hand-receiving portion 6311 and upper hand-receiving portion 6312. In an alternative embodiment, an outlet can be defined between a cover upper portion and an upper hand-receiving portion. The air-distribution device 6350 can define channels each associated with a finger or thumb of a user's hand. For example, the air-distribution device 6350 can have a shape similar to that shown in reference to air-distribution device 550 shown in FIG. 9. In addition, the cover upper portion 6322 and the upper hand-receiving portion 6312 can be coupled with seams. For example, such seams can include those on opposite sides of each channel of the air-distribution device 6350. In addition, the lower hand-receiving portion 6311 is coupled to cover upper portion 6322 thereby defining inlet 6359.

Figure 211:
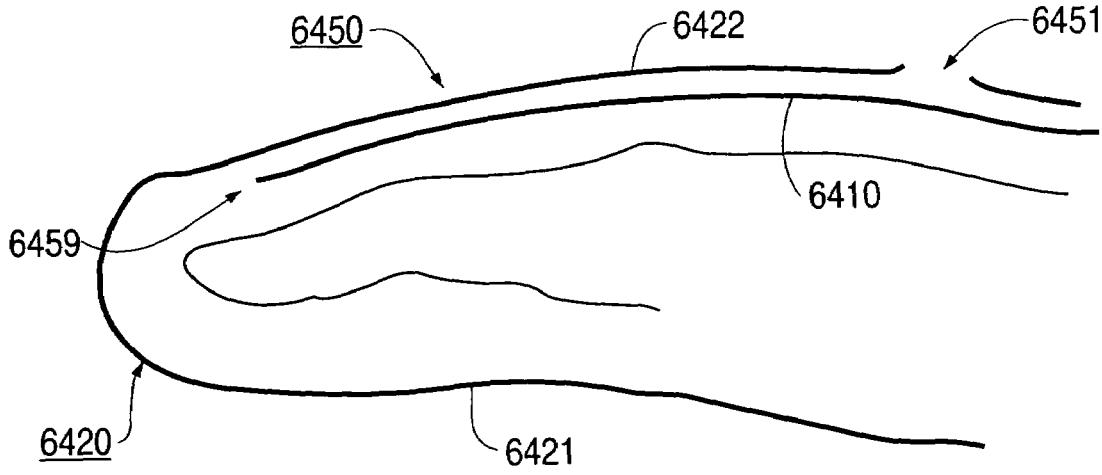

FIG. 211 depicts a partial cross sectional view of another embodiment of the invention along the line A—A of FIG. 3. As shown in FIG. 211, the cover 6420 includes a lower portion 6421 and an upper portion 6422, and the hand-receiving portion 6410 is disposed proximate to the cover upper portion 6422. The cover upper portion 6422 includes the inlet 6451. The outlet 6459 is defined between hand-receiving portion 6410 and cover upper portion 6422. The air-distribution device 6450 can define channels each associated with a finger or thumb of a user's hand.

FIG. 212 depicts a partial cross sectional view of another embodiment of the invention along the line A—A of FIG. 3. As shown in FIG. 212, the cover 6520 includes a lower portion 6521 and an upper portion 6522, and the hand-receiving portion 6510 includes lower hand-receiving portion 6511 and upper hand-receiving portion 6512. An air-distribution membrane 6553 is disposed between cover upper portion 6522 and upper hand-receiving portion 6512. A material layer 6590 (e.g., fabric or foam) is disposed between air-distribution membrane 6553 and upper hand-receiving portion 6512. The cover upper portion 6522 includes the inlet 6551. The outlet 6559 is defined between cover upper portion 6522 and air-distribution membrane 6553. The air-distribution membrane 6553 and cover upper portion 6522 collectively define air-distribution device 6550. Similar to the embodiment of the invention illustrated in and discussed with respect to FIG. 210 above, the cover upper portion 6522 and the upper hand-receiving portion 6512 can be coupled with seams. For example, such seams can include those on opposite side of each channel of the air-distribution device 6550. FIG. 212A depicts a partial cross sectional view of the air-distribution device 6550 with seams 6592 and 6594 that can couple the membrane 6553, the hand-receiving portion 6510 and the material layer 6590. Seams are discussed herein with respect to various embodiments of the invention.

FIG. 213 depicts a partial cross sectional view of another embodiment of the invention along the line A—A of FIG. 3. As shown in FIG. 213, the cover 6620 includes a lower portion 6621 and an upper portion 6622, and the hand-receiving portion 6610 is disposed proximate to the cover upper portion 6622. The cover upper portion 6622 and the hand-receiving portion 6610 collectively define air-distribution device 6650. A material layer 6670 includes a lower portion 6671 and an upper portion 6672, and is coupled to the outside of cover 6620. Such a material layer 6670 can provide an additional layer of heat or moisture retention. The cover upper portion 6622 and material layer 6670 include the inlet 6651. The outlet 6659 is defined between hand-receiving portion 6610 and cover upper portion 6622.

Figure 214:
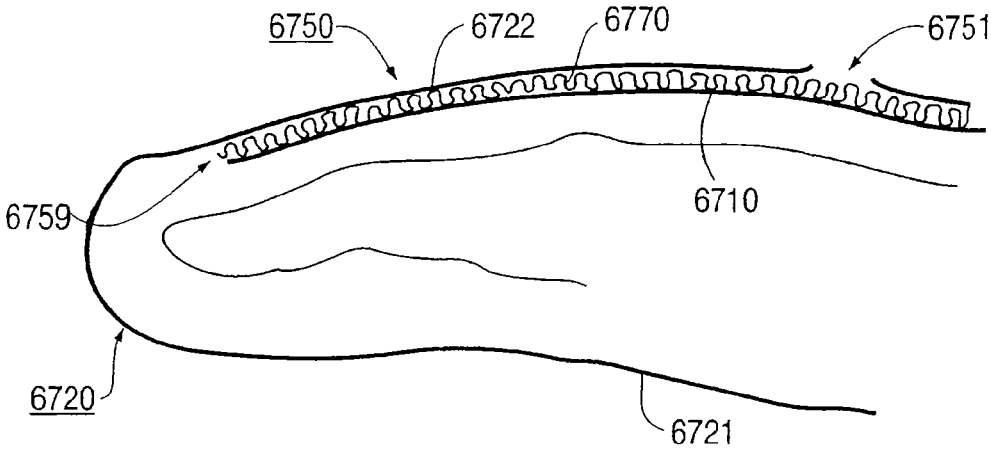

FIG. 214 depicts a partial cross sectional view of another embodiment of the invention along the line A—A of FIG. 3. As shown in FIG. 214, the cover 6720 includes a lower portion 6721 and an upper portion 6722, and the hand-receiving portion 6710 is disposed proximate to the cover upper portion 6722. The cover upper portion 6722 and the hand-receiving portion 6710 collectively define air-distribution device 6750. A material layer 6770 is disposed between cover upper portion 6722 and hand-receiving portion 6710. The cover upper portion 6722 includes the inlet 6751. The outlet 6759 is defined between hand-receiving portion 6710 and cover upper portion 6722.

Figure 215:
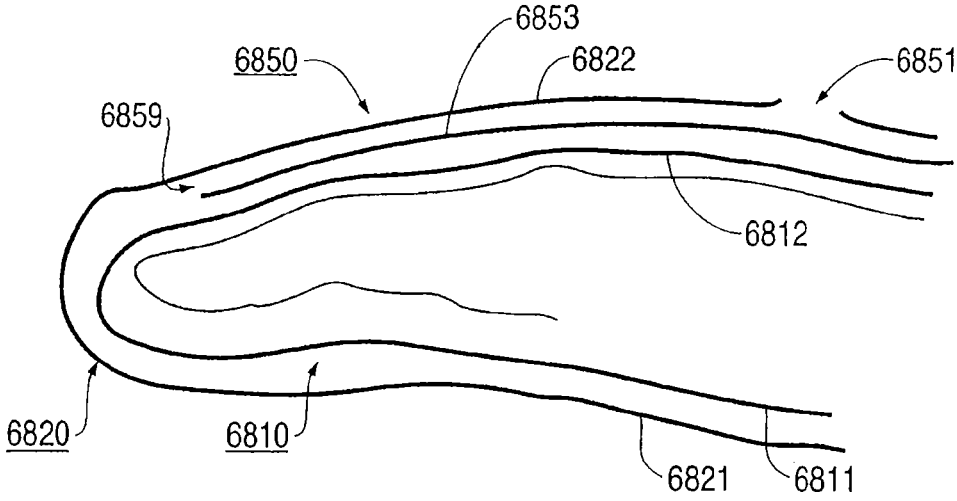

FIG. 215 depicts a partial cross sectional view of another embodiment of the invention along the line A—A of FIG. 3. As shown in FIG. 215, the cover 6820 includes a lower portion 6821 and an upper portion 6822, and the hand-receiving portion 6810 includes lower hand-receiving portion 6811 and upper hand-receiving portion 6812. An air-distribution membrane 6853 is disposed between cover upper portion 6822 and upper hand-receiving portion 6812. The cover upper portion 6822 includes the inlet 6851. The outlet 6859 defined between cover upper portion 6822 and air-distribution membrane 6853. The air-distribution membrane 6853 and cover upper portion 6822 collectively define air-distribution device 6850. As illustrated in FIG. 215, each of the membrane 6853 and the hand-receiving portion 6812 is substantially planar.

FIG. 216 depicts a partial cross sectional view of another embodiment of the invention along the line A—A of FIG. 3. As shown in FIG. 216, the cover 6920 includes a lower portion 6921 and an upper portion 6922, and the hand-receiving portion 6910 includes a lower portion 6911 and an upper portion 6912 that is disposed proximate to the cover upper portion 6922. The cover upper portion 6922 and the hand-receiving portion 6910 collectively define air-distribution device 6950. A material layer 6970 is disposed between cover upper portion 6922 and hand-receiving portion 6910. The cover upper portion 6922 includes the inlet 6951. The outlet 6959 is a hole within cover upper portion 6922 thereby directing the air inward toward the hand-receiving portion 6910.

FIG. 217 depicts a partial cross sectional view of another embodiment of the invention along the line A—A of FIG. 3. As shown in FIG. 217, the cover 7020 includes a lower portion 7021 and an upper portion 7022, and the hand-receiving portion 7010 includes a lower portion 7011 and an upper portion 7012 that is disposed proximate to the cover upper portion 7022. The cover upper portion 7022 includes the inlet 7051. The outlet 7059 is a hole within cover upper portion 7022 thereby directing the air inward toward the hand-receiving portion 7010. The cover upper portion 7022 and the hand-receiving portion 7010 collectively define air-distribution device 7050.

Figure 218:
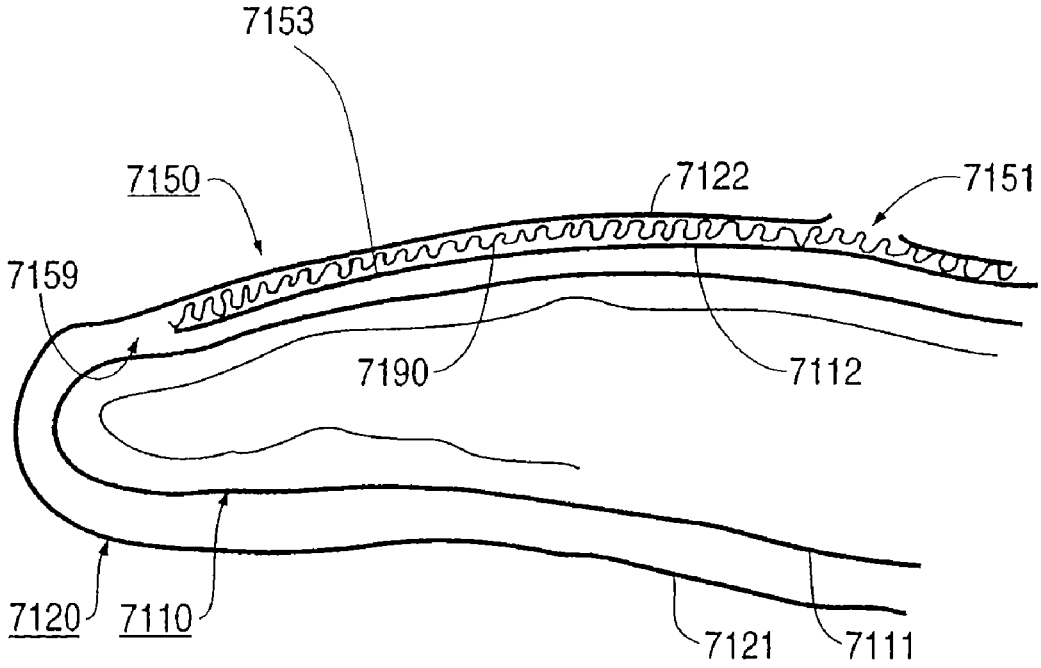

FIG. 218 depicts a partial cross sectional view of another embodiment of the invention along the line A—A of FIG. 3. As shown in FIG. 218, the cover 7120 includes a lower portion 7121 and an upper portion 7122, and the hand-receiving portion 7110 includes lower hand-receiving portion 7111 and upper hand-receiving portion 7112. An air-distribution membrane 7153 is disposed between cover upper portion 7122 and upper hand-receiving portion 7112. A material layer 7190 is disposed between cover upper portion 7122 and upper hand-receiving portion 7112. The cover upper portion 7122 includes the inlet 7151. The outlet 7159 defined between cover upper portion 7122 and air-distribution membrane 7153. The air-distribution membrane 7153 and cover upper portion 7122 collectively define air-distribution device 7150.

For the embodiments shown in FIGS. 210 through 218, the air-distribution device can define channels each associated with a finger or thumb of a user's hand. For example, the respective air-distribution device can have a shape similar to that shown in reference to air-distribution device 550 shown in FIG. 9. In addition, the corresponding cover upper portion, the upper hand-receiving portion, the air-distribution membrane and/or the material layer can be coupled with seams. For example, such seams can include those on opposite sides of each channel of the air-distribution device.

Although several embodiments are described above, many other variations are possible. For example, although several above-described embodiments refer to different portions such as a hand-receiving portion and a cover as separate materials, in other embodiments these portions can be a single material having multiple layers. Such a single material having multiple layers can be, for example, a laminate where the layers are glued or RF welded together in such a manner that the channels within the air distribution device are configured to allow the passage of air (e.g., a user's breath). For example, a single material having multiple layers including a foam-like or volume-maintaining layer can be included in a laminate. In such a case, the laminate can be constructed from all of these layers where the foam-like layer can maintain a volume through which air can pass within an air-distribution device.

In an alternative embodiment, multiple portions can be integrally formed. For example, when the air passage of the air-distribution device is constructed from a foam layer, the upper membrane and the lower membrane of the air-distribution device can be integrally formed with the foam. Such upper and lower membranes can be constructed as a by-product of the manufacture process of the foam where the upper and lower membranes are sfilm-like, waterproof surfaces. In this embodiment, the foam layer can allow the transport of air through the air-distribution device, while the upper and lower membranes can direct the air through the air passage while minimizing (or preventing) air from passing through the upper and lower membranes of the air-distribution device.

In addition, although several above-described embodiments refer to certain portions or membranes having desired characteristics, many other variations are possible. For example, in the description relating to FIGS. 6 and 7, the material 360 within the air-distribution device 350 is described above as being selected for desired temperature-management properties and desired moisture-management properties. In embodiments having a device similar to air-distribution device 350, other portions of the glove such as the cover can also similar properties. For example, for the embodiment shown in FIGS. 10 through 14, the cover 120 can be a moisture-retaining material, thereby providing another portion of the glove for retaining moisture close to yet away from the user's skin. Said another way, the cover 120 and the materials of air-distribution device 350 each can have its own moisture-retaining characteristic at least one of which is greater than the moisture-retaining characteristic of the hand-receiving portion.

By way of another example, the glove shown in FIG. 215 can have portions made of moisture-retaining materials. For example, air-distribution membrane 6853 and cover 6820 can be made of moisture-retaining materials, and hand-receiving portion 6810 can be made of a heat-retaining material that does not have a strong moisture-retaining characteristic. In other words, the moisture-retaining characteristic of the hand-receiving portion 6810 can be less than the moisture-retaining characteristic of the cover 6820 and the moisture-retaining characteristic of the air-distribution membrane 6853.

In sum, one or more portion(s) of the glove not in direct contact with the user's skin can have moisture-retaining characteristics while the portion(s) of the glove in direct contact with the user's skin can be made of a material that has a less moisture-retaining characteristic. As discussed above, by retaining moisture within the glove at a membrane, portion or layer that is not immediately in contact with the user's skin, the temperature within the glove can be enhanced for an extended period of time while avoiding the discomfort of a wet or moist surface in contact with the user's skin.

In a further embodiment of the invention, the hand coverings are configured such that when they are not in use they may be disposed within a water and wind resistant shell. Additionally, one or both of the hand coverings may include a pouch or pocket that is configured to house the shell when the hand coverings are in use.

In a further embodiment of the invention, the hand coverings are configured to collapse into a small, compact package. Thus, the hand coverings are easily stored when they are not in use.

In a further embodiment of the invention, the hand coverings include elastic material. The elastic material is located and configured to maintain a tight or snug fit against the hand of a user. In yet a further embodiment of the invention, the elastic material is located in the finger area and is configured such that when the finger is in the closed position the material is relaxed and when the finger is in a prone position the elastic material is stretched. Thus, the elastic material gathers the bulk of the glove when the finger is in a prone position.

CONCLUSION

While various embodiments of the present invention have been described above, it should be understood that they have been presented by way of example only, and not limitation. Thus, the breadth and scope of the present invention should not be limited by any of the above-described embodiments, but should be defined only in accordance with the following claims and their equivalents.

The previous description of the embodiments is provided to enable any person skilled in the art to make or use the present invention. While the invention has been particularly shown and described with reference to embodiments thereof, it will be understood by those skilled in the art that various changes in form and details may be made therein without departing from the spirit and scope of the invention.

Although not explicitly shown, the air covers described above can be used in conjunction with any of the hand covering embodiments. For example, the air covers described above can be modified for use with the tube-like air conduits described in reference to FIGS. 22 through 24.

In another embodiment, the air cover shown in reference to FIG. 159 can be used in conjunction with the hand coverings in which no air conduit is provided (see, e.g., FIGS. 19 and 20). In such an embodiment, the cover of the hand covering can include a conduit portion adjacent to which the inlet of the air distribution device is disposed. Thus, the inlet cover can be coupled to the conduit portion of the cover. The inlet cover can be removed from the cover by pulling the inlet cover away from the conduit portion of the cover. In a further embodiment, the air cover shown in reference to FIG. 159 can be used in conjunction with the hand coverings in which no air distribution device is provided (see, e.g., FIG. 19).

What is claimed is:

1. A hand covering, comprising:

a hand-receiving portion having an upper portion;

a membrane coupled to the hand-receiving portion, the membrane having an upper portion, the upper portion of the membrane and the upper portion of the hand-receiving portion each being substantially planar and collectively defining an air-distribution device having an inlet and an outlet, the inlet and the outlet of the air distribution device being positioned in a spaced apart relation, the air-distribution device having a plurality of channels, each channel from the plurality of channels being defined by a first seam and a second seam disposed on opposite sides of that channel and each coupling a portion of the upper portion of the membrane and the upper portion of the hand-receiving portion; and a material layer disposed between the upper portion of the hand-receiving portion and the upper portion of the membrane.

2. The hand covering of claim 1, wherein:

at least one of the membrane and the hand-receiving portion is a moisture-retaining fabric.

3. The hand covering of claim 1, wherein:

the membrane is associated with a moisture-retaining characteristic; and the hand-receiving portion is associated with a moisture-retaining characteristic, the moisture-retaining characteristic of the hand-receiving portion being less than the moisture-retaining characteristic of the membrane.

4. The hand covering of claim 1, wherein: each of said first seam and said second seam coupling a portion of the upper portion of the membrane, a portion of the hand-receiving portion and a portion of the material layer.

5. The hand covering of claim 1, wherein: the material layer has an upper portion, the membrane having an outer side, the material layer being coupled to the outer side of the membrane, the upper portion of the membrane being disposed between the hand-receiving portion and the upper portion of the material layer.

6. A hand covering, comprising:

a hand-receiving portion having an upper portion;

a membrane coupled to the hand-receiving portion, the membrane having an upper portion, the upper portion of the membrane being arcuate in cross section and having a concavity with respect to a direction, the upper portion of the hand-receiving portion being arcuate in cross section and having a concavity with respect to the direction, the membrane and the hand-receiving portion collectively defining an air-distribution device having an inlet and an outlet, the inlet and the outlet of the air distribution device being positioned in a spaced apart relation, the air-distribution device having a plurality of channels, each channel from the plurality of channels being defined by a first seam and a second seam disposed on opposite sides of that channel and each coupling a portion of the upper portion of the membrane and a portion of the hand-receiving portion, and a material layer disposed between the upper portion of the hand-receiving portion and the upper portion of the membrane.

7. The hand covering of claim 6, wherein:

at least one of the membrane and the hand-receiving portion is a moisture-retaining fabric.

8. The hand covering of claim 6, wherein:

the membrane is associated with a moisture-retaining characteristic; and the hand-receiving portion is associated with a moisture-retaining characteristic, the moisture-retaining characteristic of the hand-receiving portion being less than the moisture-retaining characteristic of the membrane.

9. The hand covering of claim 6, wherein: each of said first seam and said second seam coupling a portion of the upper portion of the membrane, a portion of the hand-receiving portion and a portion of the material layer.

10. The hand covering of claim 6, wherein: the material layer has an upper portion, the membrane having an outer side, the material layer being coupled to the outer side of the membrane, the upper portion of the membrane being disposed between the upper portion of the hand-receiving portion and the upper portion of the material layer.

11. A hand covering, comprising:

a hand-receiving portion being closed at a first end and defining an opening at a second end, the hand-receiving portion being associated with a moisture-retaining characteristic;

a cover coupled to the hand-receiving portion, the cover having an upper portion, the cover being associated with a moisture-retaining characteristic; and an air-distribution membrane disposed between the cover and the hand-receiving portion, the upper portion of the cover and the air-distribution membrane each being substantially planar and collectively defining an air-distribution device having an inlet and an outlet, the inlet and the outlet of the air distribution device being positioned in a spaced apart relation, the outlet being disposed substantially at the first end of the hand-receiving portion and configured to exhaust air inwardly towards the hand receiving portion, the air-distribution membrane being associated with a moisture-retaining characteristic, the moisture-retaining characteristic of the hand-receiving portion being less than at least one of the moisture-retaining characteristic of the cover and the moisture-retaining characteristic of the air-distribution membrane.

12. The hand covering of claim 11, wherein:

at least one of the cover, the air-distribution membrane and the hand-receiving portion is a moisture-retaining fabric.

13. The hand covering of claim 11, wherein:

at least two of the hand-receiving portion, the air-distribution membrane and the cover are layers of a laminate.

14. The hand covering of claim 11, wherein:

the air-distribution device has a plurality of channels, each channel from the plurality of channels being defined by a first seam and a second seam disposed on opposite sides of that channel and each coupling a portion of the upper portion of the cover and a portion of the air-distribution membrane.

15. The hand covering of claim 11, further comprising:

a material layer disposed between the air-distribution membrane and the cover.

16. The hand covering of claim 11, further comprising:

a material layer disposed between the air-distribution membrane and the cover, the air-distribution device having a plurality of channels, each channel from the plurality of channels being defined by a first seam and a second seam disposed on opposite sides of that channel and each coupling a portion of the upper portion of the cover, a portion of the air-distribution membrane and a portion of the material layer.

17. A hand covering, comprising:

a hand-receiving portion being closed at a first end and defining an opening at a second end;

a cover coupled to the hand-receiving portion, the cover having an upper portion; and an air-distribution membrane disposed between the cover and the hand-receiving portion, the upper portion of the cover being arcuate in cross section and having a concavity with respect to a direction, the air-distribution membrane being arcuate in cross section and having a concavity with respect to the direction, the upper portion of the cover and the air-distribution membrane collectively defining an air distribution device having an inlet and an outlet, the inlet and the outlet of the air distribution device being positioned in a spaced apart relation, the outlet being disposed substantially at the first end of the hand-receiving portion and configured to exhaust air inwardly towards the hand receiving portion and the air-distribution device having a plurality of channels, each channel from the plurality of channels being defined by a first seam and a second seam disposed on opposite sides of that channel and each coupling a portion of the upper portion of the cover and a portion of the air-distribution membrane.

18. The hand covering of claim 17, wherein:

at least one of the cover, the air-distribution membrane and the hand-receiving portion is a moisture-retaining fabric.

19. The hand covering of claim 17, wherein:

the cover is associated with a moisture-retaining characteristic;

the air-distribution membrane is associated with a moisture-retaining characteristic; and the hand-receiving portion is associated with a moisture-retaining characteristic, the moisture-retaining characteristic of the hand-receiving portion being less than at least one of the moisture-retaining characteristic of the cover and the moisture-retaining characteristic of the air-distribution membrane.

20. The hand covering of claim 17, wherein:

at least two of the hand-receiving portion, the air-distribution membrane and the cover are layers of a laminate.

21. The hand covering of claim 17, further comprising:

a material layer disposed between the air-distribution membrane and the cover.

22. The hand covering of claim 21, wherein:

at least two of the cover, the material layer, the air-distribution membrane and the hand-receiving portion are layers of a laminate.

23. The hand covering of claim 17, further comprising:

a material layer disposed between the air-distribution membrane and the cover, each of said first seam and said second seam coupling a portion of the upper portion of the cover, a portion of the air-distribution membrane and a portion of the material layer.

24. A hand covering, comprising:

a hand-receiving portion being closed at a first end, defining an opening at a second end and having an interior portion; and an air-distribution device having a first membrane, a second membrane and a material layer, the first membrane, the second membrane and the material layer each having a perimeter portion, at least a portion of the perimeter portion of the first membrane being coupled to corresponding perimeter portions of the second membrane and the material layer, the air-distribution device being coupled to the hand-receiving portion, the first membrane defining an inlet into the interior portion, the second membrane further defining a plurality of outlets in gaseous communication with the inlet and the interior portion of the hand-receiving portion, the inlet and the plurality of outlets of the air distribution device being positioned in a spaced apart relation.

25. The hand covering of claim 24, wherein:

at least one of the first membrane, the second membrane and the material layer of the air-distribution device is a moisture-retaining fabric.

26. The hand covering of claim 24, wherein:

the first membrane of the air-distribution device is associated with a moisture-retaining characteristic;

the second membrane of the air-distribution device is associated with a moisture-retaining characteristic;

the material layer of the air-distribution device is associated with a moisture-retaining characteristic; and the hand-receiving portion is associated with a moisture-retaining characteristic, the moisture-retaining characteristic of the hand-receiving portion being less than at least one of the moisture-retaining characteristic of the first membrane, the moisture-retaining characteristic of the second membrane and the moisture-retaining characteristic of the material layer.

27. The hand covering of claim 24, wherein:

at least two of the hand-receiving portion, the first membrane of the air-distribution device, the second membrane of the air-distribution device and the material layer of the air-distribution device are layers of a laminate.

28. The hand covering of claim 24, wherein:

the material layer being disposed between the first membrane and the second membrane.

29. The hand covering of claim 24, wherein:

the second membrane being disposed between the first membrane and the material layer.

30. A hand covering, comprising:

a hand-receiving portion being closed at a first end and defining an opening at a second end, the hand-receiving portion being a porous material;

a cover coupled to the hand-receiving portion, the cover having an upper portion;

a material layer at least partially disposed between the hand-receiving portion and the cover; and an air-distribution membrane at least partially disposed between the hand-receiving portion and the material layer, the air-distribution membrane, the material layer and the upper portion of the cover collectively defining an air distribution device having an inlet and an outlet, the air-distribution device being substantially planar, the inlet and the outlet of the air distribution device being positioned in a spaced apart relation, the outlet being disposed substantially at the first end of the hand-receiving portion and configured to exhaust air inwardly towards the hand receiving portion, the air-distribution membrane and the material layer each having a perimeter portion, at least a portion of the perimeter portion of the air-distribution membrane and at least a portion of the perimeter portion of material layer being coupled to the upper portion of the cover, the air-distribution device being coupled to the hand-receiving portion.

* * * * *